US010668341B2

(12) United States Patent
Jertson et al.

(10) Patent No.: US 10,668,341 B2
(45) Date of Patent: Jun. 2, 2020

(54) GOLF CLUB HEAD WITH ADJUSTABLE RESTING FACE ANGLE

(71) Applicant: KARSTEN MANUFACTURING CORPORATION, Phoenix, AZ (US)

(72) Inventors: Martin R. Jertson, Cave Creek, AZ (US); Daniel K. Lee, Chandler, AZ (US); Xiaojian Chen, Phoenix, AZ (US); Travis D. Milleman, Portland, OR (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/973,398

(22) Filed: May 7, 2018

(65) Prior Publication Data

US 2018/0318675 A1 Nov. 8, 2018

Related U.S. Application Data

(60) Provisional application No. 62/501,873, filed on May 5, 2017, provisional application No. 62/506,387, filed
(Continued)

(51) Int. Cl.
*A63B 53/06* (2015.01)
*A63B 53/04* (2015.01)
(Continued)

(52) U.S. Cl.
CPC ..... *A63B 53/06* (2013.01); *A63B 53/0466* (2013.01); *A63B 60/52* (2015.10);
(Continued)

(58) Field of Classification Search
CPC ..... A63B 2053/0433
(Continued)

(56) References Cited

U.S. PATENT DOCUMENTS 5,213,329 A * 5/1993 Okumoto ..... A63B 53/04 473/328
5,807,186 A * 9/1998 Chen ..... A63B 53/04 473/248
(Continued)

FOREIGN PATENT DOCUMENTS

JP 2003062131 A * 3/2003
JP 4177414 11/2008
(Continued)

OTHER PUBLICATIONS

International Search Report and Written Opinion for PCT Application No. PCT/US2018/031446, 13 pages, dated Oct. 11, 2018.
(Continued)

*Primary Examiner* — Alvin A Hunter

(57) ABSTRACT

A golf club head includes a club body and a resting face angle adjuster. The club body includes a crown opposite a sole, a toe end opposite a heel end, a back end opposite a face, and a hosel. The sole includes a sole surface. The resting face angle adjuster includes an adjustment member having a keel surface, and a recess formed in the sole such that a portion of the sole surface at least partially bounds the recess. The adjustment member is disposed in the recess and positionable between a first adjustment position and a second adjustment position. In the first adjustment position, the keel surface is at a first distance relative to the portion of the sole surface. In the second adjustment position, the keel surface is at a second distance relative to the portion of the sole surface not equal to the first distance in the direction.

20 Claims, 27 Drawing Sheets

Related U.S. Application Data on May 15, 2017, provisional application No. 62/658,437, filed on Apr. 16, 2018.

(51) Int. Cl.
*A63B 60/52* (2015.01)
*A63B 102/32* (2015.01)

(52) U.S. Cl.
CPC ..... *A63B 2053/0433* (2013.01); *A63B 2053/0445* (2013.01); *A63B 2102/32* (2015.10)

(58) Field of Classification Search
USPC ..... 473/324–350, 246, 248
See application file for complete search history.

(56) References Cited

U.S. PATENT DOCUMENTS

| | | | | |
|---|---|---|---|---|
| 6,475,100 | B1 | 11/2002 | Helmstetter et al. | |
| 7,934,999 | B2 * | 5/2011 | Cackett | A63B 53/0466 473/242 |
| 8,012,034 | B1 * | 9/2011 | Cackett | A63B 53/0466 473/242 |
| 8,025,587 | B2 * | 9/2011 | Beach | A63B 53/0466 473/245 |
| 8,262,496 | B1 | 9/2012 | Cackett | |
| 8,303,429 | B2 * | 11/2012 | Cackett | A63B 53/0466 473/246 |
| 8,337,319 | B2 * | 12/2012 | Sargent | A63B 53/02 473/246 |
| 8,517,851 | B2 * | 8/2013 | Cackett | A63B 53/0466 473/242 |
| 8,641,554 | B1 | 2/2014 | Hocknell et al. | |
| 8,668,596 | B2 * | 3/2014 | Cackett | A63B 53/0466 473/242 |
| 9,114,292 | B2 * | 8/2015 | Clausen | A63B 53/0466 |
| 9,114,294 | B2 * | 8/2015 | Clausen | A63B 53/0466 |
| 9,295,885 | B2 | 3/2016 | Matsunaga | |
| 9,320,950 | B2 | 4/2016 | Matsunaga | |
| 9,931,551 | B2 * | 4/2018 | Mizutani | A63B 53/0466 |
| 2010/0292018 | A1 | 11/2010 | Cackett et al. | |
| 2011/0152000 | A1 | 6/2011 | Sargent et al. | |
| 2013/0337935 | A1 | 12/2013 | Evans | |
| 2014/0274449 | A1 | 9/2014 | Greensmith et al. | |
| 2014/0316542 | A1 | 10/2014 | Beno et al. | |
| 2015/0011327 | A1 | 1/2015 | Matsunaga et al. | |
| 2015/0031468 | A1 | 1/2015 | Matsunaga et al. | |
| 2015/0031470 | A1 | 1/2015 | Matsunaga et al. | |
| 2015/0105176 | A1 | 4/2015 | Sander et al. | |
| 2015/0352414 | A1 | 12/2015 | Clausen et al. | |
| 2016/0045795 | A1 | 2/2016 | Clausen et al. | |
| 2016/0129322 | A1 | 5/2016 | Myers et al. | |

FOREIGN PATENT DOCUMENTS

| | | | | |
|---|---|---|---|---|
| JP | 2009136608 | | 6/2009 | |
| JP | 2011229914 | | 11/2011 | |
| JP | 2011229914 | A * | 11/2011 | |
| JP | 2014057832 | A * | 4/2014 | A63B 53/0466 |
| JP | 2015019998 | A * | 2/2015 | A63B 53/0466 |

OTHER PUBLICATIONS

Mizuno JPX 900 Driver; accessed on Jul. 26, 2018; https://www.mizunousa.com/category/golf+content/jpx+900+drivers.do.

* cited by examiner

GOLF CLUB HEAD WITH ADJUSTABLE RESTING FACE ANGLE

CROSS-REFERENCE TO RELATED APPLICATIONS

This claims priority to U.S. Provisional Patent Application No. 62/501,873, filed on May 5, 2017, U.S. Provisional Patent Application No. 62/506,387, filed on May 15, 2017, and U.S. Provisional Patent Application No. 62/658,437, filed on Apr. 16, 2018, the contents of all of which are hereby incorporated in their entirety.

BACKGROUND

Various characteristics of a golf club can affect the performance of the golf club, including the position of the center of gravity and the resting face angle.

SUMMARY

The disclosure provides, in one aspect, a golf club head including a club body and a resting face angle adjuster. The club body includes a crown opposite a sole, a toe end opposite a heel end, a back end opposite a face, and a hosel. The sole includes a sole surface. The resting face angle adjuster includes an adjustment member having a keel surface, and a recess formed in the sole such that a portion of the sole surface at least partially bounds the recess. The adjustment member is disposed in the recess and positionable between a first adjustment position and a second adjustment position. When the adjustment member is positioned in the first adjustment position, the keel surface is at a first distance relative to the portion of the sole surface in a direction orthogonal to the portion of the sole surface. When the adjustment member is positioned in the second adjustment position, the keel surface is at a second distance relative to the portion of the sole surface not equal to the first distance in the direction.

The disclosure provides, in another aspect, a golf club head including a club body and a resting face angle adjuster. The club body includes a crown opposite a sole, a toe end opposite a heel end, a back end opposite a face, and a hosel. The sole includes a sole surface. The resting face angle adjuster includes an adjustment member positionable within a recess formed in the sole and defining a recess edge. The adjustment member includes a keel surface, and is positionable between a first adjustment position and a second adjustment position. When the adjustment member is positioned in the first adjustment position, a portion of the keel surface is at a first distance from a portion of the recess edge. When the adjustment member is positioned in the second adjustment position, the portion of the keel surface is at a second distance from the portion of the recess edge greater than the first distance.

The disclosure provides, in another aspect, a golf club head including a club body and a resting face angle adjuster. The club body includes a crown opposite a sole, a toe end opposite a heel end, a back end opposite a face, and a hosel. The sole includes a sole surface. The resting face angle adjuster includes an adjustment member positionable within a recess formed in the sole. The adjustment member includes a keel surface positionable between a first adjustment position and a second adjustment position. The resting face angle adjustment member is configured such that when the adjustment member is positioned in the first adjustment position, the adjustment member effects a keel point at a first location on the club body when the club head is at an address position. When the adjustment member is positioned in the second adjustment position, the adjustment member effects a keel point at a second location on the club body when the club head is at the address position.

The disclosure provides, in another aspect, a golf club head including a club body and a resting face angle adjuster. The club body includes a crown opposite a sole including a sole surface, a toe end opposite a heel end, a back end opposite a face, a hosel, and a hosel recess having a hosel surface configured to receive a fastener for securing a golf club shaft to the club body, the hosel recess defining a recess edge. A portion of the sole surface bounds the recess edge. The resting face angle adjuster includes an adjustment member disposed within the hosel recess, the adjustment member including a keel surface. The adjustment member is positionable between a first adjustment position and a second adjustment position. The adjuster is configured such that when the adjustment member is positioned in the first adjustment position, the keel surface is at a first distance relative to the portion of the sole surface in a direction orthogonal to the portion of the sole surface. When the adjustment member is positioned in the second adjustment position, the keel surface is at a second distance relative to the portion of the sole surface not equal to the first distance in the direction.

DETAILED DESCRIPTION

Figure 1:
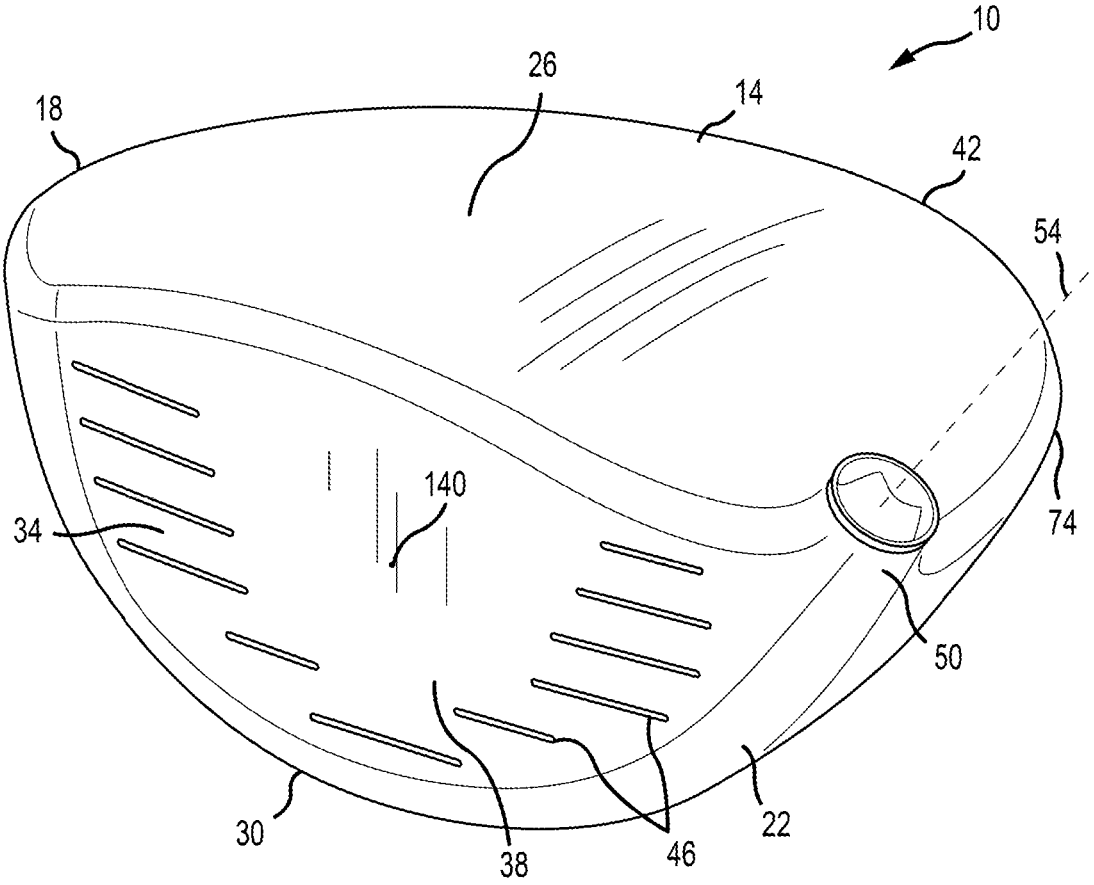
FIG. 1 is a perspective view of a golf club head that includes one or more embodiments of a resting face angle adjuster as disclosed herein.

Described herein is a golf club head having a multi-component resting face angle adjuster that allows a user to adjust a resting face angle of the golf club head. The club head generally includes a club head body having a crown opposite a sole, a toe end opposite a heel end, a back end opposite a face, a hosel, and a recess formed in the club body. The adjuster includes an adjustment member configured to be wholly or partially received by the recess and selectively fastened to the club head body. In many embodiments, the adjustment members described herein protrude from the external contour of the club head, or are minimally inserted or recessed from the external contour of the club head. The adjustment members are configured to slide or pivot relative to the recess toward or away from the external contour of the sole of the club head. The adjustment members may further be configured to slide or pivot relative to the recess toward or away from the face, and/or toward or away from the toe end. In some embodiments, the above-mentioned recess for the adjuster is the hosel recess formed in the club head to provide access to the club shaft fastener, and the adjustment member includes an adjustable bracket affixed to a surface of the hosel recess.

The term "resting face angle" (RFA) of a golf club, as described herein, refers to the angle formed between the club face and the golf ball at address (i.e., prior to the swing), and more specifically between the club face and an imaginary line that extends from the golf ball along a player's intended target line at address. It should be appreciated that the RFA is in a neutral position when the club face is square (or generally perpendicular) to the target line. The RFA is in an open position when the club head rotates about the shaft such that the toe end moves away from the ball relative to the target line. The RFA is in a closed position when the club head rotates about the shaft such that the toe end moves towards the ball relative to the target line. The RFA of a golf club head can bias or promote a player's tendency to hook or slice a golf ball. The closed position will bias a right-handed player to hook the golf ball trajectory to the left. The open position will bias a right-handed player to slice the golf ball trajectory to the right.

The RFA of the golf club is dictated by the relationship between the location on the sole at which the club naturally rests on the ground surface at address, commonly referred to as the keel point, and the center of gravity (CG) of the club. In some embodiments, only one keel point exists. In such embodiments, the keel point will align with the CG of the golf club head, allowing an imaginary axis perpendicular to the ground to pass through both the keel point and the CG of the club. In other embodiments, two keel points exist. In such embodiments, a first keel point is located on a first side of the sole with respect to the CG, and the second keel point located on a second side of the sole with respect to the CG opposite the first side.

The height of a keel point is referred to as the distance by which the keel point projects outward relative to the surrounding natural curvature of the sole or sole features, for example measured orthogonal to an adjacent surface portion of the sole. The greater the height of the keel point, the more protruded the point is from the remainder of the sole. In embodiments having a first keel point located forward of the CG (i.e., closer to the face) and a second keel point located behind the CG (i.e., closer to the back end), changing the height or location relative to the sole of either the first keel point or the second keel point will influence the RFA of the club head. For example, increasing the height of the first keel point, while maintaining the height of the second keel point, tends to open the RFA so that the golf club head rests in a more open position at address. Similarly, decreasing the height of the second keel point, while maintaining the height of the first keel point, also tends to open the RFA so that the club head rests in a more open position at address. Conversely, decreasing the height of the first keel point, while maintaining the height of the second keel point, tends to close the RFA so that the club head rests in a more closed position at address. Similarly, increasing the height of the second keel point, while maintaining the height of the first keel point, also tends to close the RFA so that the club head rests in a more closed position at address.

Other features and aspects will become apparent by consideration of the following detailed description and accompanying drawings. Before any embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

For ease of discussion and understanding, and for purposes of description only, the following detailed description illustrates a golf club head 10 as a wood, and more specifically a driver (FIGS. 1-49). It should be appreciated that the driver is provided for purposes of illustration of one or more embodiments of a resting face angle adjuster 100 (FIGS. 1-9), 200 (FIGS. 10-17), 300 (FIGS. 18-23), 400 (FIGS. 24-29), 500 (FIGS. 30-37), 600 (FIGS. 38-43), and 700 (FIGS. 44-49) as disclosed herein. The disclosed adjuster 100, 200, 300, 400, 500, 600, 700 can be used on any desired golf club head 10, including a wood, a hybrid, an iron, a putter, or other golf club where one or more adjustment members can be adjustably positioned on the golf club head 10. For example, the club head 10 can include, but is not limited to, a driver, a fairway wood, a hybrid, a one-iron, a two-iron, a three-iron, a four-iron, a five-iron, a six-iron, a seven-iron, an eight-iron, a nine-iron, a pitching wedge, a gap wedge, a utility wedge, a sand wedge, a lob wedge, and/or a putter. In addition, the golf club head 10 can have a loft that can range from approximately 3 degrees to approximately 65 degrees (including, but not limited to, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 20.5, 21, 21.5, 22, 22.5, 23, 23.5, 24, 24.5, 25, 25.5, 26, 26.5, 27, 27.5, 28, 28.5, 29, 29.5, 30, 30.5, 31, 31.5, 32, 32.5, 33, 33.5, 34, 34.5, 35, 35.5, 36, 36.5, 37, 37.5, 38, 38.5, 39, 39.5, 40, 40.5, 41, 41.5, 42, 42.5, 43, 43.5, 44, 44.5, 45, 45.5, 46, 46.5, 47, 47.5, 48, 48.5, 49, 49.5, 50, 50.5, 51, 51.5, 52, 52.5, 53, 53.5, 54, 54.5, 55, 55.5, 56, 56.5, 57, 57.5, 58, 58.5, 59, 59.5, 60, 60.5, 61. 61.5, 62, 62.5, 63, 63.5, 64, 64.5, and/or 65 degrees).

FIGS. 1-9 illustrate an embodiment of the golf club head 10 that incorporates one or more embodiments of the resting face angle adjuster 100, 200, 300, 400, 500, 600, 700 disclosed herein. The golf club head 10 includes a club body 14 (or body 14) having a toe end 18 (or toe 18) opposite a heel end 22 (or heel 22). The body 14 also includes a crown 26 (or top 26) opposite a sole 30 (or bottom 30). The body 14 carries a face plate 34 (or strike plate 34 or club face 34) that defines a strike surface 38. The face plate 34 is positioned opposite a back end 42 (or rear end 42 or rear 42 or back side 42) (shown in FIGS. 1 and 3A). A plurality of grooves 46 (shown in FIG. 1) can be positioned on the face plate 34. The golf club head 10 also includes a hosel 50 having a hosel axis 54 (shown in FIG. 1) that extends through a center of the hosel 50. The hosel 50 is configured to receive a golf club shaft (not shown) that carries a grip (not shown).

The strikeface 34 of the club head 10 defines a geometric center 140. In some embodiments, the geometric center 140 can be located at the geometric centerpoint of a strikeface perimeter, and at a midpoint of face height. In the same or other examples, the geometric center 140 also can be centered with respect to engineered impact zone, which can be defined by a region of grooves on the strikeface. As another approach, the geometric center of the strikeface can be located in accordance with the definition of a golf governing body such as the United States Golf Association (USGA). For example, the geometric center 140 of the strikeface 34 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

Figure 2:
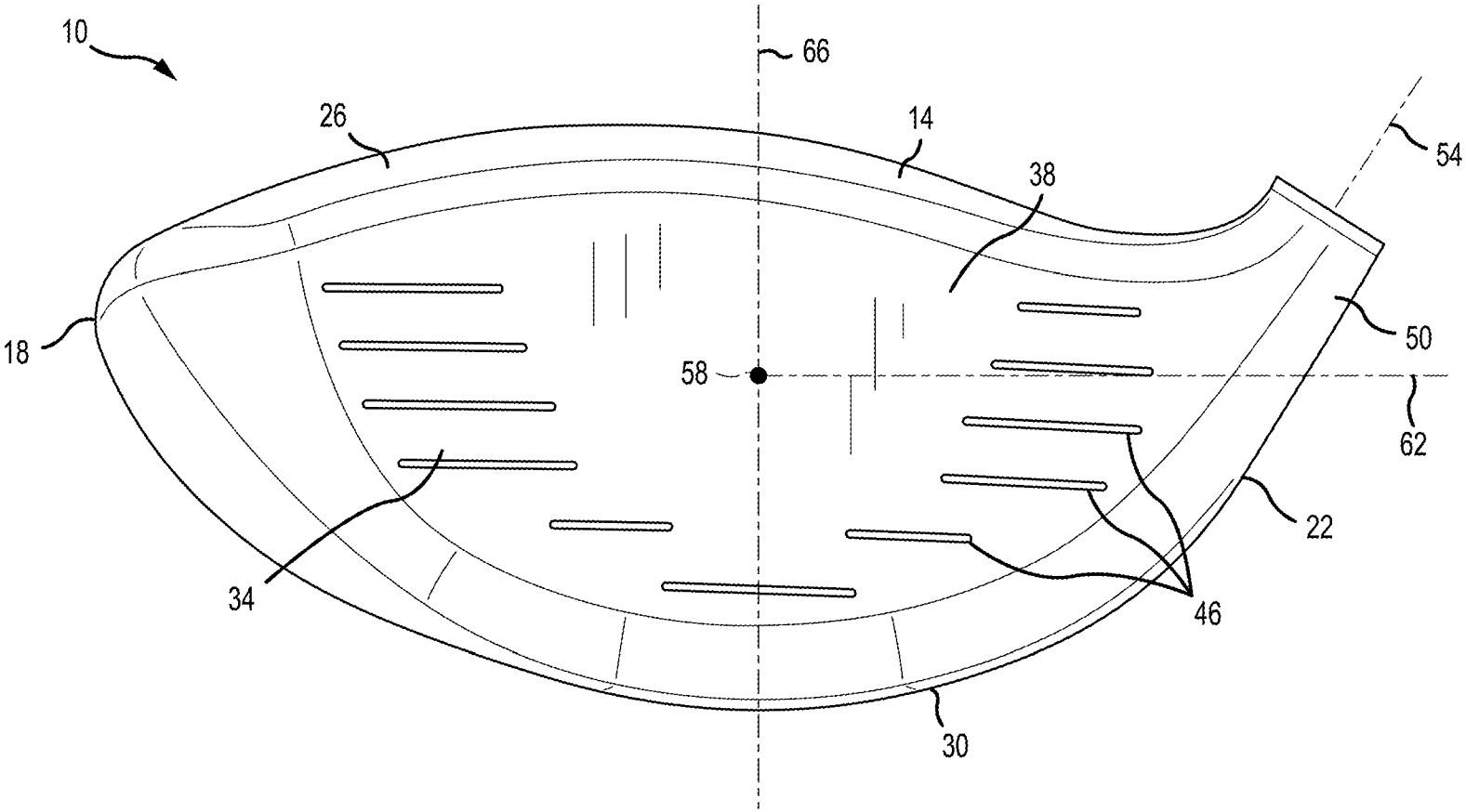
FIG. 2 is a front view of the club head of FIG. 1, illustrating the face plate.
Figure 3A:
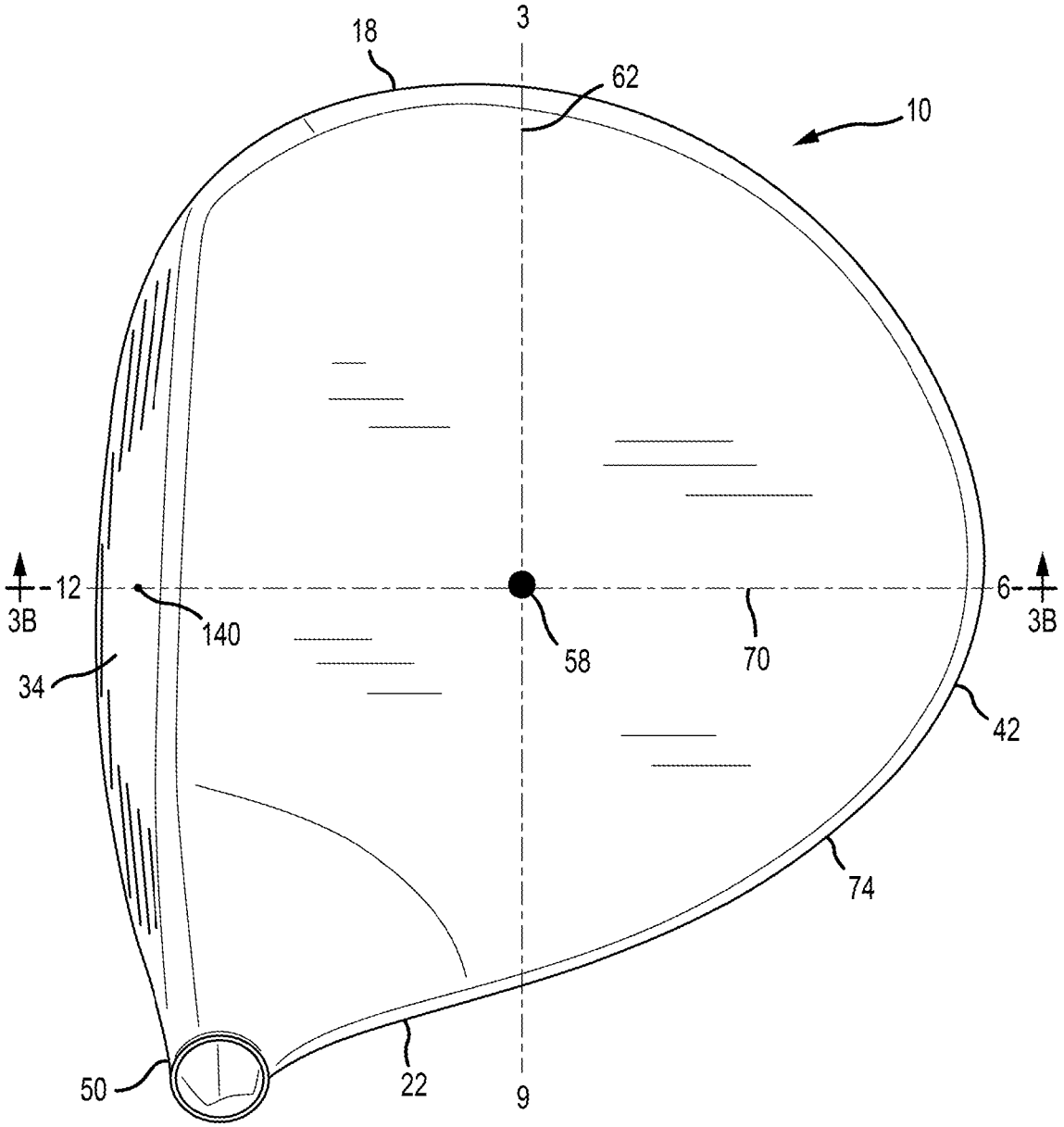
FIG. 3A is a top (or crown) view of the club head of FIG. 1.
Figure 3B:
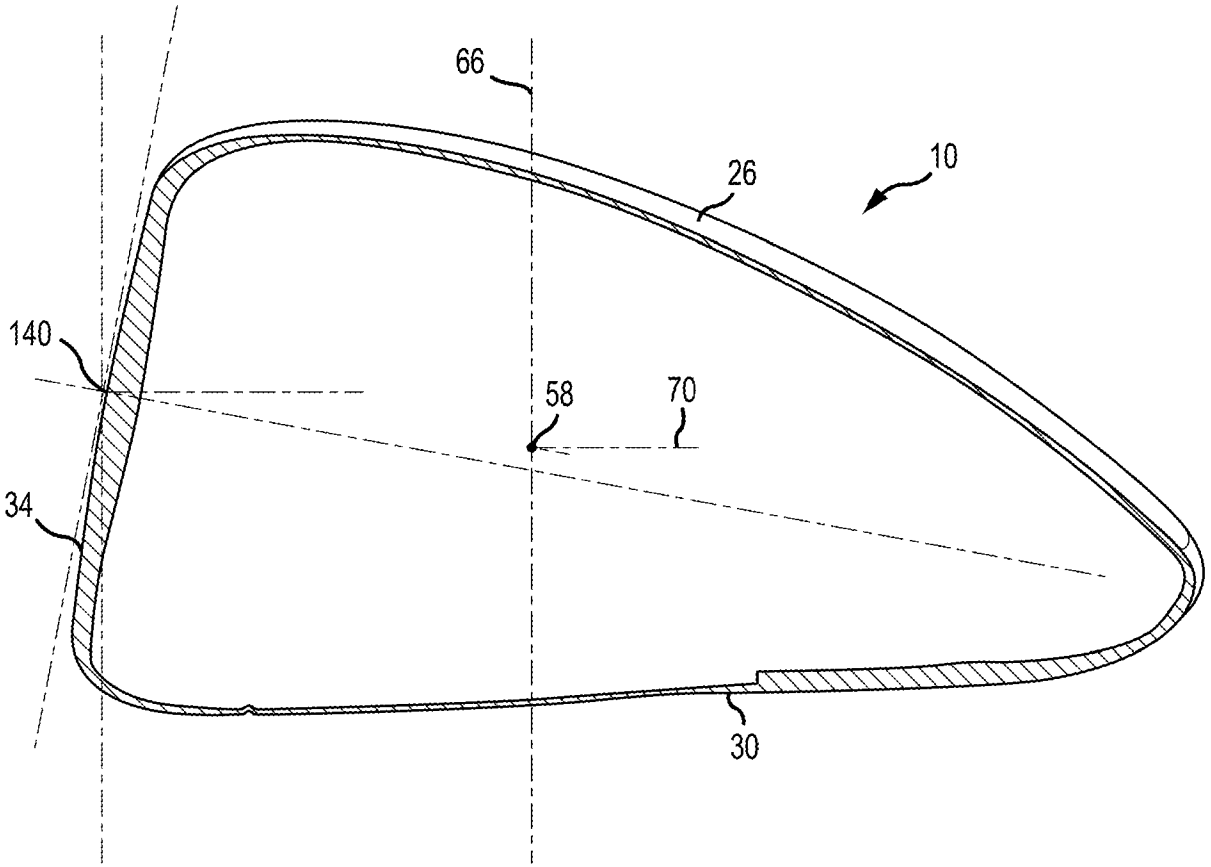
FIG. 3B is a side cross-sectional view of the club head of FIG. 1 taken along line 3B-3B of FIG. 3A.
Figure 4:
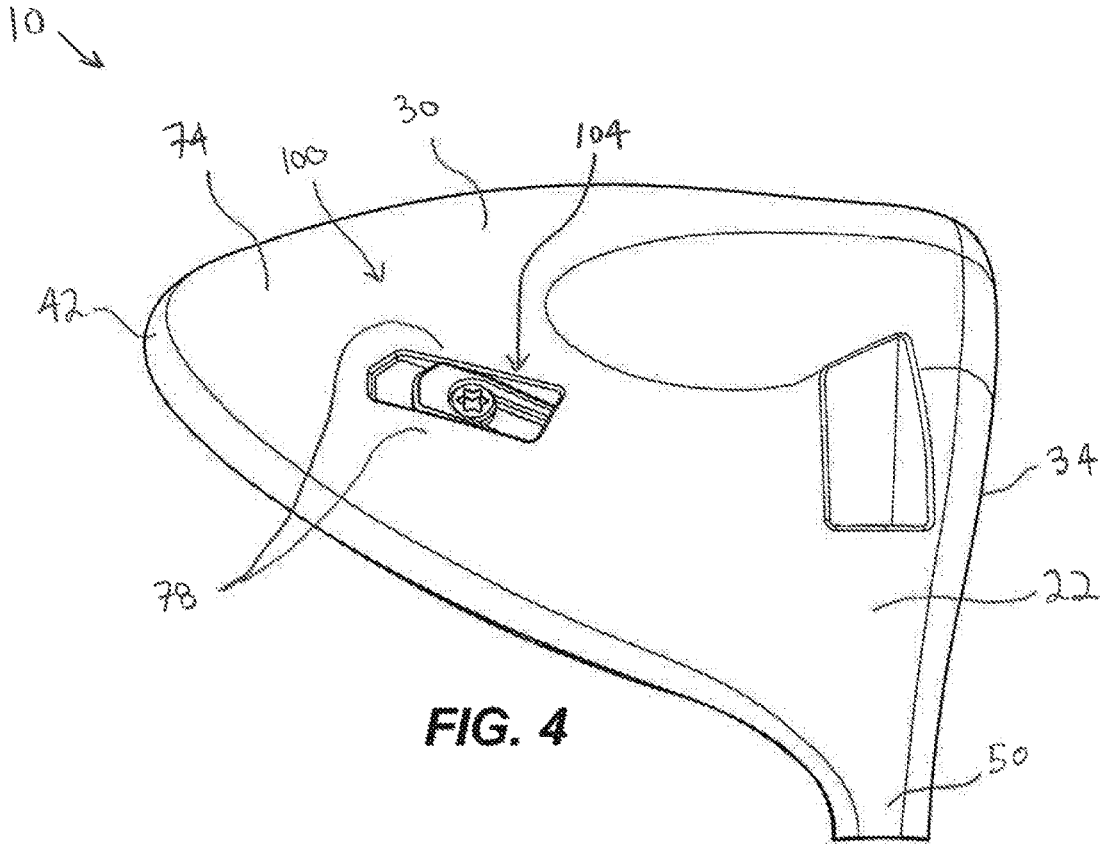
FIG. 4 is another perspective view of the golf club head of FIG. 1 including an adjustment member.
Figure 5:
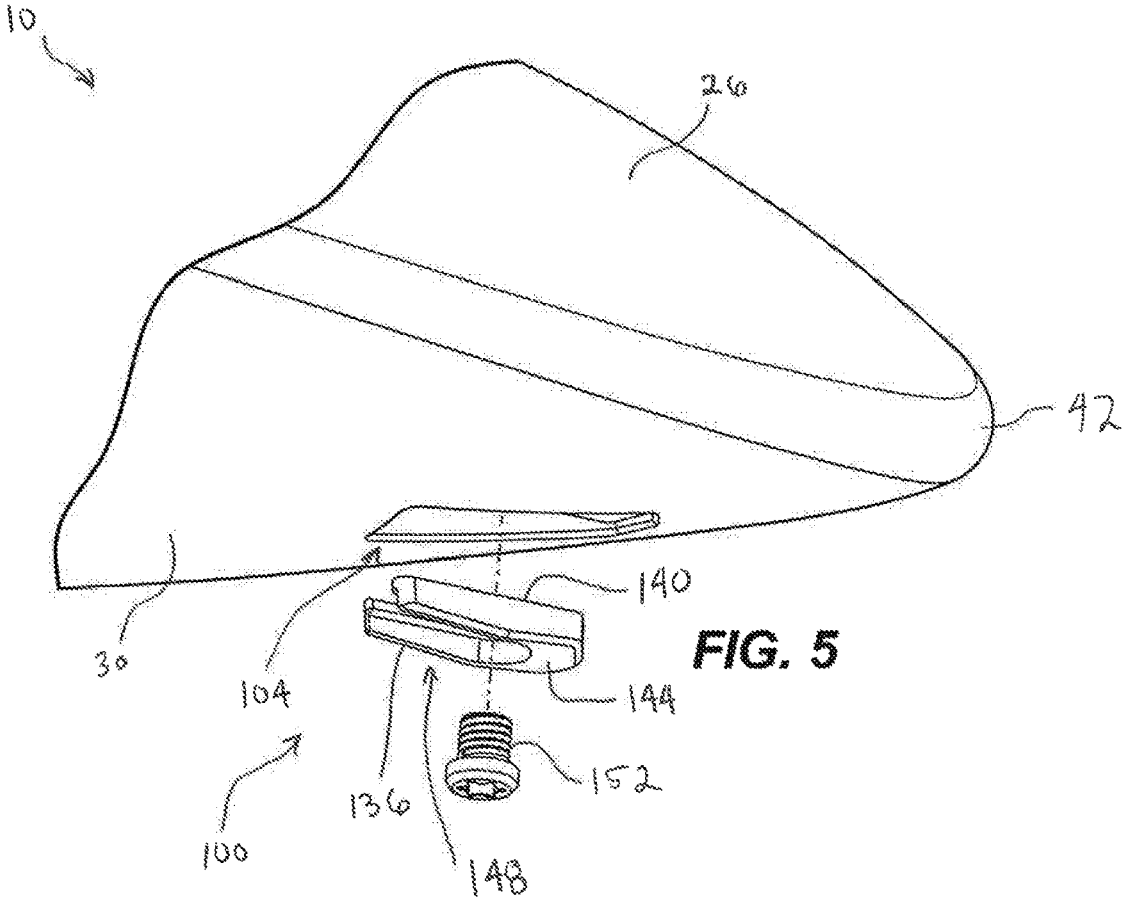
FIG. 5 is an exploded perspective view of a portion of the golf club head of FIG. 1.

Referring now to FIGS. 2, 3A, and 3B the golf club head 10 includes a center of gravity or CG 58 that defines an origin of a coordinate system including an x-axis 62, a y-axis 66, and a z-axis 70. The y-axis 66 (shown in FIG. 2) extends through the club head 10 center of gravity 58 from the crown or top 26 to the sole or bottom 30, is parallel to the hosel axis 54 when viewed from the side view, and is positioned at a 30 degree angle from the hosel axis 54 when viewed from a front view (FIG. 2). The x-axis 62 (shown in FIG. 3A) extends through the club head center of gravity (CG) 58 from the toe or toe end 18 to the heel or heel end 22, perpendicular to y-axis 66 when viewed from a front view.

The z-axis 70 (shown in FIG. 3A) extends through the CG 58 of the club head 10 from the club face 34 to the back end 42 and perpendicular to the x-axis 62 and the y-axis 66. The x-axis 62 extends through the head CG 58 from the toe or toe end 18 to the heel or heel end 22. The y-axis 66 extends through the head CG 58 from the crown or top 26 to the sole or bottom 30. The z-axis 70 extends through the head CG 58 from the club face 34 to the back end 42.

For additional guidance in describing the innovation herein, the x-axis 62 and the z-axis 70 are arranged to coincide with numbers on an analog clock in FIG. 3A. The z-axis 70 extends between 12 o'clock ("12" through the club face 34) and 6 o'clock ("6" through the back 42), and the x-axis 62 extends between 3 o'clock ("3" through the toe end 18) and 9 o'clock ("9" through the heel end 22).

FIGS. 4-9 illustrate an embodiment of the resting face angle adjuster 100. The adjuster 100 includes a recess 104 that is positioned or formed in or on the sole 30 of the golf club head 10. In the illustrated embodiment, the recess 104 extends from the heel end 22, closer to the face 34, toward the toe end 18, closer to the back end 42. The recess 104 is a substantially straight recess 104 that extends along a portion of the sole 30. The recess 104 is positioned on the sole 30 closer to the heel end 22 than to the toe end 18, and closer to the back end 42 than to the face 34 and behind the CG. However, in other embodiments, the recess 104 can be positioned at any suitable position on the sole 30, to include in front of the CG near the front of the golf club head, and can be any suitable shape (e.g., arcuate, etc.).

In the illustrated embodiment, the recess 104 includes a bottom wall 108, opposing sidewalls 112, a back wall 116 that defines an second end 120, and a front wall 124 that defines a first end 128 opposite the second end 120. The bottom wall 108 defines a sliding surface 132. The sole 30 includes a sole surface 74 having an adjacent surface portion 78 immediately surrounding the recess 104 at which the sole surface 74 meets the sidewalls 112, the back wall 116, and the front wall 124. In other words, a portion of the sole surface 74 at least partially bounds the recess 104 and in some embodiments the adjacent surface portion 78 is a recess edge 78.

The recess 104 includes a variable recess depth D measured orthogonal to the sliding surface 132 between the sliding surface 132 and the adjacent surface portion 78. In the illustrated embodiment, the recess depth D is greater near the closed or first end 128 and smaller near the open or second end 120. The sliding surface 132 is generally flat and sloped or angled relative to the adjacent surface portion 78, so that the recess depth D varies linearly between the second end 120 and the first end 128. In other embodiments (not shown), the recess depth D may be greater near the second end 120 and smaller near the first end 128. In the same or further embodiments (not shown), the sliding surface 132 may be arcuately shaped, stepped, with another profile, etc., so that the recess depth D varies non-linearly between the first and second ends 128, 120, or it may remain constant.

The adjuster 100 also includes an adjustment member 136 at least partially received into the recess 104. The adjustment member 136 includes a bottom surface 140, a keel surface 144 (or projecting surface 144 or contact surface 144) located opposite the bottom surface 140, and a through slot 148 extending between the bottom surface 140 and the keel surface 144. The through slot 148 can receive a threaded fastener 152 that selectively engages a threaded bore 156 in the bottom wall 108 to provisionally secure the adjustment member 136 to the golf club head 10 within the recess 104. In other embodiments (not shown), the adjustment member 136 can be secured to the golf club head 10 by other mechanical means (e.g., magnets, etc.). When inserted into the recess 104, the bottom surface 140 of the adjustment member 136 abuts the sliding surface 132. The keel surface 144 projects to a keel height H above the adjacent surface portion 78, measured orthogonal to the adjacent surface portion 78 between the adjacent surface portion 78 and the keel surface 144.

Figure 6:
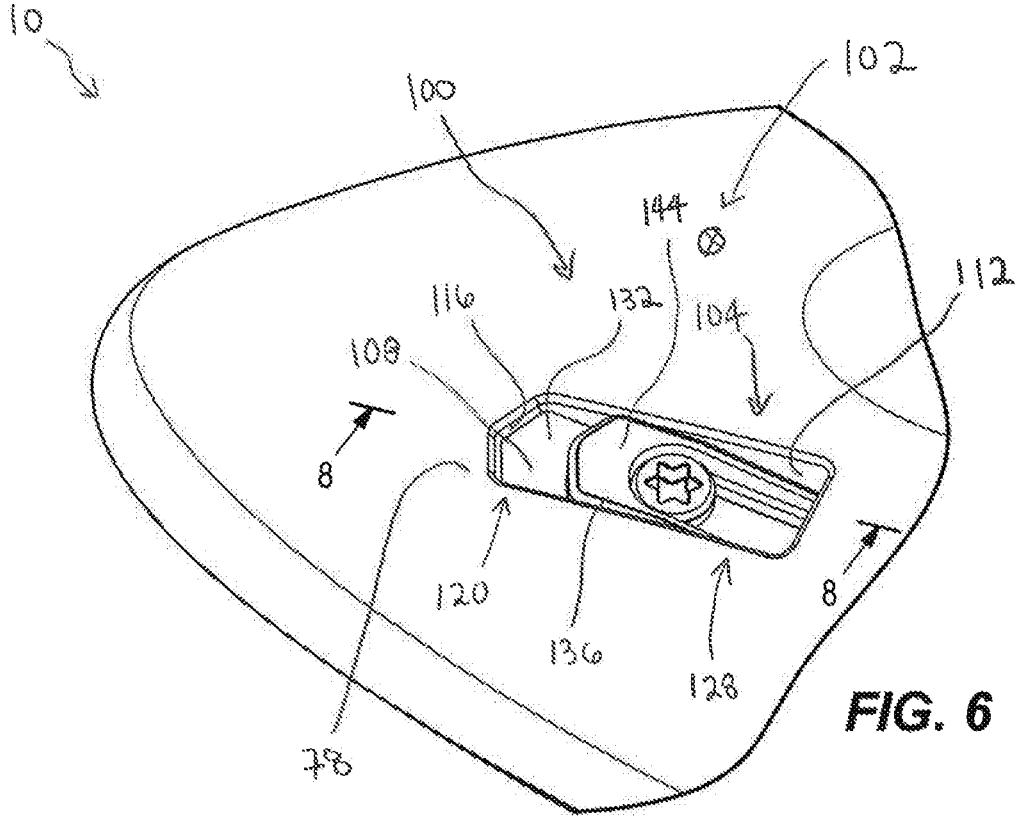
FIG. 6 is a perspective view of a portion of the golf club head of FIG. 1, illustrating the adjustment member in a first position.
Figure 7:
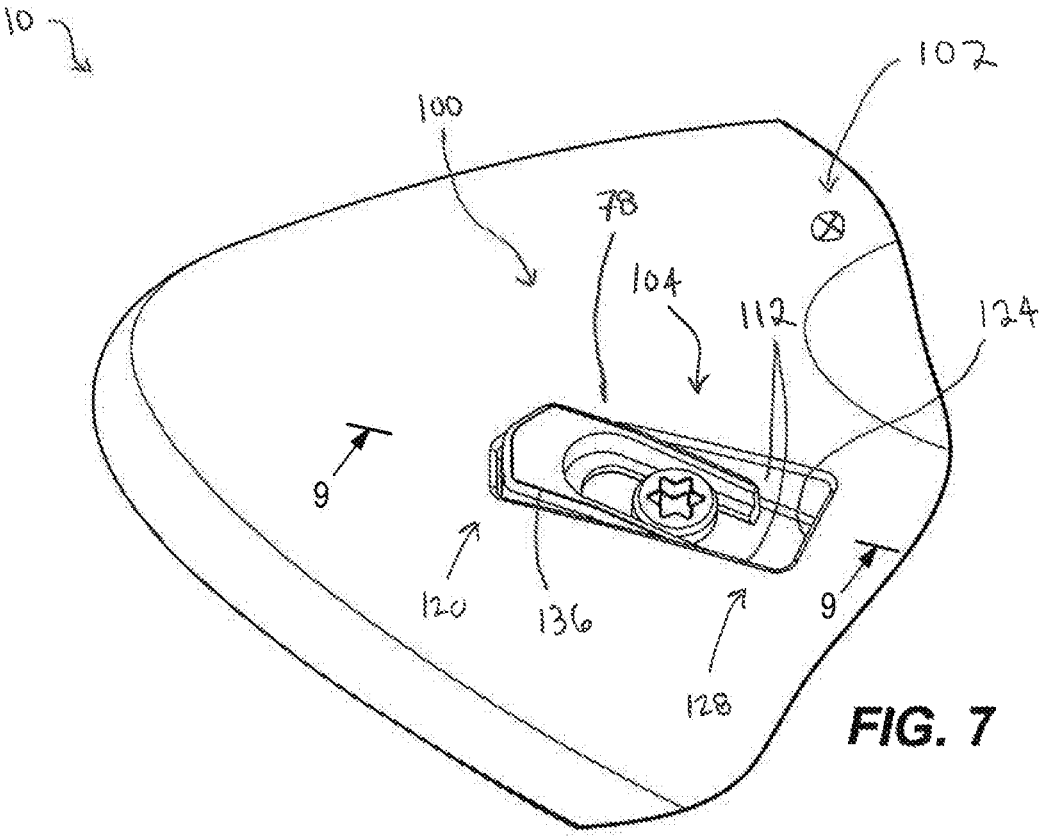
FIG. 7 is another perspective view of the portion of the golf club head of FIG. 1, illustrating the adjustment member in a second position.
Figure 8:
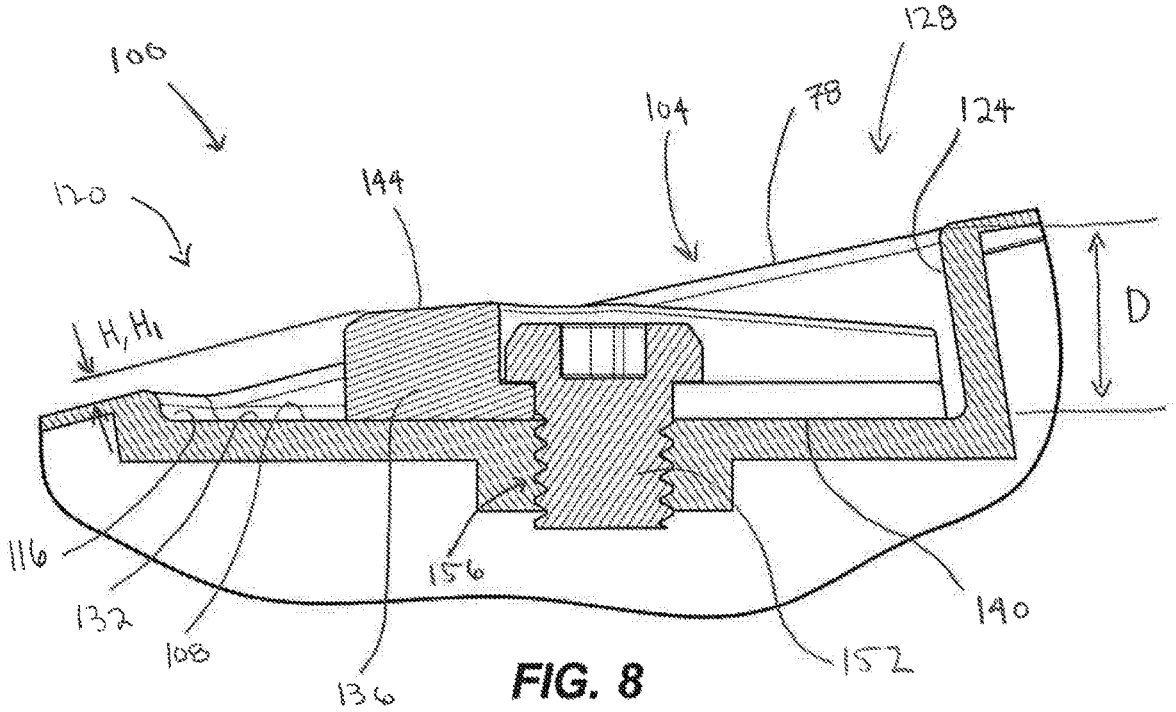
FIG. 8 is a cross-sectional view of the portion of the golf club head of FIG. 1 taken along line 8-8 of FIG. 6.
Figure 9:
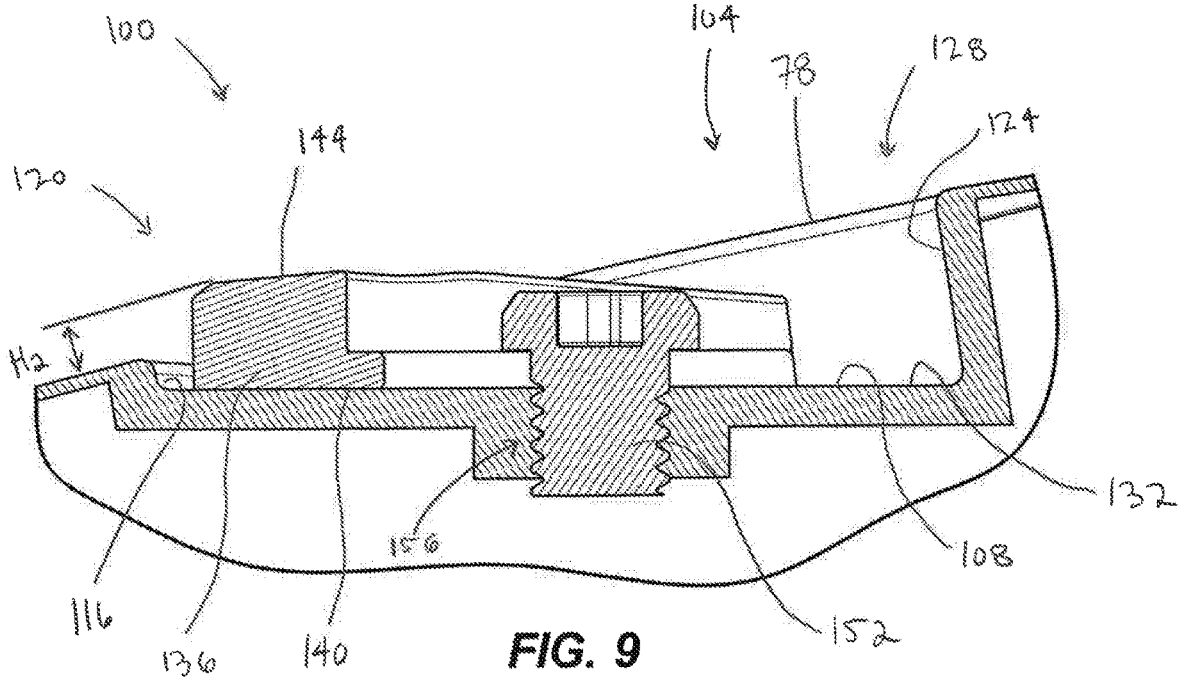
FIG. 9 is another cross-sectional view of the portion of the golf club head of FIG. 1 taken along line 9-9 of FIG. 7.
Figure 10:
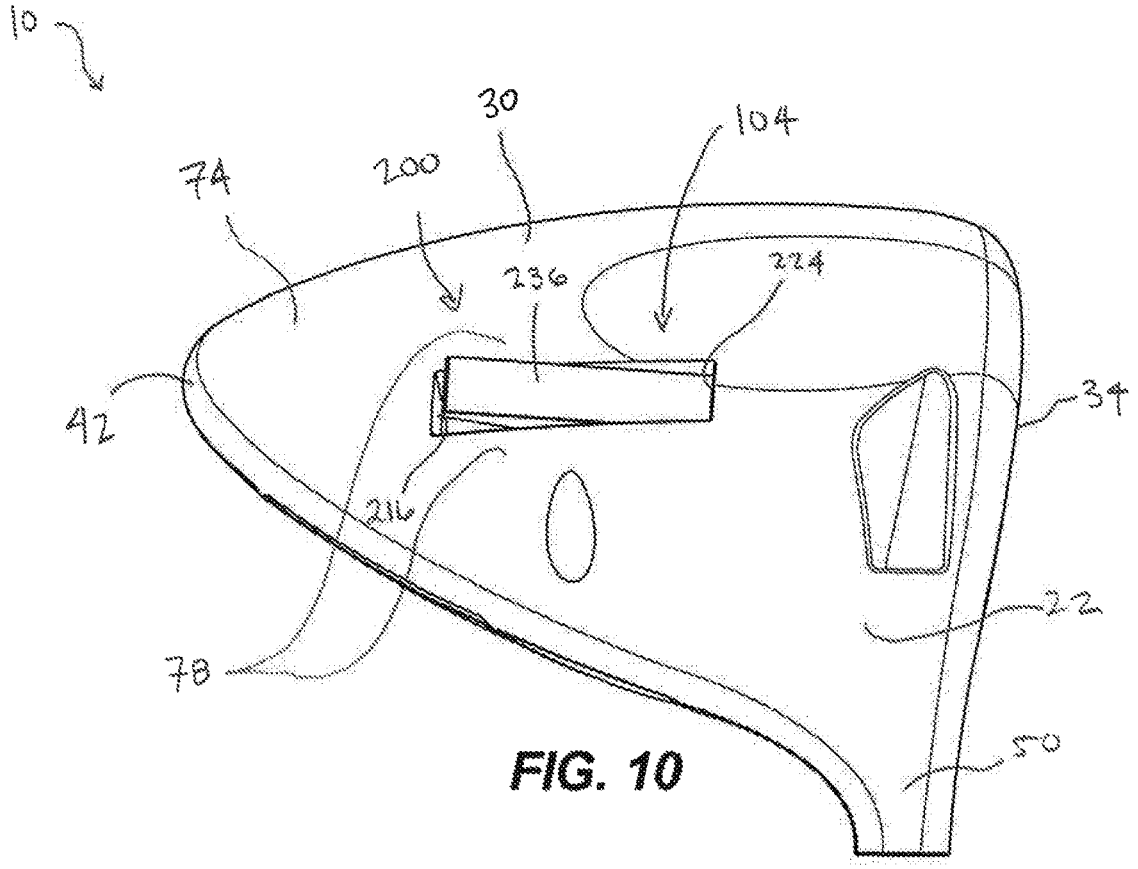
FIG. 10 is a perspective view of a golf club head including a resting face angle adjuster according to another embodiment of the disclosure.
Figure 11:
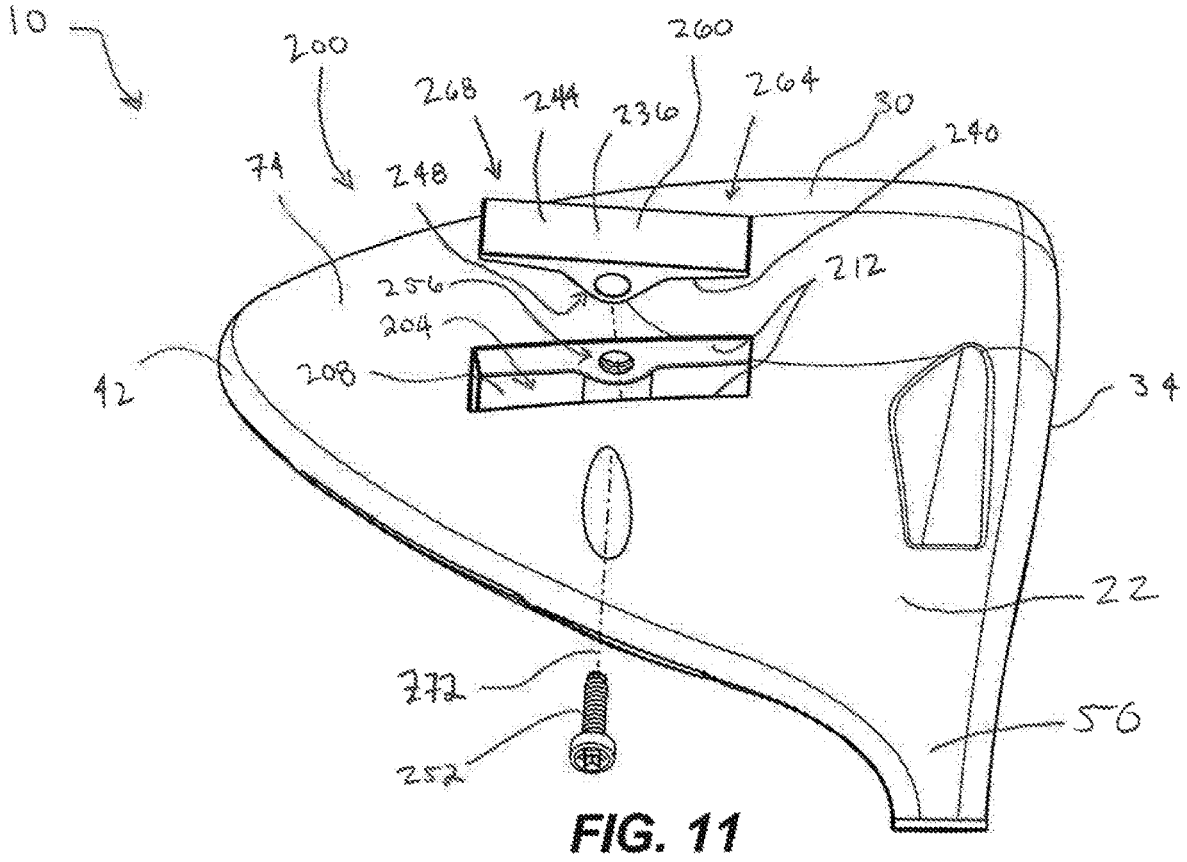
FIG. 11 is an exploded perspective view of the golf club head of FIG. 10.
Figure 12:
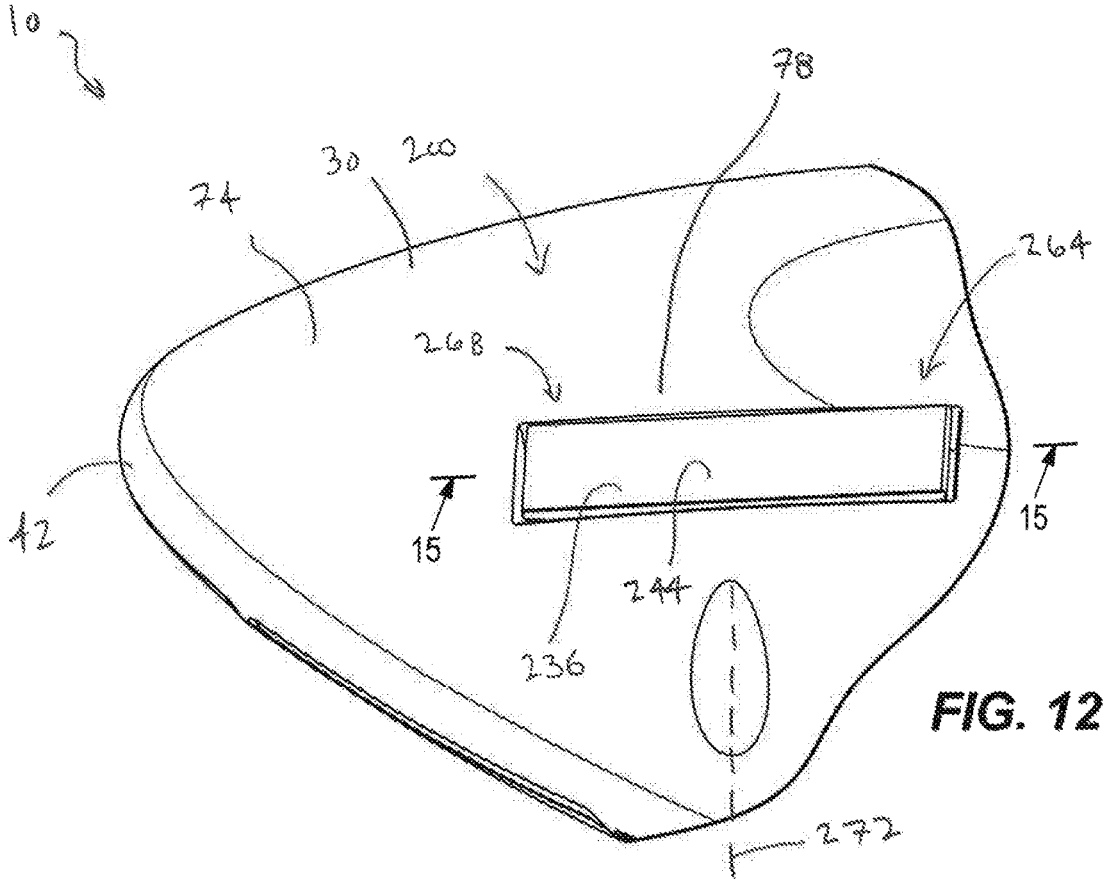
FIG. 12 is a perspective view of a portion of the golf club head of FIG. 10, illustrating the adjustment member in a first position.

Referring now to FIGS. 6-9, the adjustment member 136 is repositionable within the recess 104 in a plurality of adjustment positions between a first, retracted adjustment position adjacent the first end 128 (FIGS. 6 and 8) and a second, extended adjustment position adjacent the second end 120 (FIGS. 7 and 9). For example, FIGS. 6 and 8 illustrate the adjustment member 136 in the first adjustment position wherein the adjustment member 136 is situated closer to the first end 128. Referring to FIGS. 7 and 9, the adjustment member 136 is depicted in the second adjustment position wherein the adjustment member 136 is situated closer to the second end 120. In the illustrated embodiment, the adjustment of the adjustment member is continuous between the first position and the second position such that the adjustment member 136 can be positioned in any number of intermediate adjustment positions (not shown) between the first and second adjustment positions. In other embodiments (not shown), the adjustment member 136 may only be secured in a discrete number of adjustment positions (i.e., two adjustment positions, three adjustment positions, etc.). In such embodiments, the adjustment member 136 may include an insert geometry that cooperates with the fastener 152 to define each adjustment position (e.g., a discrete number of bores, such as two bores, three bores, etc., in the adjustment member 136 for receiving the fastener 152). Alternatively, in such embodiments the adjustment member 136 may include ridges (not shown) or other structures that cooperate with corresponding notches (not shown) in the sidewalls 112 (or the ridges, etc. may be formed on the sidewalls 112 with corresponding notches on the adjustment member 136) to restrict the adjustment member 136 to two adjustment positions, three adjustment positions, etc. Moreover, the slot 148 may include narrowed and widened portions (not shown) that restrict the fastener 152 to a discrete number of positions.

In the first adjustment position, the keel surface 144 projects to a first keel height H1 (FIG. 8) above the adjacent surface portion 78, measured orthogonal to the adjacent surface portion 78 between the adjacent surface portion 78 and the sliding surface 132. In the second adjustment position, the keel surface 144 projects to a second keel height H2 (FIG. 9) above the adjacent surface portion 78, measured orthogonal to the adjacent surface portion 78 between the adjacent surface portion 78 and the sliding surface 132. The second keel height H2 is greater than the first keel height H1. In other words, when the adjustment member 136 is in the second adjustment position, the keel surface 144 projects to a greater extent beyond the adjacent surface portion 78 (or edge 78) than when the adjustment member 136 is in the first adjustment position. When the adjustment member is positioned in any intermediate adjustment position (not shown) between the first and second adjustment positions, the keel surface 144 projects to an intermediate keel height (not shown) that is greater than the first keel height H1 and less than the second keel height H2.

In operation of the resting face angle adjuster 100, the location of the adjustment member 136 within the recess 104 can be adjusted by loosening the fastener 152 and sliding the adjustment member 136 toward the second end 120, or, alternatively, toward the first end 128. For example, the adjustment member 136 can be relocated from the first adjustment position (FIG. 6) to the second adjustment position (FIG. 7) by loosening the fastener 152, sliding the adjustment member 136 within the recess 104 from the first end 128 to the second end 120, and then retightening the fastener 152 to secure the adjustment member 136 in the second adjustment position. Similarly, the adjustment member 136 can be relocated from the second adjustment position (FIG. 7) to the first adjustment position (FIG. 6) by loosening the fastener 152 and sliding the adjustment member 136 from the first end 128 to the second end 120.

By repositioning the adjustment member 136 between the first and second ends 128, 120, the keel height H can be adjusted to manipulate the resting face angle at address position. For example, with the adjustment member 136 in the first adjustment position (FIG. 6) such that the keel surface 144 minimally extends out of the recess 104 (i.e., so that the keel surface 144 extends to the adjustment height H1 relative to the adjacent surface portion 78), the keel surface 144 may contact the ground and generate its own keel point when the golf club head 10 is at address position. In such instances, the keel point generated by the keel surface 144 in the first adjustment position is located behind the CG 58 (i.e., between the back end 42 and the CG 58 in a direction parallel to the z-axis 70). By positioning the adjustment member 136 in the first adjustment position, the resting face angle at address can be reoriented into a more closed position either from an open position to a neutral position or from a neutral position to a closed position, with the toe end 18 being closer than the heel end 22 to a golf ball at address (e.g., to promote a draw or a hook).

Alternatively, when the adjustment member 136 is in the first adjustment position such that the keel surface 144 is at height H1, the keel surface 144 may not contact the ground when the club head 10 is at address position, or the keel surface 144 may be entirely within the recess 104 and not contact the ground when the club head 10 is at address position. By positioning the adjustment member 136 in the first adjustment position, the resting face angle at address can be oriented into a more open position, or alternatively into a neutral position (or neutral configuration or square configuration), with neither the toe end 18 nor the heel end 22 being closer to the golf ball at address (e.g., to promote a straight ball flight).

As another example, the adjustment member 136 can be reoriented to the second adjustment position (FIG. 7) such that the keel surface 144 extends sufficiently out of the recess 104 (i.e., so that the keel surface 144 extends to the adjustment height H2 relative to the adjacent surface portion 78) that the keel surface 144 contacts the ground and thus generates its own keel point at a different location on the sole surface 74 (further from the front end) than the keel point generated at height H1, or alternatively generates a first adjustment member keel point when the golf club head 10 is at address position. In the second position, the keel point generated by the keel surface 144 is located behind the CG 58 (i.e., between the back end 42 and the CG 58 in a direction parallel to the z-axis 70). By repositioning the adjustment member 136 to the second adjustment position, the resting face angle at address can be reoriented into a more closed position either from an open position to a neutral position or from a neutral position to a closed position, with the toe end 18 being closer than the heel end 22 to a golf ball at address (e.g., to promote a draw or a hook).

Likewise, the adjustment member 136 can further be repositioned at any intermediate position (not shown) between the first and second adjustment positions, thereby adjusting an extent to which the resting face angle at address is reoriented into a more closed or open position. In other embodiments (not shown), the adjustment member 136 may only be secured in a discrete number of adjustment positions (i.e., two adjustment positions, three adjustment positions, etc.), as discussed above.

Without any adjuster 100, the golf club head 10 has a natural keel point 102 on the contour of the sole surface 74 at address position. When the adjustment member 136 is positioned in the first adjustment position and the club head 10 is located at address position, the natural keel point 102 (FIG. 6) will remain in a first location if the keel surface 144 does not extend from the recess (i.e., keel height H is less than or equal to zero). Alternatively, in the first adjustment position, the keel surface 144 could extend from the recess (i.e., keel height H is greater than zero), but not contact the ground and thus not generate a keel point on the keel surface 144, so that the natural keel point 102 remains at the first location. When the adjustment member 136 is moved to the second adjustment position (FIG. 7), this causes the natural keel point 102 to relocate to a second location on the sole surface 74 different from the first location, as illustrated in FIGS. 6 and 7.

In the illustrated embodiment, when the adjustment member 136 is positioned in the first adjustment position (FIG. 6), the first location of keel point 102 is between the CG 58 and the face 34 (i.e., the first location is closer to the face 34 relative to the CG 58, in a direction parallel to the z-axis 70). Accordingly, the resting face angle at address can be oriented in a more open position, or alternatively into a neutral position (or neutral configuration or square configuration), with neither the toe end 18 nor the heel end 22 being closer to the golf ball at address (e.g., to promote a straight ball flight). When the adjustment member 136 is positioned in the second adjustment position (FIG. 7), the second location of keel point 102 is between the first location and the face 34 (i.e., the second location is closer to the face 34 relative to the first location and the CG 58, in a direction parallel to the z-axis 70). Accordingly, the resting face angle at address can be reoriented into a more closed position either from an open position to a neutral position or from a neutral position to a closed position, with the toe end 18 being closer than the heel end 22 to a golf ball at address (e.g., to promote a draw or a hook). In other words, extension of the adjustment member 136 from the first adjustment position toward the second adjustment position results in a progressively more closed face angle at address (i.e. from an open position to a neutral position, or from a neutral position to a more closed position, etc.). The resulting change in resting face angle comparing the first adjustment position to the second adjustment position can be up to 10 degrees. For example, the resulting change in resting face angle comparing the first adjustment position to the second adjustment position can be 1 degree, 2 degrees, 3 degrees, 4 degrees, 5 degrees, 6 degrees, 7 degrees, 8 degrees, 9 degrees, or 10 degrees.

The adjustment member 136 can also be removed from the recess 104 by disengaging the fastener 152. The adjustment member 136 can then be rotated, removed and replaced, or otherwise reoriented, and then reinserted, or another adjustment member may be inserted (not shown), into the recess 104. The adjustment member 136 may be reattached to the recess 104 by reinserting the fastener 152 into the through slot 148 and retightening the fastener 152 within the threaded bore 156. In some embodiments, the fastener 152 is not removable such that the adjustment member 136 is not removable from the recess.

Referring now to FIGS. 10-17, an embodiment of a resting face angle adjuster 200 is illustrated. The adjuster 200 has similar components to the adjuster 100, with like names and/or like numbers identifying like components. The adjuster 200 includes a recess 204 positioned on the sole 30 of the golf club head 10. In the illustrated embodiment, the recess 204 extends longitudinally from a front wall 224 to a back wall 216. The recess 204 extends along a portion of the sole 30 in a substantially straight line. The recess 204 is positioned on the sole 30 closer to the heel end 22 than to the toe end 18. However, in other embodiments, the recess 204 can be positioned at any suitable position on the sole 30, and can be any suitable shape (e.g., arcuate, etc.).

In the illustrated embodiment, the recess 204 includes a bottom wall 208, opposing sidewalls 212, the front wall 224 located closer to the face 34, and the back wall 216 opposite the front wall 224 and located closer to the back end 42. The sole 30 includes a sole surface 74 having an adjacent surface portion 78 immediately surrounding the recess 204 where the sole surface 74 meets the sidewalls 212, the back wall 216, and the front wall 224. In other words, a portion of the sole surface 74 at least partially bounds the recess 204 and in some embodiments the adjacent surface portion 78 is a recess edge 78.

The adjuster 200 also includes an adjustment member 236 at least partially received into the recess 204. The adjustment member 236 includes a body 260 extending between a first end 264 and a second end 268 (with the first end 264 in front of the CG and the second end 268 behind the CG), a bottom surface 240, a keel surface 244 (or projecting surface 244 or contact surface 244) located opposite the bottom surface 240, and a slot 248 transversely intersecting the body 260 between the bottom surface 240 and the keel surface 244. The slot 248 defines a pivot axis 272 and can receive a threaded fastener 252 that selectively engages a threaded bore 256 in the sidewall 212 to provisionally secure the adjustment member 236 to the golf club head 10 within the recess 204. In other embodiments (not shown), the adjustment member 236 can be secured to the golf club head 10 by other mechanical means (e.g., magnets, etc.). When inserted into the recess 204, the first end 264 is situated adjacent the front wall 224 and the second end is situated adjacent the back wall 216. A portion of the keel surface 244 can project to a keel height H above the adjacent surface portion 78, measured orthogonal to the adjacent surface portion 78 between the adjacent surface portion 78 and the keel surface 244.

Figure 13:
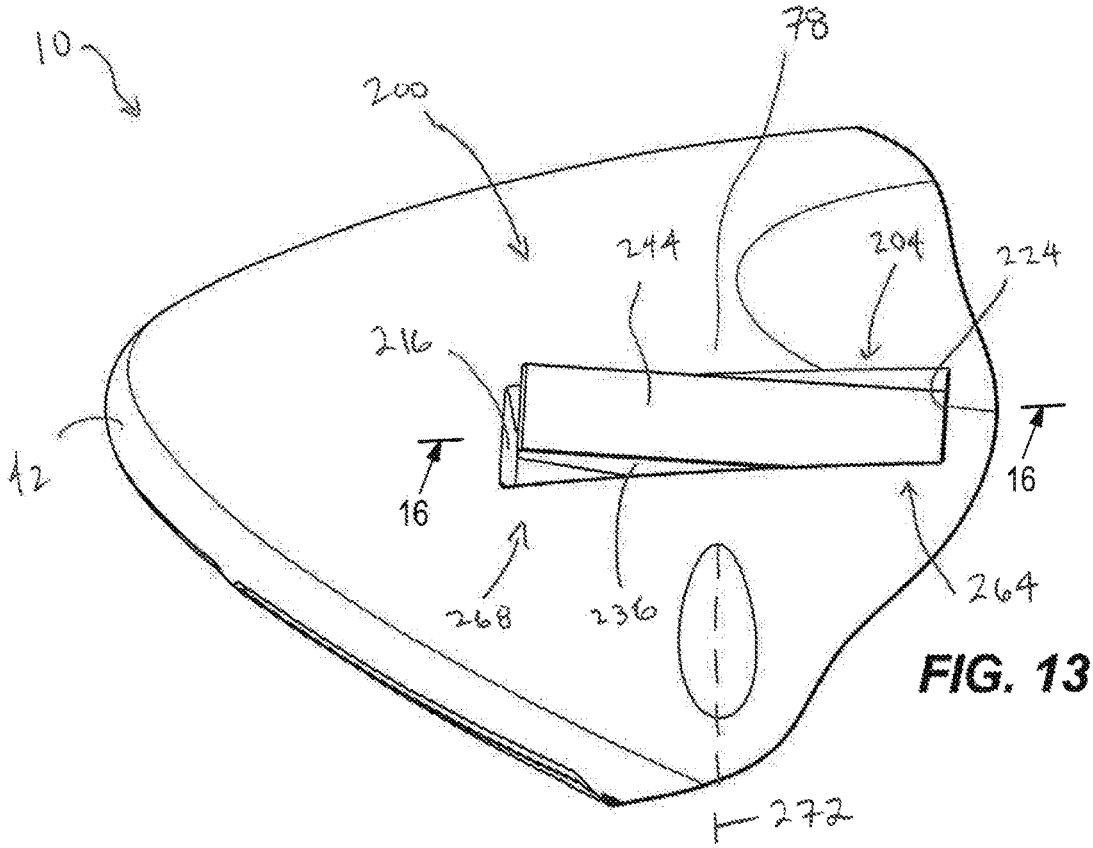
FIG. 13 is another perspective view of the portion of the golf club head of FIG. 10, illustrating the adjustment member in a second position.
Figure 14:
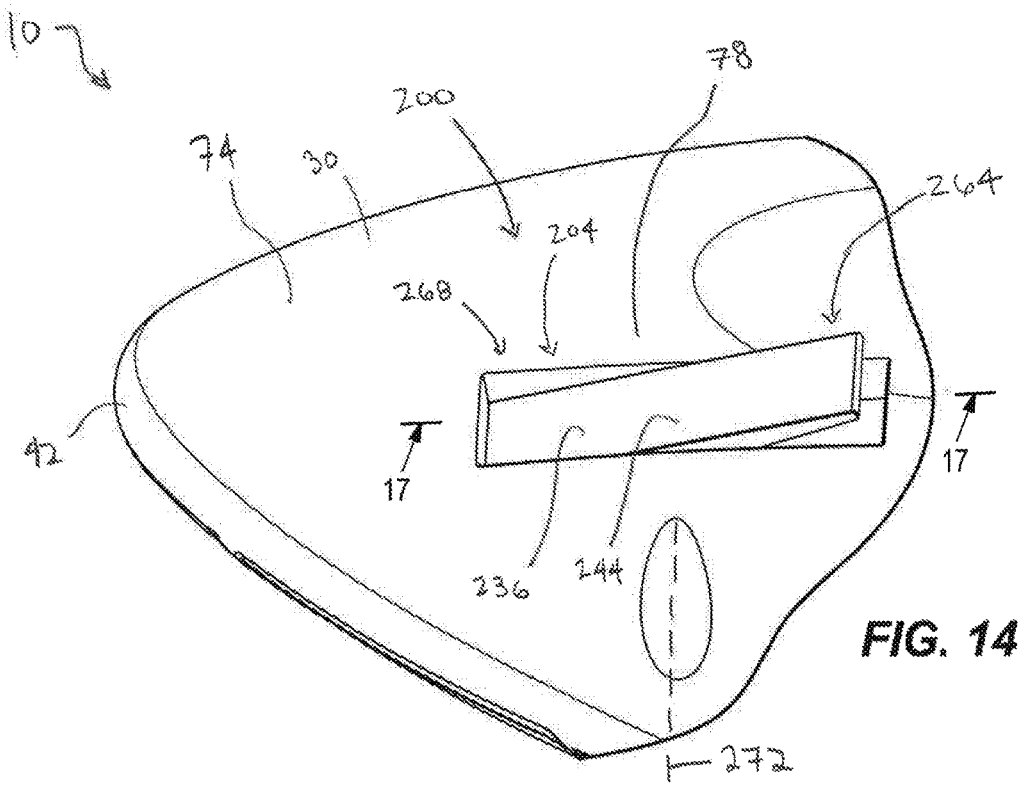
FIG. 14 is another perspective view of the portion of the golf club head of FIG. 10, illustrating the adjustment member in a third position.
Figure 15:
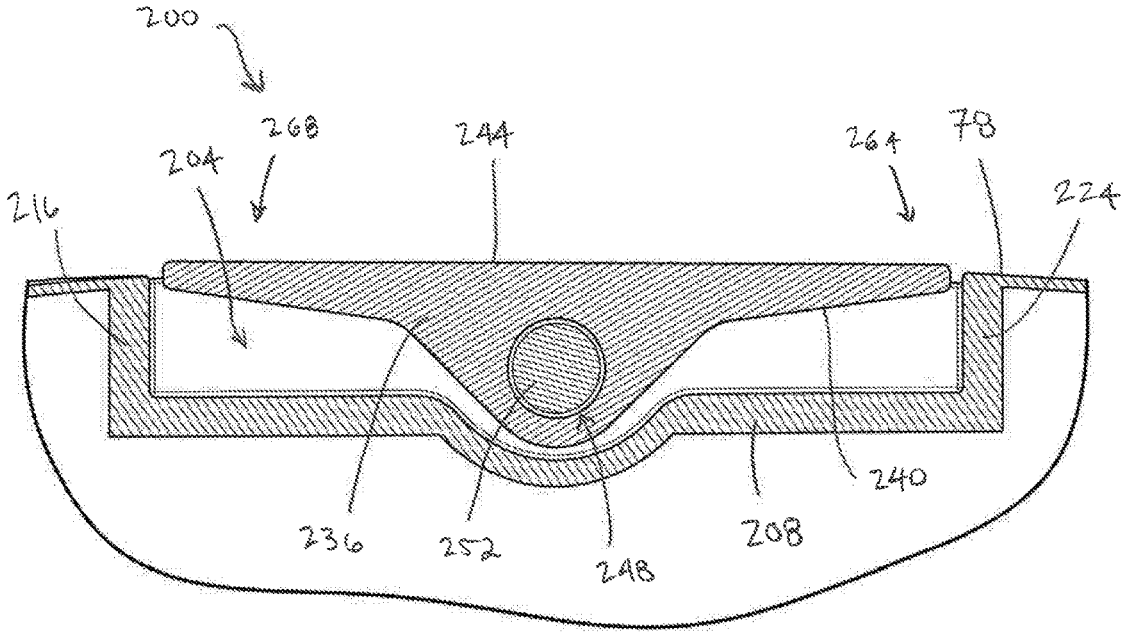
FIG. 15 is a cross-sectional view of the portion of the golf club head of FIG. 10 taken along line 15-15 of FIG. 12.
Figure 16:
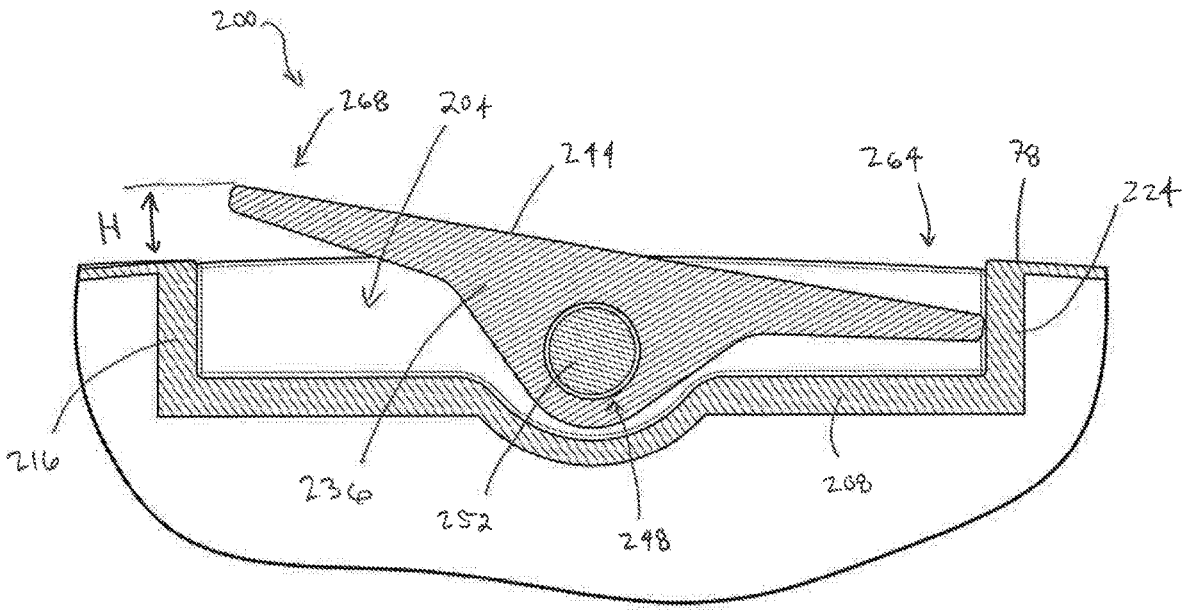
FIG. 16 is another cross-sectional view of the portion of the golf club head of FIG. 10 taken along line 16-16 of FIG. 13.
Figure 17:
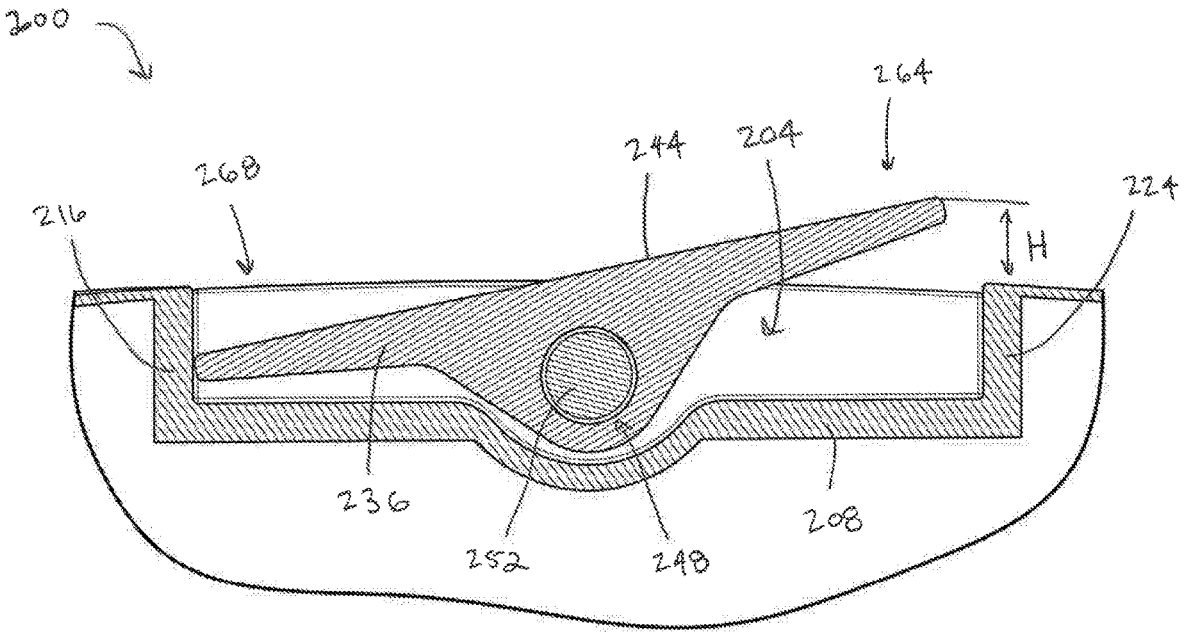
FIG. 17 is another cross-sectional view of the portion of the golf club head of FIG. 10 taken along line 17-17 of FIG. 14.
Figure 18:
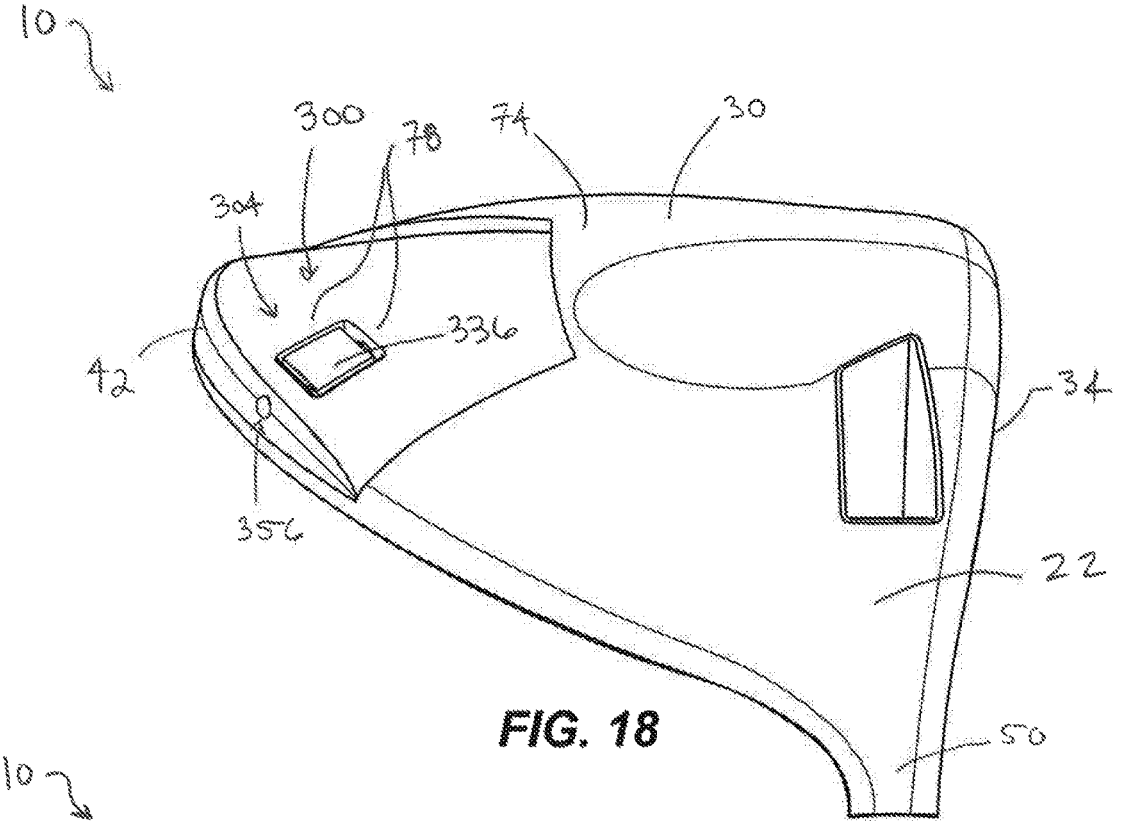
FIG. 18 is a perspective view of a golf club head including a resting face angle adjuster according to another embodiment of the disclosure.
Figure 19:
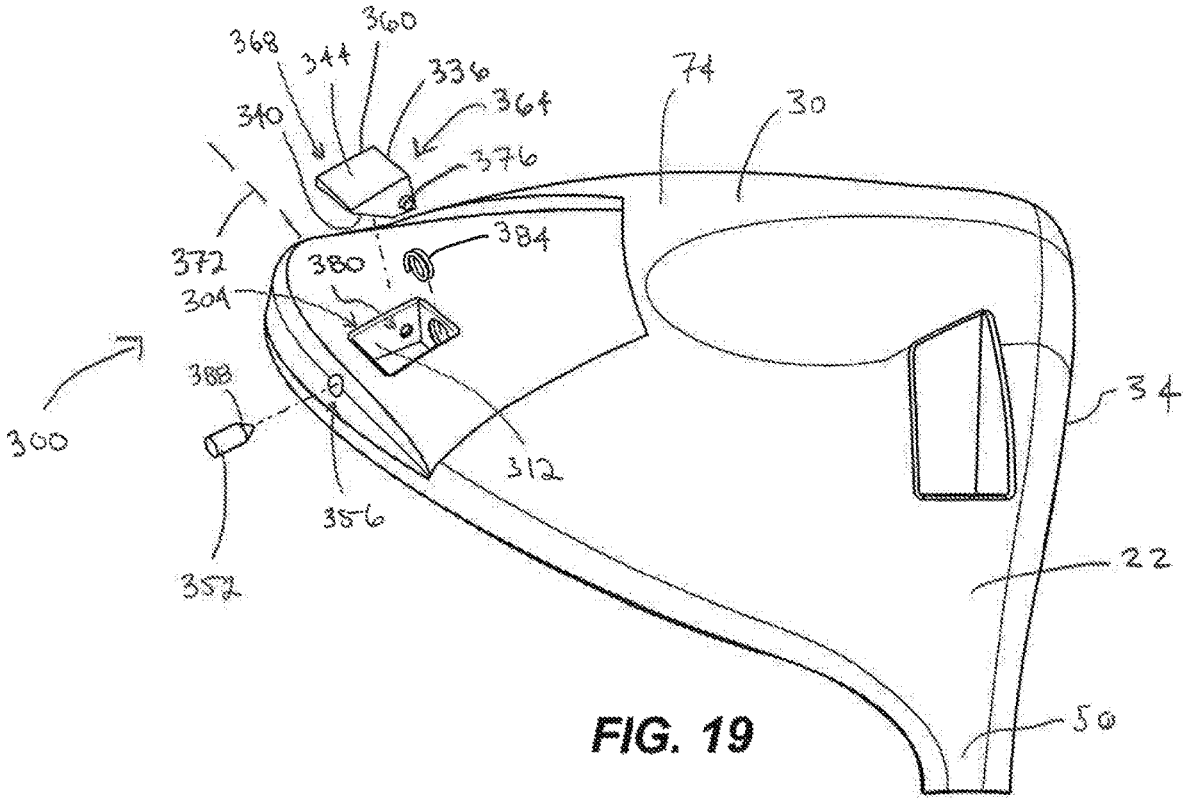
FIG. 19 is an exploded perspective view of the golf club head of FIG. 18.

Referring now to FIGS. 12-17, the adjustment member 236 can be reoriented within the recess 204 in a plurality of adjustment positions between a first adjustment position, wherein the first end 264 is fully extended out of the recess 204 (FIGS. 14 and 17), and a second adjustment position, wherein the second end 268 is fully extended out of the recess 204 (FIGS. 13 and 16). The adjustment member can also be positioned in a third, neutral adjustment position wherein neither the first end 264 nor the second end 268 extends out of the recess 204 (FIGS. 12 and 15) or the first end 264 and/or the second end 268 extend minimally out of the recess 204. In the third adjustment position, the keel surface 244 is generally coplanar with the adjacent surface portion 78.

In operation of the resting face angle adjuster 200, the orientation of the adjustment member 236 within the recess 204 can be adjusted by loosening the fastener 252 and pivoting the adjustment member 236 about the pivot axis 272 such that the first end 264, or, alternatively, the second end 268, projects outward from the recess 204 and above the adjacent surface portion 78 (or edge 78). For example, the adjustment member 236 can be pivoted from the first adjustment position (FIG. 14) to the second adjustment position (FIG. 13) by loosening the fastener 252, pivoting the first end 264 toward the bottom wall 208, and then retightening the fastener 252 to secure the adjustment member 236 in the second adjustment position. Similarly, the adjustment member 236 can be pivoted from the second adjustment position (FIG. 13) to the first adjustment position (FIG. 14) by loosening the fastener 252 and pivoting the second end 268 toward the bottom wall 208. Moreover, the adjustment member 236 can be pivoted to the third, neutral adjustment position (FIG. 12) by loosening the fastener 252 and pivoting the adjustment member 236 about the pivot axis 272 until the first and second ends 264, 268 are each oriented approximately the same distance from the bottom wall 208.

By pivoting the adjustment member 236 between the first, second, and third adjustment positions, the keel height H can be adjusted at each end 264, 268 of the adjustment member 236 to manipulate the resting face angle at address position. For example, with the adjustment member 236 in the first adjustment position (FIG. 14) such that the first end 264 extends out of the recess 204, the keel surface 244 contacts the ground at the first end 264 and thus generates its own keel point when the golf club head 10 is at address position. In the first position, the keel point generated by the keel surface 244 is located forward of the CG 58 (i.e., between the face 34 and the CG 58 in a direction parallel to the z-axis 70). By positioning the adjustment member 236 in the first adjustment position, the resting face angle at address can be oriented into a more open position, with the heel end 22 being closer than the toe end 18 to a golf ball at address (e.g., to promote a fade or slice).

As another example, the adjustment member 236 can be reoriented to the second adjustment position (FIG. 13) such that the second end 268 extends out of the recess 204, the keel surface 244 contacts the ground at the second end 268 and thus generates a different adjustment member keel point when the golf club head 10 is at address position. In the second position, the keel point generated by the keel surface 244 is located behind the CG 58 (i.e., between the back end 42 and the CG 58 in a direction parallel to the z-axis 70). By repositioning the adjustment member 236 to the second adjustment position, the resting face angle at address can be reoriented into a more closed position, with the toe end 18 being closer than the heel end 22 to a golf ball at address (e.g., to promote a draw or a hook). Adjustment between the first and second adjustment positions also moves a keel point on the sole surface 74 from a first position to a second position, as previously described with respect to FIGS. 4-9. The resulting change in resting face angle comparing the first adjustment position to the second adjustment position can be up to 20 degrees. For example, the resulting change in resting face angle comparing the first adjustment position to the second adjustment position can be 1 degree, 2 degrees, 3 degrees, 4 degrees, 5 degrees, 6 degrees, 7 degrees, 8 degrees, 9 degrees, 10 degrees, 11 degrees, 12 degrees, 13 degrees, 14 degrees, 15 degrees, 16 degrees, 17 degrees, 18 degrees, 19 degrees, or 20 degrees.

As another example, the adjustment member 236 can be reoriented to the third adjustment position (FIG. 12) such that neither the first end 264 nor the second end 268 extends out of the recess 204 (or first and second ends 264, 268 may be entirely within the recess 204). In the third adjustment position, the keel surface 244 does not contact the ground and thus does not generate a keel point at either end 264, 268 when the golf club head 10 is at address position. By repositioning the adjustment member 236 to the third adjustment position, the resting face angle at address can be reoriented into a more neutral position (or neutral configuration or square configuration), with neither the toe end 18 nor the heel end 22 being closer to the golf ball at address (e.g., to promote a straight ball flight).

In the illustrated embodiment, the adjustment member 236 can further be repositioned at any intermediate position (not shown) between the first and third adjustment positions, thereby adjusting an extent to which the resting face angle at address is reoriented into a more open position. Likewise, the adjustment member 236 can further be repositioned at any intermediate position (not shown) between the second and third adjustment positions, thereby adjusting an extent to which the resting face angle at address is reoriented into a closed open position. In further embodiments (not shown), the adjustment member 236 may only be secured in a discrete number of adjustment positions (i.e., two adjustment positions, three adjustment positions, etc.), with surface features within the recess 204 or on the adjustment member 236 as described above with respect to adjuster 100.

Referring now to FIGS. 18-23, an embodiment of a resting face angle adjuster 300 is illustrated. The adjuster 300 has similar components to the adjusters 100 and 200, with like names and/or like numbers identifying like components. The adjuster 300 includes a recess 304 positioned on the sole 30 of the golf club head 10. In the illustrated embodiment, the recess 304 extends longitudinally from a front wall 324 closer to the face 34 to a back wall 316 closer to the back end 42. The recess 304 extends along a portion of the sole 30 in a substantially straight line. The recess 304 is positioned on the sole 30 closer to the heel end 22 than to the toe end 18, and closer to the back end 42 than to the face 34 behind the CG. However, in other embodiments, the recess 304 can be positioned at any suitable position on the sole 30, to include in front of the CG near the front of the golf club head, and can be any suitable shape (e.g., arcuate, etc.).

In the illustrated embodiment, the recess 304 includes a bottom wall 308, opposing sidewalls 312, the front wall 324 located closer to the face 34, and the back wall 316 opposite the front wall 324 and located closer to the back end 42. The sole 30 includes a sole surface 74 having an adjacent surface portion 78 immediately surrounding the recess 304 where the sole surface 74 meets the sidewalls 312, the back wall 316, and the front wall 324. A portion of the sole surface 74 at least partially bounds the recess 304 and in some embodiments the adjacent surface portion 78 is a recess edge 78.

Figure 20:
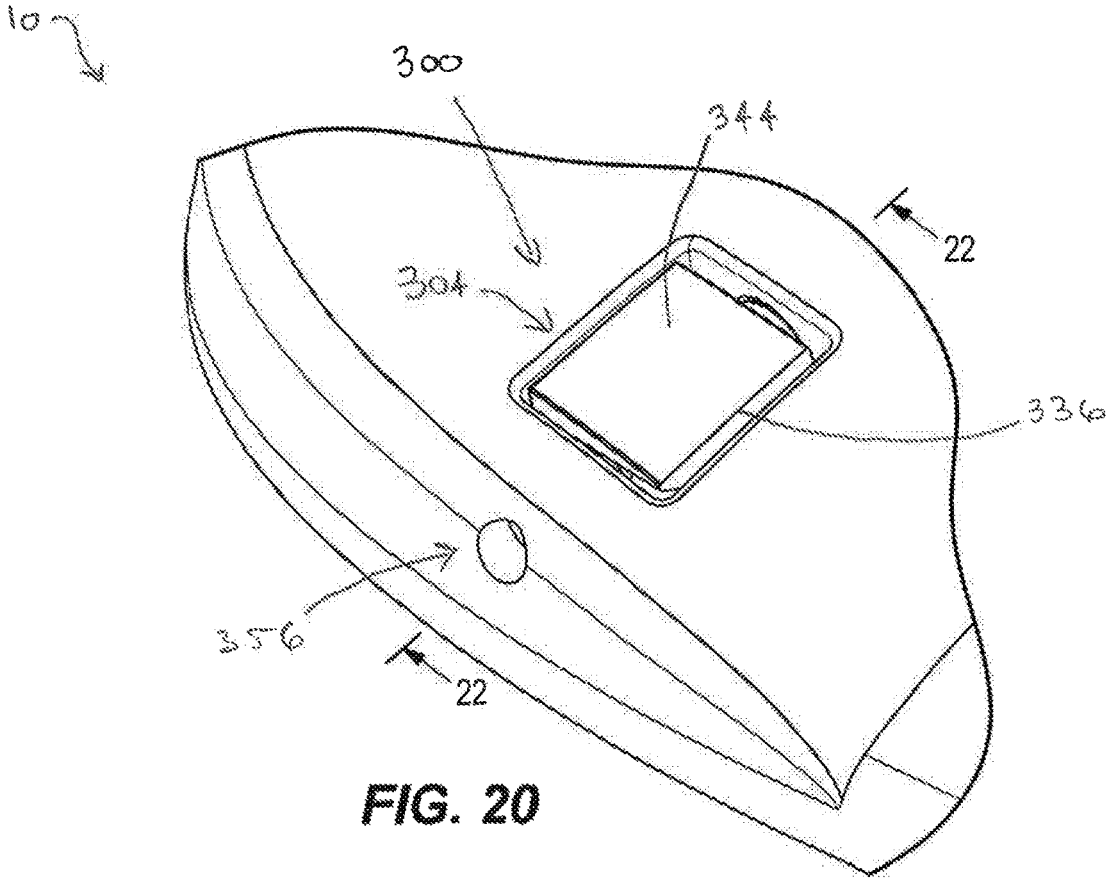
FIG. 20 is a perspective view of a portion of the golf club head of FIG. 18, illustrating the adjustment member in a first position.

The adjuster 300 also includes an adjustment member 336 at least partially received into the recess 304. The adjustment member 336 includes a body 360 extending between a first end 364 and a second end 368, a tapered bottom surface 340, and a keel surface 344 (or projecting surface 344 or contact surface 344) located opposite the bottom surface 340. In the illustrated construction, a pair of cylindrical projections 376 (FIG. 19) project outward from each side of the adjustment member 336 proximate the bottom surface 340 and the front wall 324. The recess 304 includes a pair of openings 380 in each sidewall 312 that receive the projections 376 to secure the adjustment member 336 within the recess 304. In other embodiments (not shown), the adjustment member 336 can be secured to the golf club head 10 by other mechanical means (e.g., magnets, etc.). Together, the projections 376 define a pivot axis 372. When inserted into the recess 304, the first end 364 is situated adjacent the front wall 324 and rotatably coupled thereto, and the second end is situated adjacent the back wall 316. A spring 384 is positioned between the front wall 324 of the recess 304 and the first end 364 of the adjustment member 336 and biases the bottom surface 340 toward the bottom wall 308 (i.e., the spring 384 biases the adjustment member toward a first, retracted position) (FIG. 20). In other embodiments the spring may be a compressible material, such as foam, or any other suitable compressible material. In yet other embodiments, the spring 384 may be coupled to the bottom wall 308 and the bottom surface 340 by any suitable coupling method.

The club head 10 also includes a threaded bore 356 intersecting the back wall 316 and extending through the body 360 from the back end 42 to the back wall 316. An adjustment screw 352 selectively engages the threaded bore 356. The adjustment screw 352 is rotatably adjustable within the threaded bore 356, so that a tip portion 388 selectively projects through the back wall 316 and into the recess 304.

Figure 21:
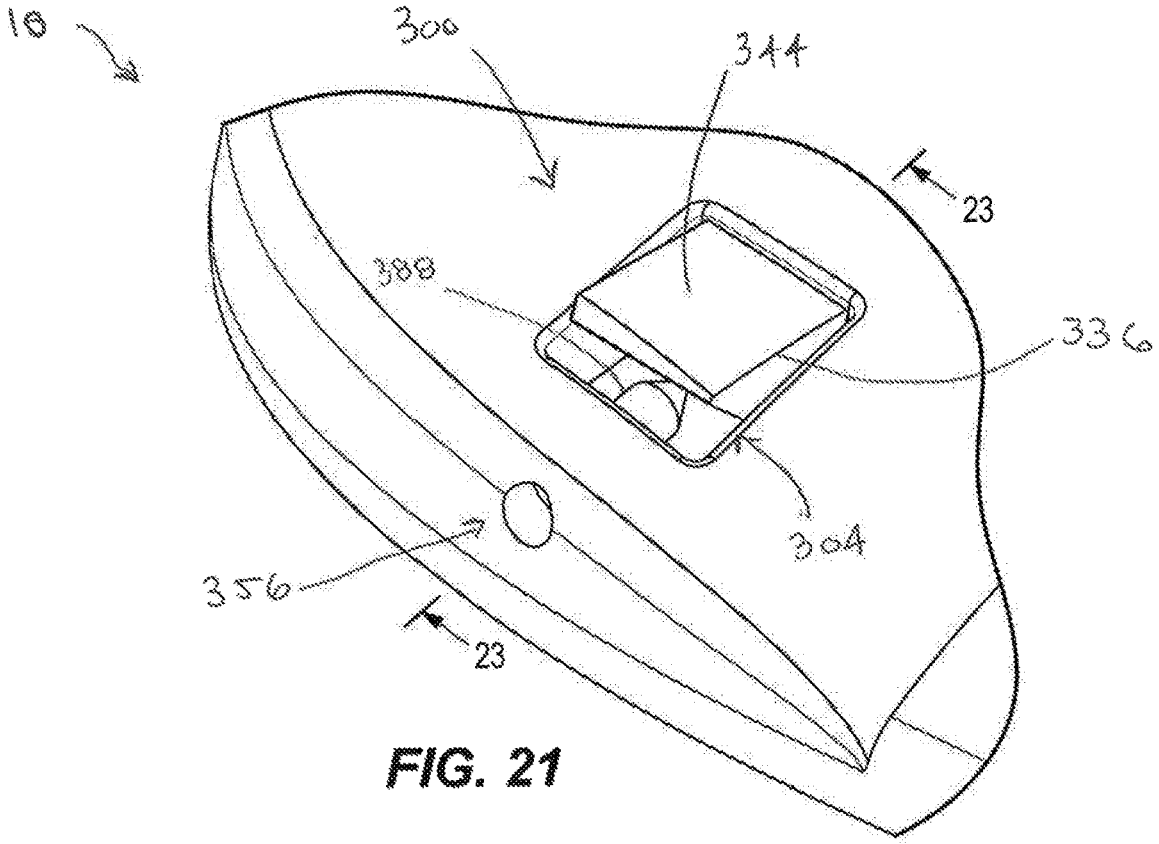
FIG. 21 is another perspective view of a portion of the golf club head of FIG. 18, illustrating the adjustment member in a second position.
Figure 22:
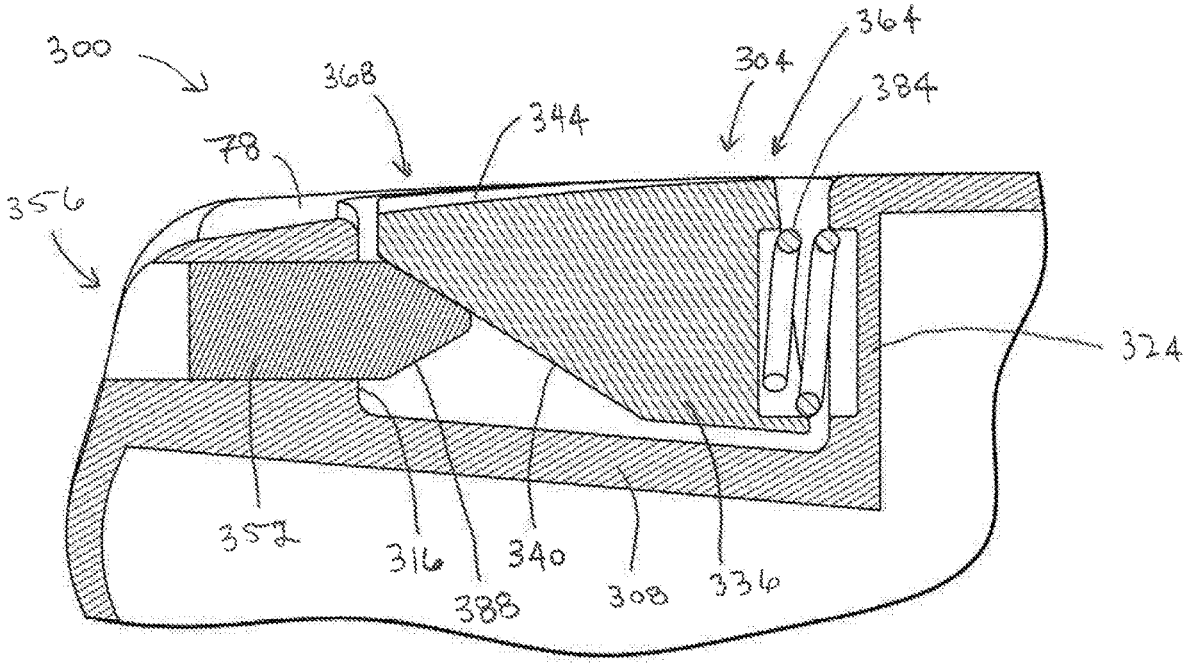
FIG. 22 is a cross-sectional view of the portion of the golf club head of FIG. 18 taken along line 22-22 of FIG. 20.
Figure 23:
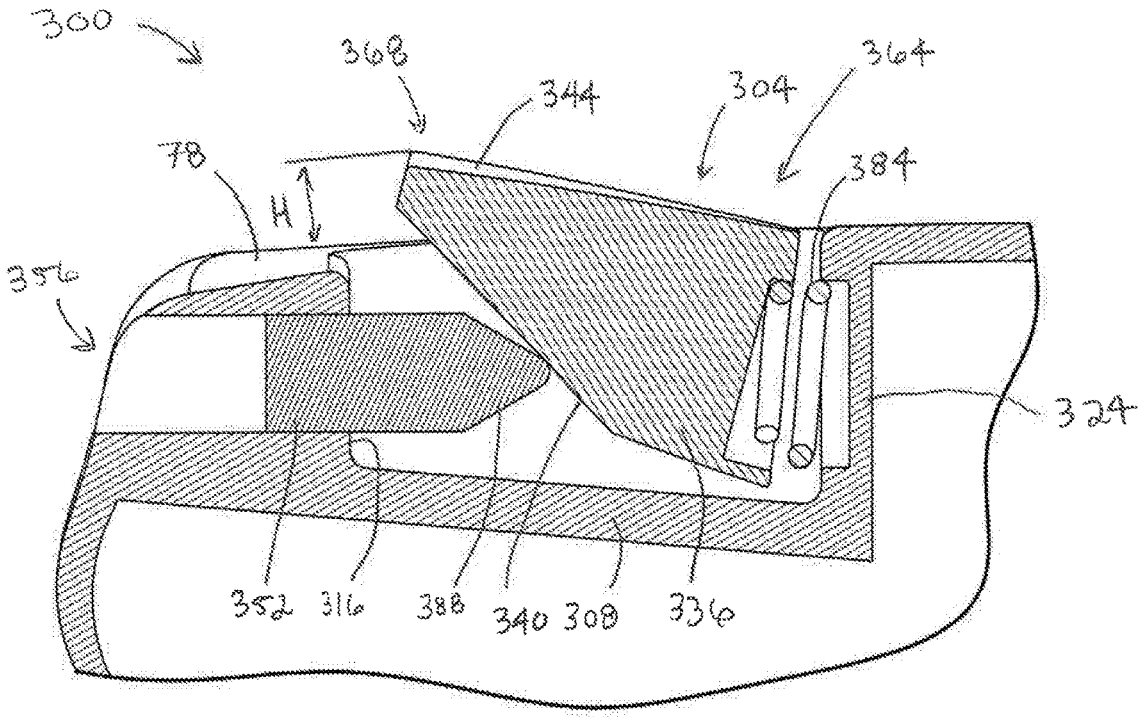
FIG. 23 is another cross-sectional view of the portion of the golf club head of FIG. 18 taken along line 23-23 of FIG. 21.
Figure 24:
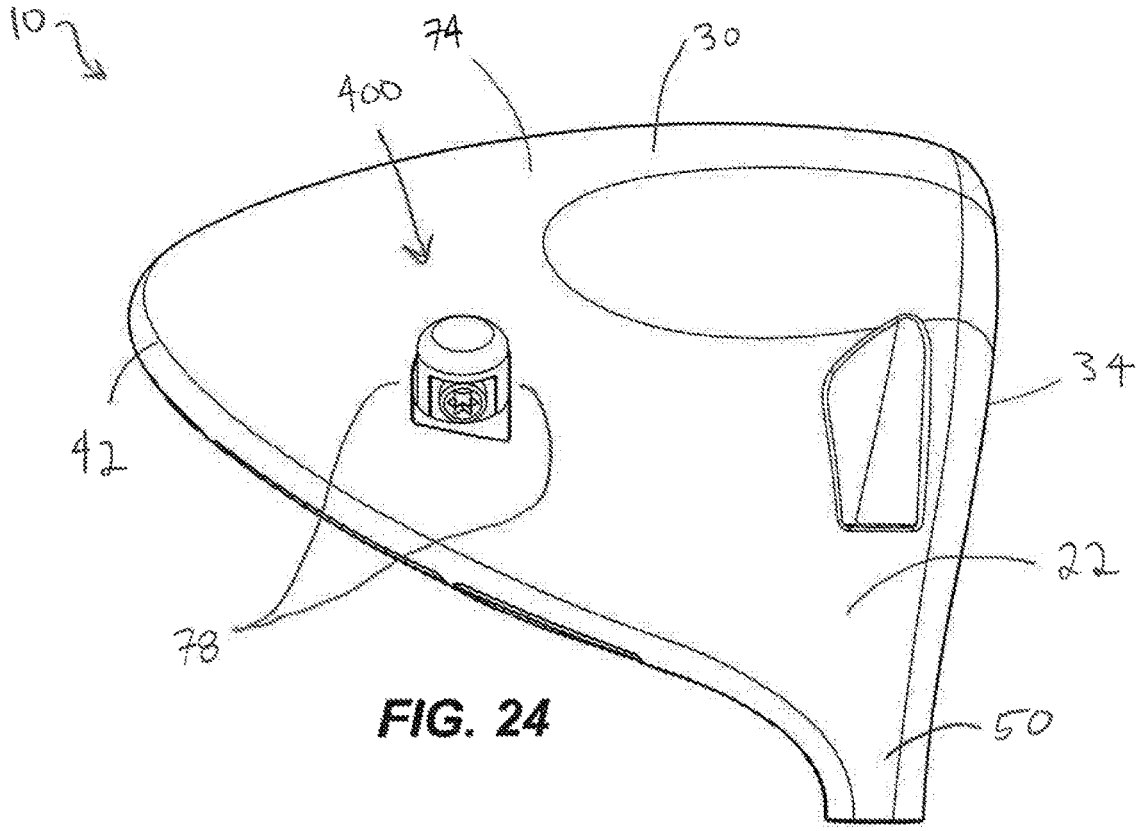
FIG. 24 is a perspective view of a golf club head including a resting face angle adjuster according to another embodiment of the disclosure.
Figure 25:
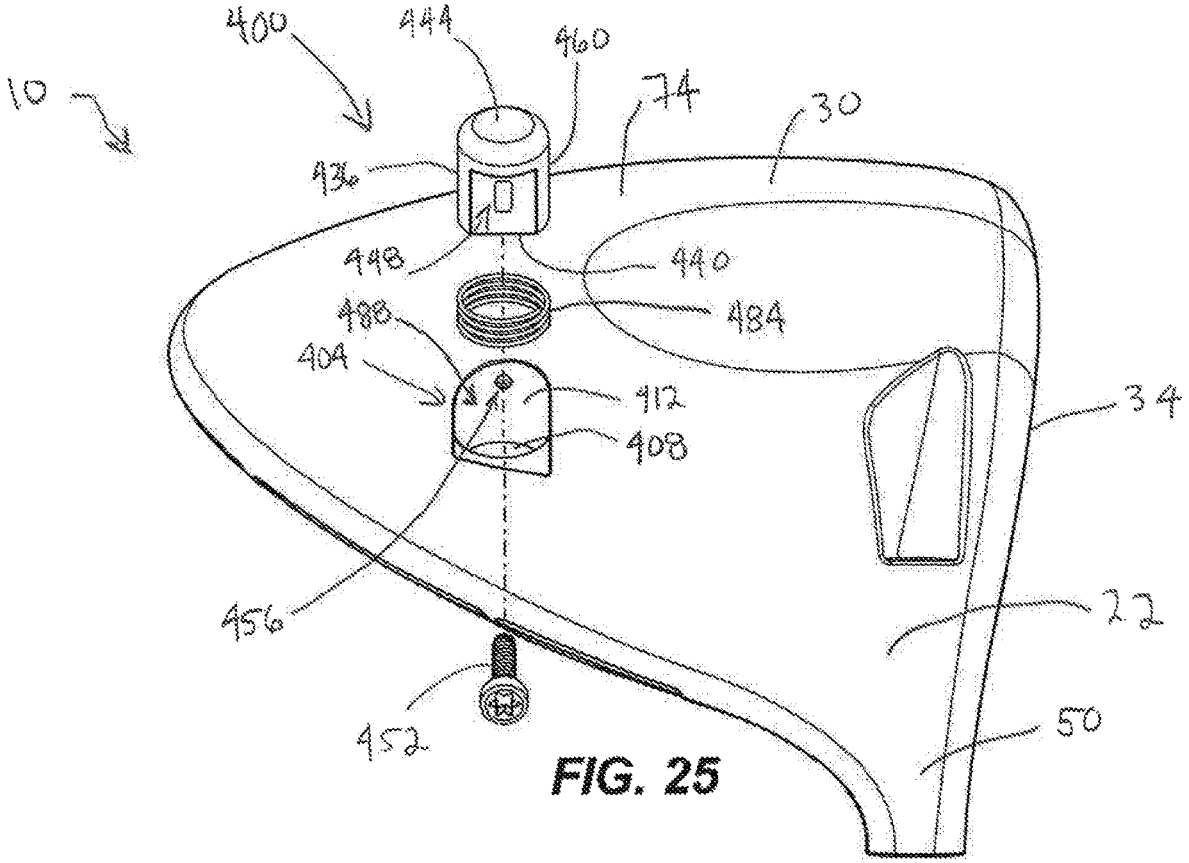
FIG. 25 is an exploded perspective view of the golf club head of FIG. 24.

Referring now to FIGS. 20-23, the adjustment member 336 can be reoriented within the recess 304 in a plurality of adjustment positions between the first, retracted adjustment position (FIGS. 20 and 22) and a second, extended adjustment position (FIGS. 21 and 23). For example, FIGS. 20 and 22 illustrate the adjustment member 336 in the first adjustment position wherein the keel surface 344 does not project above the adjacent surface portion 78 (i.e., a first keel height H). Referring to FIGS. 21 and 23, the adjustment member 336 is depicted in the second adjustment position wherein keel surface 344 projects outward above the adjacent surface portion 78 (i.e., a second keel height H greater than the first keel height H). The adjustment member 336 can also be positioned in any number of intermediate adjustment positions (not shown) between the first and second adjustment positions. In other embodiments (not shown), the adjustment member 336 may only be secured in a discrete number of adjustment positions (i.e., two adjustment positions, three adjustment positions, etc.), with surface features within the recess 304 or on the adjustment member 336 as described above with respect to adjuster 100.

In operation of the resting face angle adjuster 300, the orientation of the adjustment member 336 within the recess 304 can be adjusted by rotating the adjustment screw 352. Specifically, as the adjustment screw 352 is threaded into the threaded bore 356, the tip portion 388 abuts the bottom surface 340, causing the adjustment member 336 to rotate about the pivot axis 372 against the force of the spring 384 and permitting the adjustment member 336 to remain in discrete positions. As the adjustment member 336 pivots, the second end 368 rotates away from the recess 304 and above the adjacent surface portion 78 (or edge 78).

By pivoting the adjustment member 336 between the first and second adjustment positions, the keel height H can be adjusted to manipulate the resting face angle at address position. For example, with the adjustment member 336 in the first adjustment position (FIG. 20) such that the keel surface 344 does not extend (or minimally extends) out of the recess 304, or is entirely within the recess 304, the keel surface 344 may not contact the ground and thus not generate its own keel point when the golf club head 10 is at address position. By positioning the adjustment member 336 in the first adjustment position, the resting face angle at address can be oriented into a more open position at address, or alternatively into a neutral position (or neutral configuration or square configuration), with neither the toe end 18 nor the heel end 22 being closer to the golf ball at address (e.g., to promote a straight ball flight).

As another example, the adjustment member 336 can be reoriented to the second adjustment position (FIG. 21) such that the keel surface 344 extends out of the recess 304 at a sufficient keel height H so that the keel surface 344 contacts the ground and thus generates its own keel point when the golf club head 10 is at address position. In the second position, the keel point generated by the keel surface 344 is located behind the CG 58 (i.e., between the back end 42 and the CG 58 in a direction parallel to the z-axis 70). By repositioning the adjustment member 336 to the second adjustment position, the resting face angle at address can be reoriented into a more closed position either from an open position to a neutral position or from a neutral position to a closed position, with the toe end 18 being closer than the heel end 22 to a golf ball at address (e.g., to promote a draw or a hook). Adjustment between the first and second adjustment positions also moves a keel point on the sole surface 74 from a first position to a second position, as previously described with respect to FIGS. 4-9. The resulting change in resting face angle comparing the first adjustment position to the second adjustment position can be up to 10 degrees. For example, the resulting change in resting face angle comparing the first adjustment position to the second adjustment position can be 1 degree, 2 degrees, 3 degrees, 4 degrees, 5 degrees, 6 degrees, 7 degrees, 8 degrees, 9 degrees, or 10 degrees.

Likewise, the adjustment member 336 can further be repositioned at any intermediate position (not shown) between the first and second adjustment positions, thereby adjusting an extent to which the resting face angle at address is reoriented into a more closed or open position. In other embodiments (not shown), the adjustment member 336 may only be secured in a discrete number of adjustment positions (i.e., two adjustment positions, three adjustment positions, etc.), as described above with respect to adjuster 100.

Referring now to FIGS. 24-29, an embodiment of a resting face angle adjuster 400 is illustrated. The adjuster 400 has similar components to the adjusters 100, 200, and 300, with like names and/or like numbers identifying like components. The adjuster 400 includes a recess 404 positioned on the sole 30 of the golf club head 10. In the illustrated embodiment, the recess 404 is generally cylindrical and extends axially from an opening 488 in a sole surface 74 to a bottom wall 408. The recess 404 is positioned on the sole 30 closer to the heel end 22 than to the toe end 18, and closer to the back end 42 than to the face 34. However, in other embodiments, the recess 404 can be positioned at any suitable position on the sole 30, to include closer to the face 34 and in front of the CG.

In the illustrated embodiment, the recess 404 includes the bottom wall 408, and a cylindrical sidewall 412 extending between the bottom wall 408 and the opening 488. The sole 30 includes a sole surface 74 having an adjacent surface portion 78 immediately surrounding the recess 404 where the sole surface 74 meets the cylindrical sidewall 412. A portion of the sole surface 74 at least partially bounds the recess 404 and in some embodiments the adjacent surface portion 78 is a recess edge 78.

The adjuster 400 also includes an adjustment member 436 at least partially received into the recess 404. The adjustment member 436 includes a generally cylindrical body 460 extending between a bottom surface 440 and a keel surface 444 (or projecting surface 444 or contact surface 444) located opposite the bottom surface 440. A through slot 448 extends transversely through the body 460. The through slot 448 can receive a threaded fastener 452 that selectively engages a threaded bore 456 in the cylindrical sidewall 412 to provisionally secure the adjustment member 436 to the golf club head 10 within the recess 404. In other embodiments (not shown), the adjustment member 136 can be secured to the golf club head 10 by other mechanical means (e.g., magnets, etc.). A spring 484 is positioned between the bottom wall 408 of the recess 404 and the bottom surface 440 of the adjustment member 436, and biases the bottom surface 440 away from the bottom wall 408. In other embodiments the spring may be a compressible material, such as foam, or any other suitable compressible material. In other embodiments, no spring is used.

Figure 26:
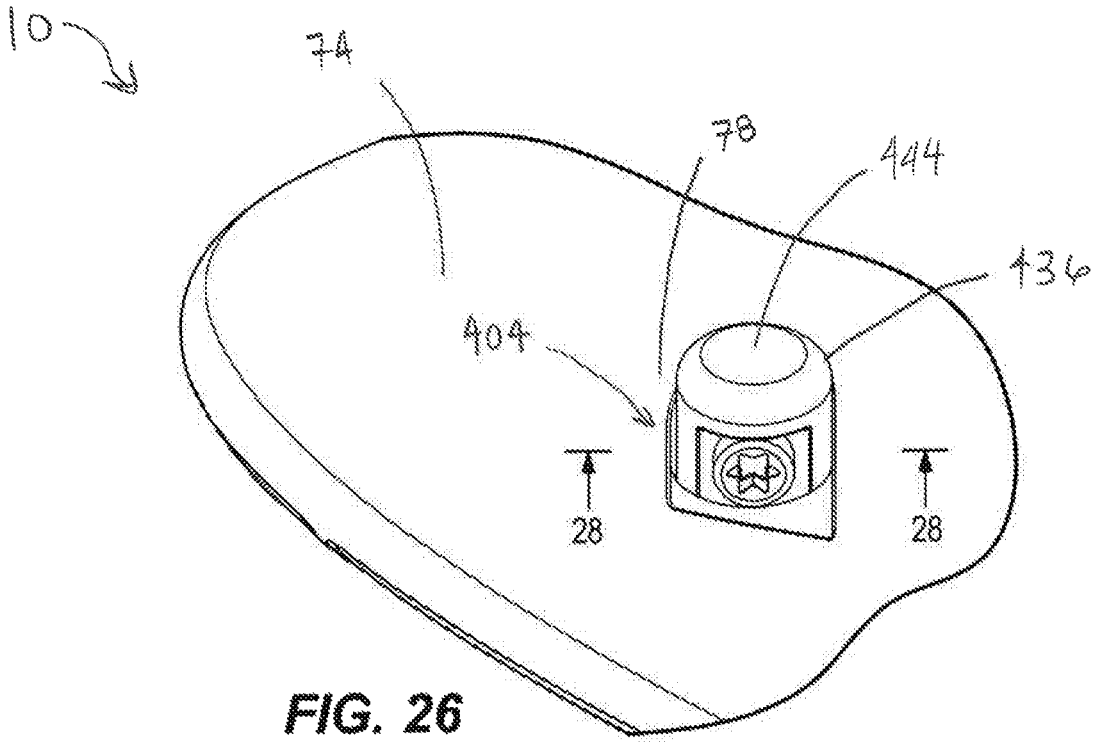
FIG. 26 is a perspective view of a portion of the golf club head of FIG. 24, illustrating the adjustment member in a first position.
Figure 27:
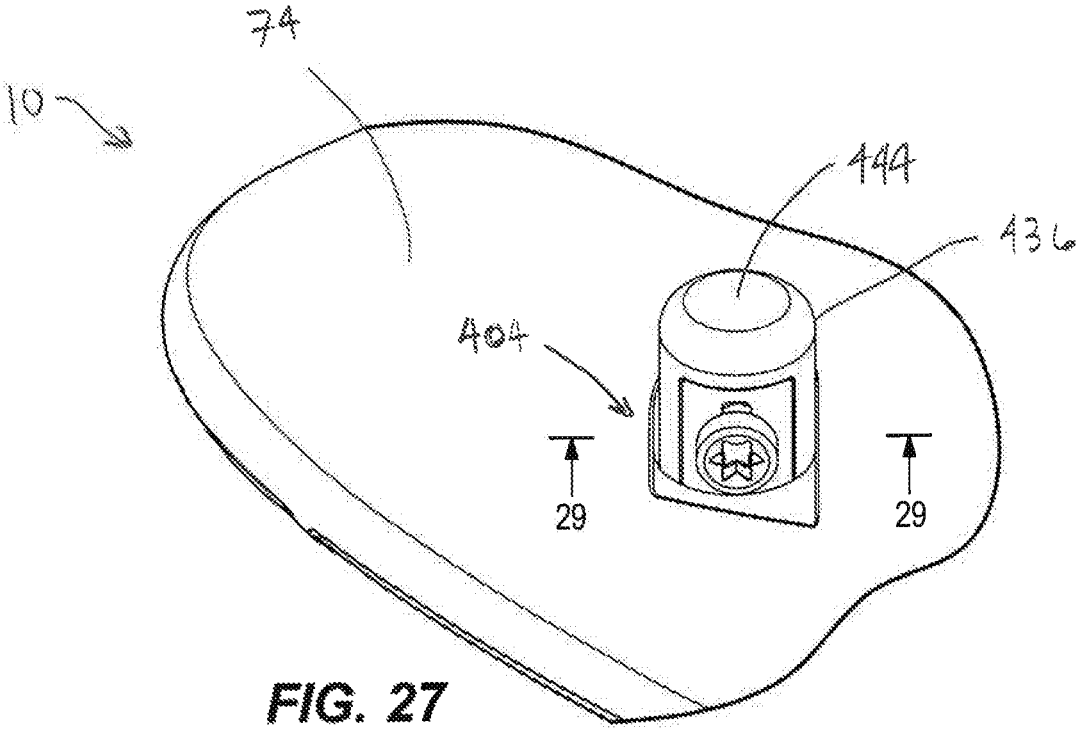
FIG. 27 is another perspective view of a portion of the golf club head of FIG. 24, illustrating the adjustment member in a second position.
Figure 28:
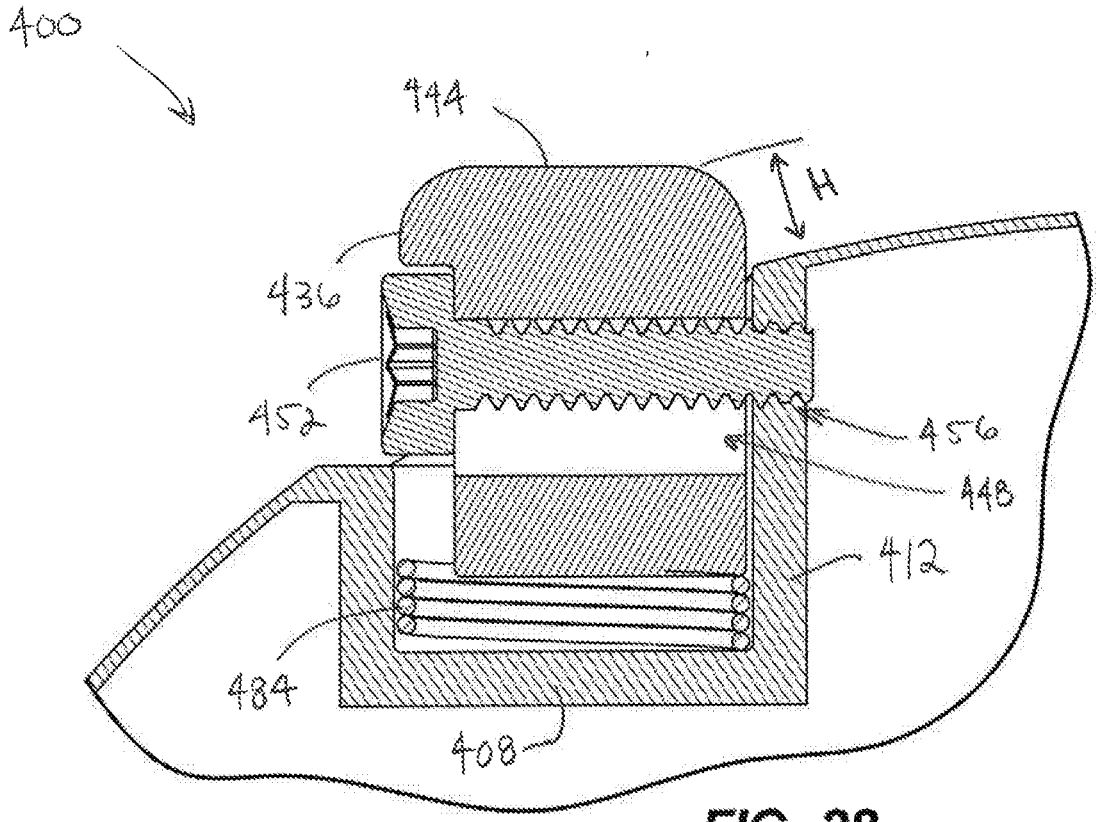
FIG. 28 is a cross-sectional view of the portion of the golf club head of FIG. 24 taken along line 28-28 of FIG. 26.
Figure 29:
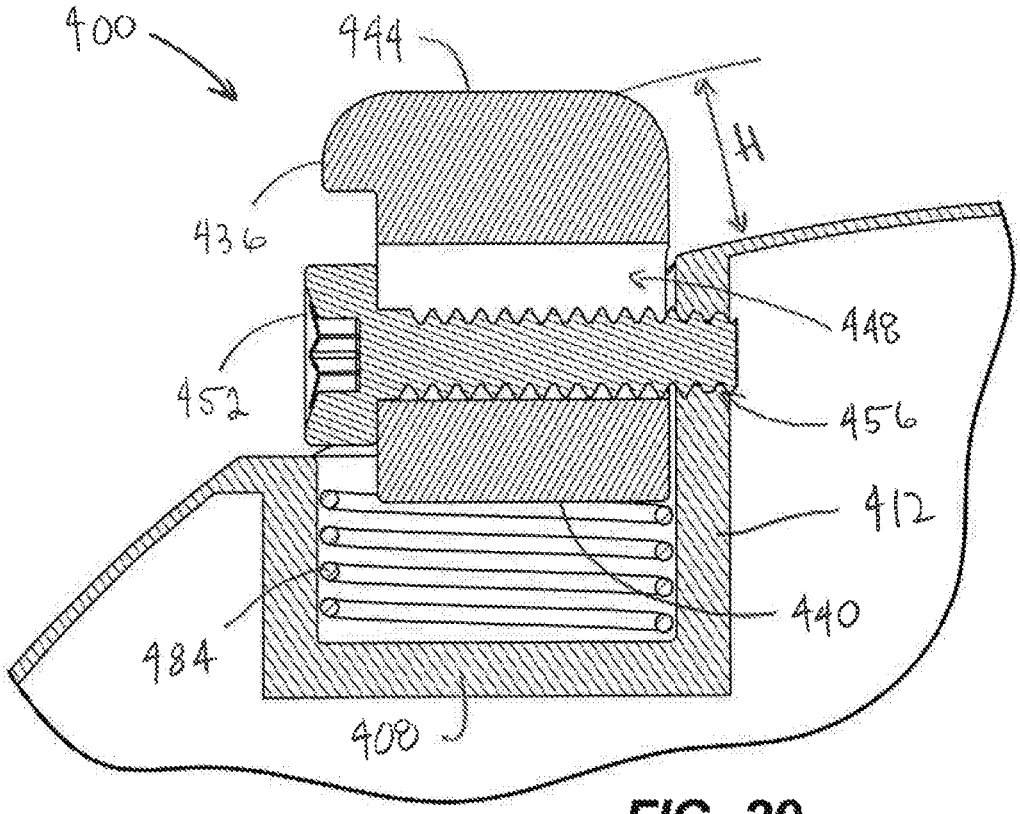
FIG. 29 is another cross-sectional view of the portion of the golf club head of FIG. 24 taken along line 29-29 of FIG. 27.
Figure 30:
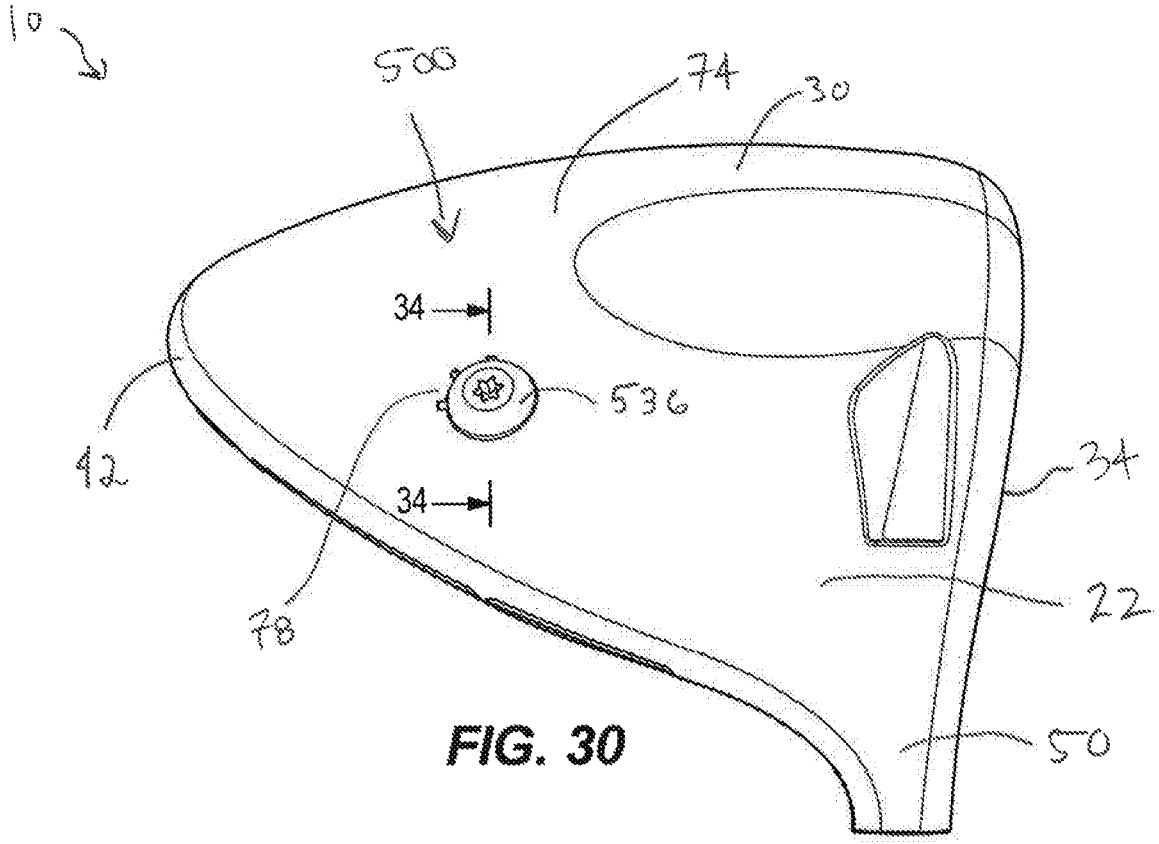
FIG. 30 is a perspective view of a golf club head including a resting face angle adjuster according to another embodiment of the disclosure.
Figure 31:
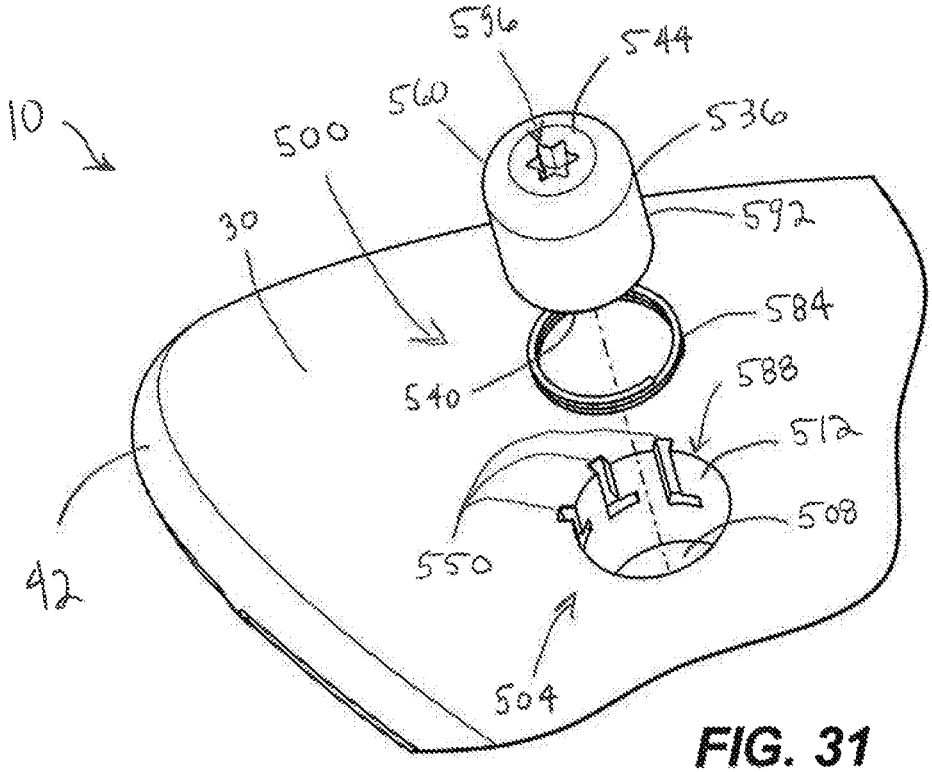
FIG. 31 is an exploded perspective view of a portion of the golf club head of FIG. 30.
Figure 32:
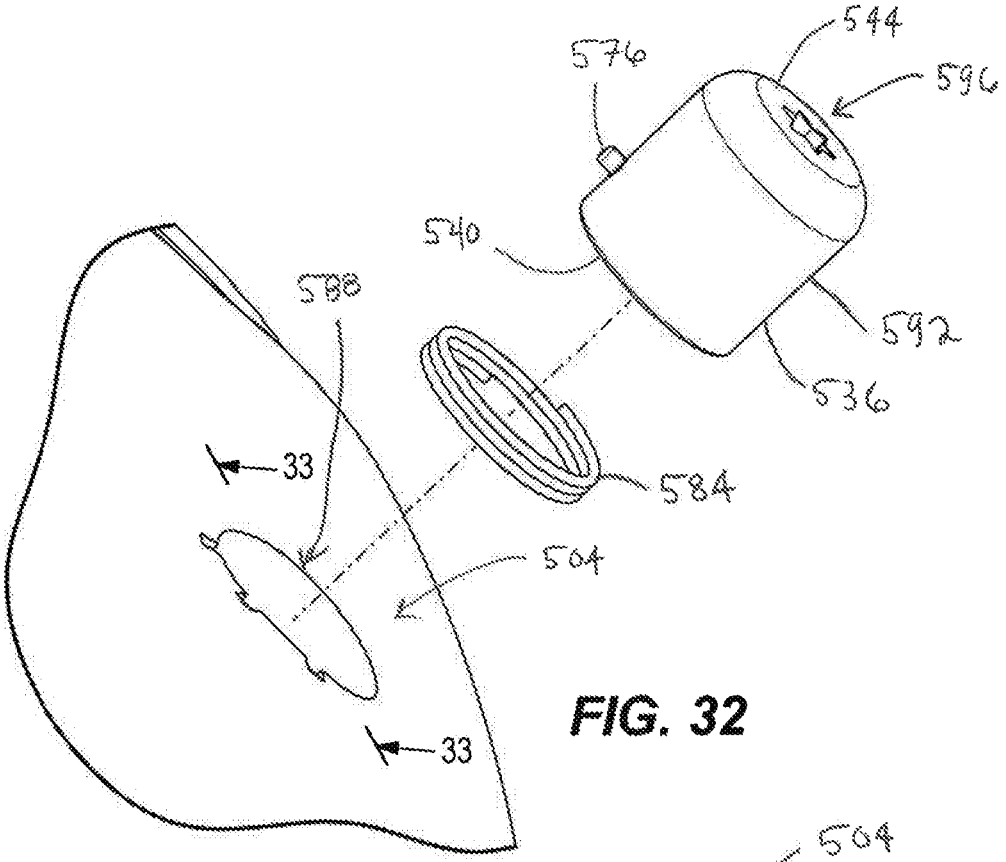
FIG. 32 is another exploded perspective view of the portion of the golf club head of FIG. 30.

Referring now to FIGS. 26-29, the adjustment member 436 is repositionable within the recess 404 in a plurality of adjustment positions between a first, retracted adjustment position (FIGS. 26 and 28) and a second, extended adjustment position (FIGS. 27 and 29), i.e., generally in a crown to sole direction. For example, FIGS. 26 and 28 illustrate the adjustment member 436 in the first adjustment position wherein the bottom surface 440 is located closer to the bottom wall 408. Moving to FIGS. 27 and 29, the adjustment member 436 is depicted in the second adjustment position wherein the bottom surface 440 is located farther from the bottom wall 408. The adjustment member 436 can also be positioned in any number of intermediate adjustment positions (not shown) between the first and second adjustment positions. In other embodiments (not shown), the adjustment member 436 may only be secured in a discrete number of adjustment positions (i.e., two adjustment positions, three adjustment positions, etc.), with surface features within the recess 404 or on the adjustment member 436 as described above with respect to adjuster 100.

In the illustrated embodiment, when the adjustment member 436 is in the first adjustment position, the keel surface 444 protrudes beyond the adjacent surface portion 78 (or edge 78). In other embodiments (not shown), the keel surface 444 is below, or relatively flush with, the adjacent surface portion 78 in the first position. When the adjustment member 436 is in the second adjustment position, the keel surface 444 projects to a greater extent beyond the adjacent surface portion 78 (or edge 78) than when the adjustment member 436 is in the first adjustment position. When the adjustment member is positioned in any intermediate adjustment position (not shown) between the first and second adjustment positions, the keel surface 444 projects to an intermediate extent that is greater than that of the first adjustment position and less than that of the second adjustment position.

In operation of the resting face angle adjuster 400, the location of the adjustment member 436 within the recess 404 can be adjusted by loosening the fastener 452 and sliding the adjustment member 436 into or out of the recess 404. The spring 484 biases the adjustment member 436 away from the bottom wall 408. To slide the adjustment member 436 toward the bottom wall 408, the adjustment member is pressed toward the bottom wall 408 until the spring force of the spring 484 is overcome. For example, the adjustment member 436 can be relocated from the first adjustment position (FIG. 26) to the second adjustment position (FIG. 27) by loosening the fastener 452, permitting the adjustment member 436 to slide within the recess 404 away from the bottom wall 408 (i.e., due to the spring force exerted by the spring 484), and then retightening the fastener 452 to secure the adjustment member 436 in the second adjustment position. Similarly, the adjustment member 436 can be relocated from the second adjustment position (FIG. 27) to the first adjustment position (FIG. 26) by loosening the fastener 452 and pressing the adjustment member 436 toward the bottom wall 408.

By repositioning the adjustment member 436 between the first and second adjustment positions, the keel height H can be adjusted to manipulate the resting face angle at address position. For example, with the adjustment member 436 in the first adjustment position (FIG. 26) wherein the keel surface 444 only minimally extends out of the recess 404, the keel surface 444 may contact the ground and generate its own keel point when the golf club head 10 is at address position. Alternatively, in the first adjustment position the keel surface 444 may not contact the ground when the club head 10 is at address position, or the keel surface 444 may be entirely within the recess 404 and not contact the ground when the club head 10 is at address position. By positioning the adjustment member 436 in the first adjustment position, the resting face angle at address can be oriented into a more open position at address, or alternatively into a neutral position (or neutral configuration or square configuration), with neither the toe end 18 nor the heel end 22 being closer to the golf ball at address (e.g., to promote a straight ball flight).

As another example, the adjustment member 436 can be reoriented to the second adjustment position (FIG. 27) wherein the keel surface 444 extends out of the recess 404 at a sufficient keel height H so that the keel surface 444 contacts the ground and thus generates its own keel point when the golf club head 10 is at address position. In the second position, the keel point generated by the keel surface 444 is located behind the CG 58 (i.e., between the back end 42 and the CG 58 in a direction parallel to the z-axis 70). By repositioning the adjustment member 436 to the second adjustment position, the resting face angle at address can be reoriented into a more closed position either from an open position to a neutral position or from a neutral position to a closed position, with the toe end 18 being closer than the heel end 22 to a golf ball at address (e.g., to promote a draw or a hook). Adjustment between the first and second adjustment positions also moves a keel point on the sole surface 74 from a first position to a second position, as previously described with respect to FIGS. 4-9. The resulting change in resting face angle comparing the first adjustment position to the second adjustment position can be up to 10 degrees. For example, the resulting change in resting face angle comparing the first adjustment position to the second adjustment position can be 1 degree, 2 degrees, 3 degrees, 4 degrees, 5 degrees, 6 degrees, 7 degrees, 8 degrees, 9 degrees, or 10 degrees.

Likewise, the adjustment member 436 can further be repositioned at any intermediate position (not shown) between the first and second adjustment positions, thereby adjusting an extent to which the resting face angle at address is reoriented into a more closed or open position. In other embodiments (not shown), the adjustment member 436 may only be secured in a discrete number of adjustment positions (i.e., two adjustment positions, three adjustment positions, etc.), as described above with respect to adjuster 100.

Referring now to FIGS. 30-37, an embodiment of a resting face angle adjuster 500 is illustrated. The adjuster 500 has similar components to the adjusters 100, 200, 300, and 400, with like names and/or like numbers identifying like components. The adjuster 500 includes a recess 504 positioned on the sole 30 of the golf club head 10. In the illustrated embodiment, the recess 504 is generally cylindrical and extends axially from an opening 588 in a sole surface 74 to a bottom wall 508. The recess 504 is positioned on the sole 30 closer to the heel end 22 than to the toe end 18, and closer to the back end 42 than to the face 34. However, in other embodiments, the recess 504 can be positioned at any suitable position on the sole 30 and in front of the CG.

In the illustrated embodiment, the recess 504 includes the bottom wall 508, and a cylindrical sidewall 512 extending between the bottom wall 508 and the opening 588. The sole 30 includes a sole surface 74 having an adjacent surface portion 78 immediately surrounding the recess 504 where the sole surface 74 meets the cylindrical sidewall 512. A portion of the sole surface 74 at least partially bounds the recess 504 and in some embodiments the adjacent surface portion 78 is a recess edge 78.

Figure 33:
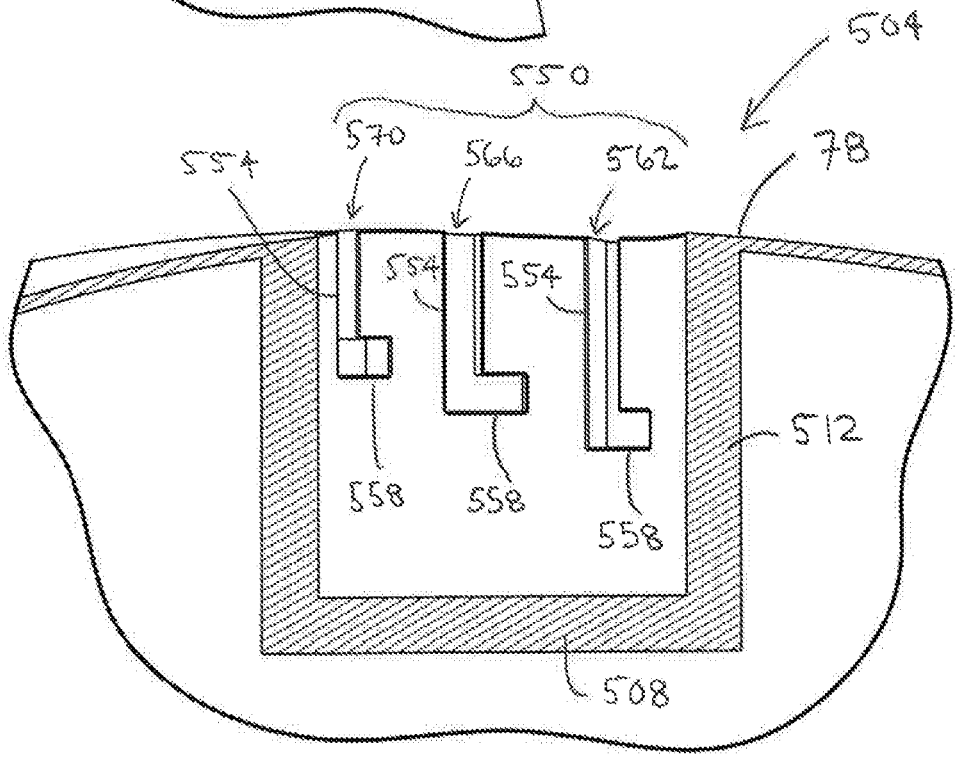
FIG. 33 is a cross-sectional view of the portion of the golf club head of FIG. 30 taken along line 33-33 of FIG. 32, illustrating a cavity having L-shaped slots.
Figure 34:
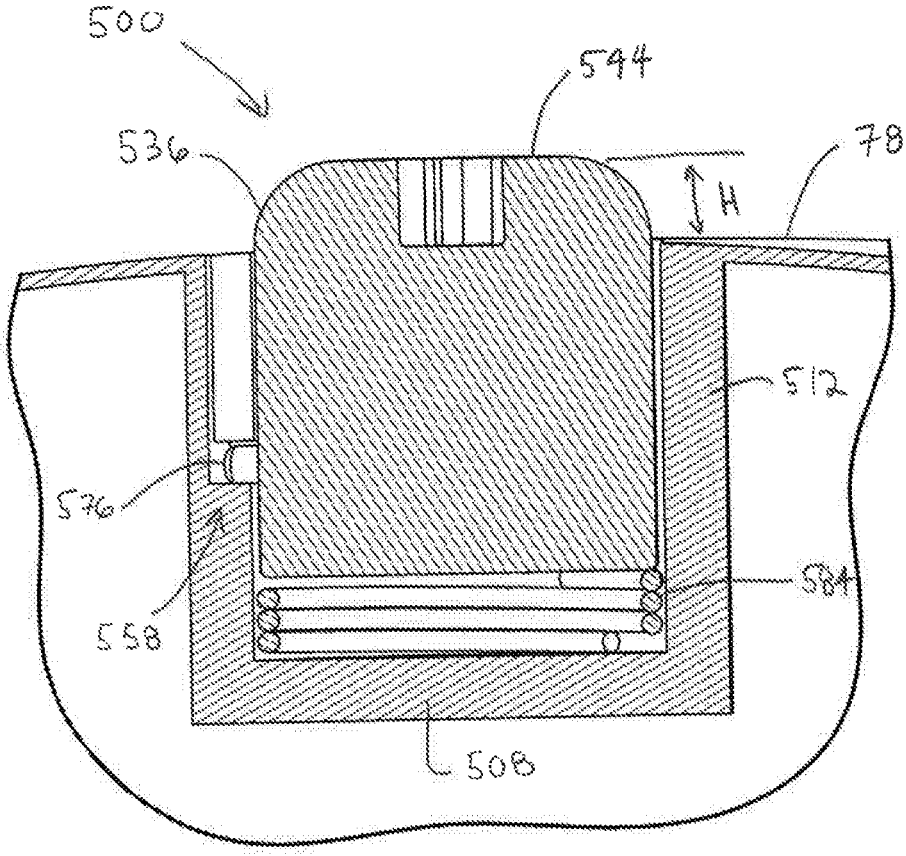
FIG. 34 is another cross-sectional view of the portion of the golf club head of FIG. 30 taken along line 34-34 of FIG. 30.

With reference to FIG. 33, the recess 504 includes J or L-shaped grooves or channels 550 formed into the cylindrical sidewall 512. Each channel 550 includes an axial portion 554 and a circumferential portion 558 that corresponds to a respective adjustment position (and keel height H), as will be discussed in further detail below. In the illustrated embodiment, the recess 504 includes three channels 550 including a first channel 562, a second channel 566, and a third channel 570. In other embodiments (not shown) the recess 504 may include fewer or more than three channels 550 corresponding to fewer or more than three adjustment positions.

The adjuster 500 also includes an adjustment member 536 at least partially received into the recess 504. The adjustment member 536 includes a generally cylindrical body 560 having a circumferential sidewall 592 that extends between a bottom surface 540 and a keel surface 544 (or projecting surface 544 or contact surface 544) located opposite the bottom surface 540. A projection 576 extends radially outward from the circumferential sidewall 592. The projection 576 can selectively engage a respective channel 550 in the cylindrical sidewall 512 to provisionally secure the adjustment member 536 to the golf club head 10 within the recess 504. A tool recess 596 is disposed in the keel surface 544 and selectively engages with a tool bit (not shown) to rotate the adjustment member 536 with respect to the recess 504. A spring 584 is positioned between the bottom wall 508 of the recess 504 and the bottom surface 540 of the adjustment member 536 and biases the bottom surface 540 away from the bottom wall 508, from the crown to the sole. In other embodiments the spring may be a compressible material, such as foam, or any other suitable compressible material. In other embodiments, no spring is used.

Figure 35:
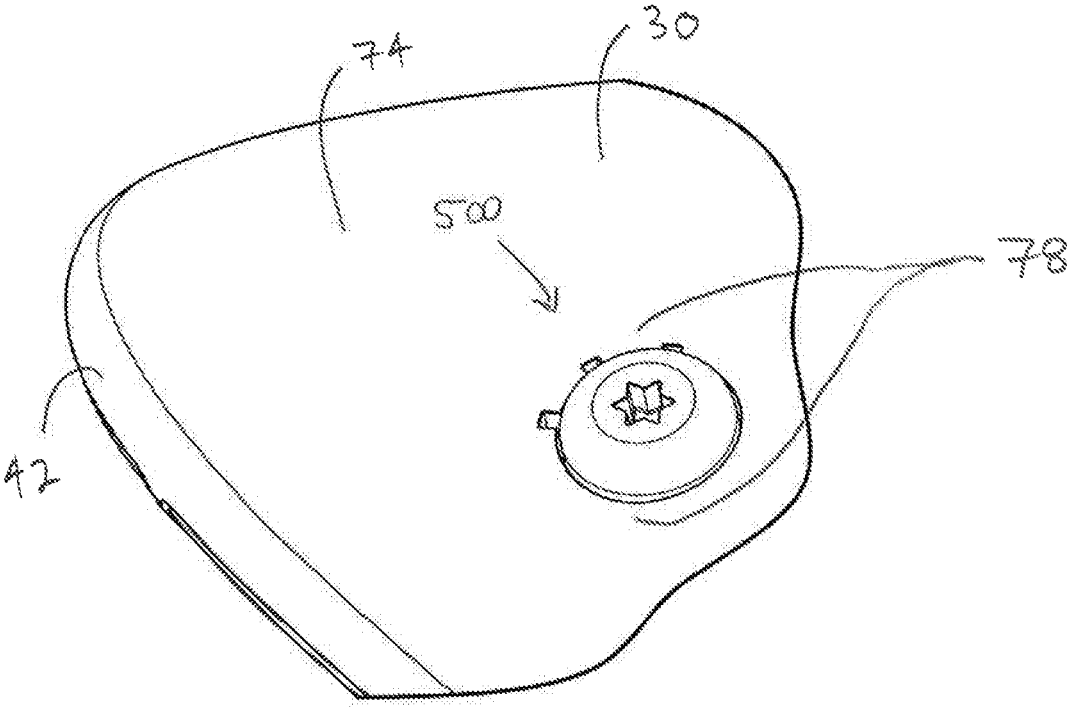
FIG. 35 is a perspective view of the portion of the golf club head of FIG. 30, illustrating the adjustment member in a first position.
Figure 36:
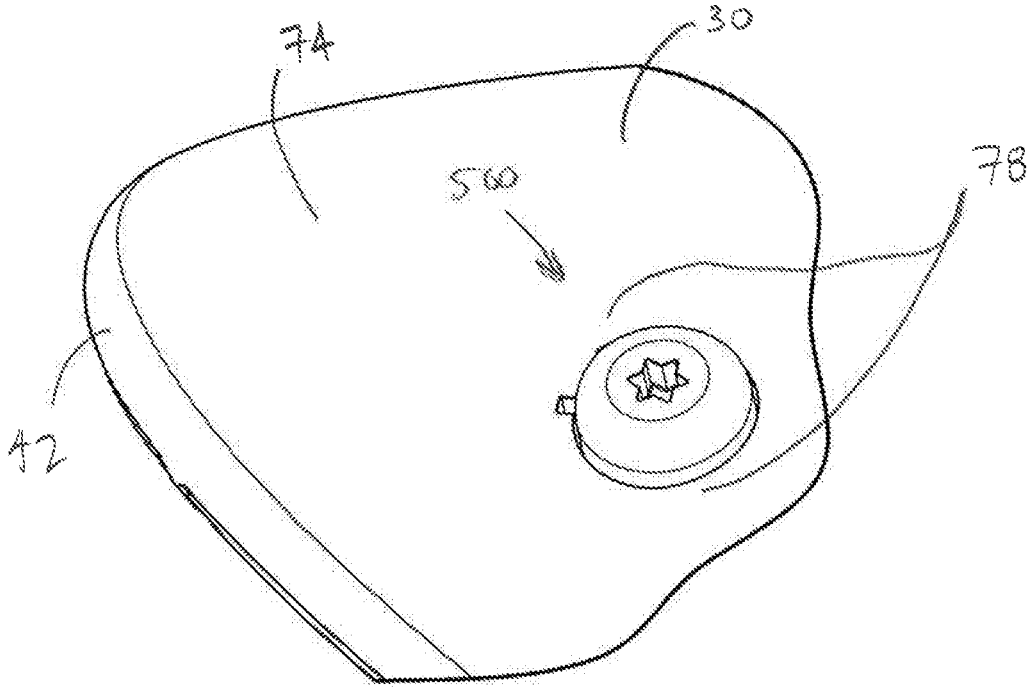
FIG. 36 is another perspective view of the portion of the golf club head of FIG. 30, illustrating the adjustment member in a second position.
Figure 37:
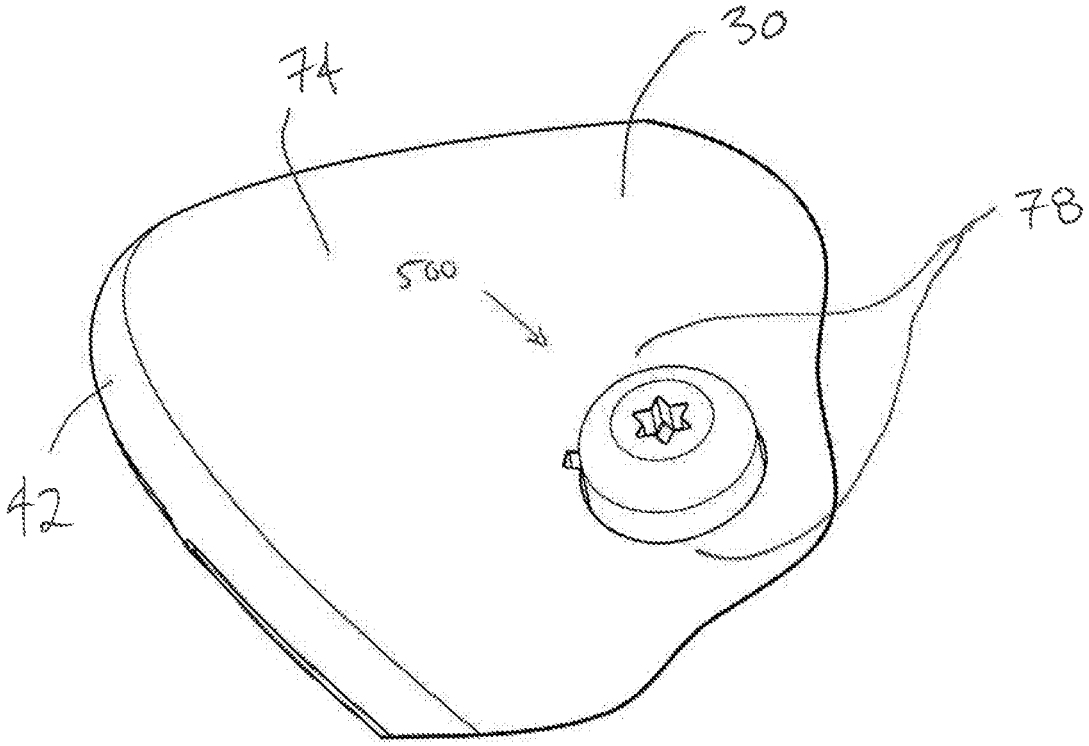
FIG. 37 is another perspective view of the portion of the golf club head of FIG. 30, illustrating the adjustment member in a third position.
Figure 38:
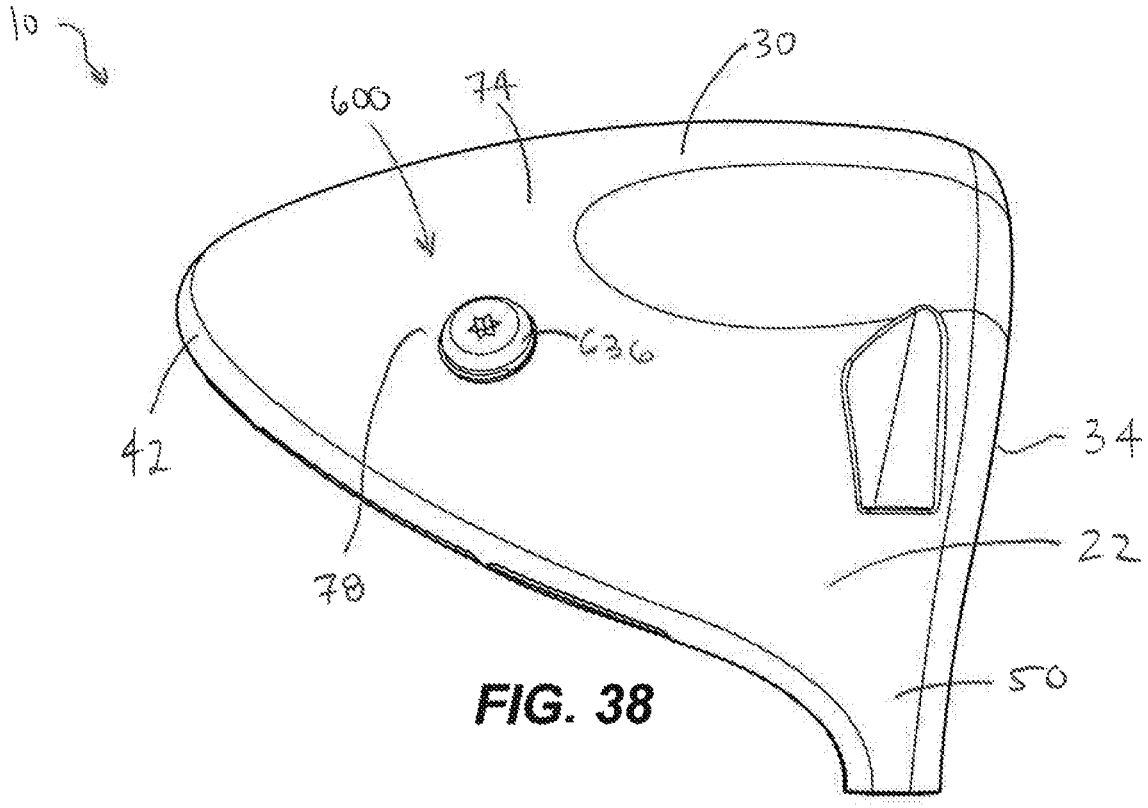
FIG. 38 is a perspective view of a golf club head including a resting face angle adjuster according to another embodiment of the disclosure.
Figure 39:
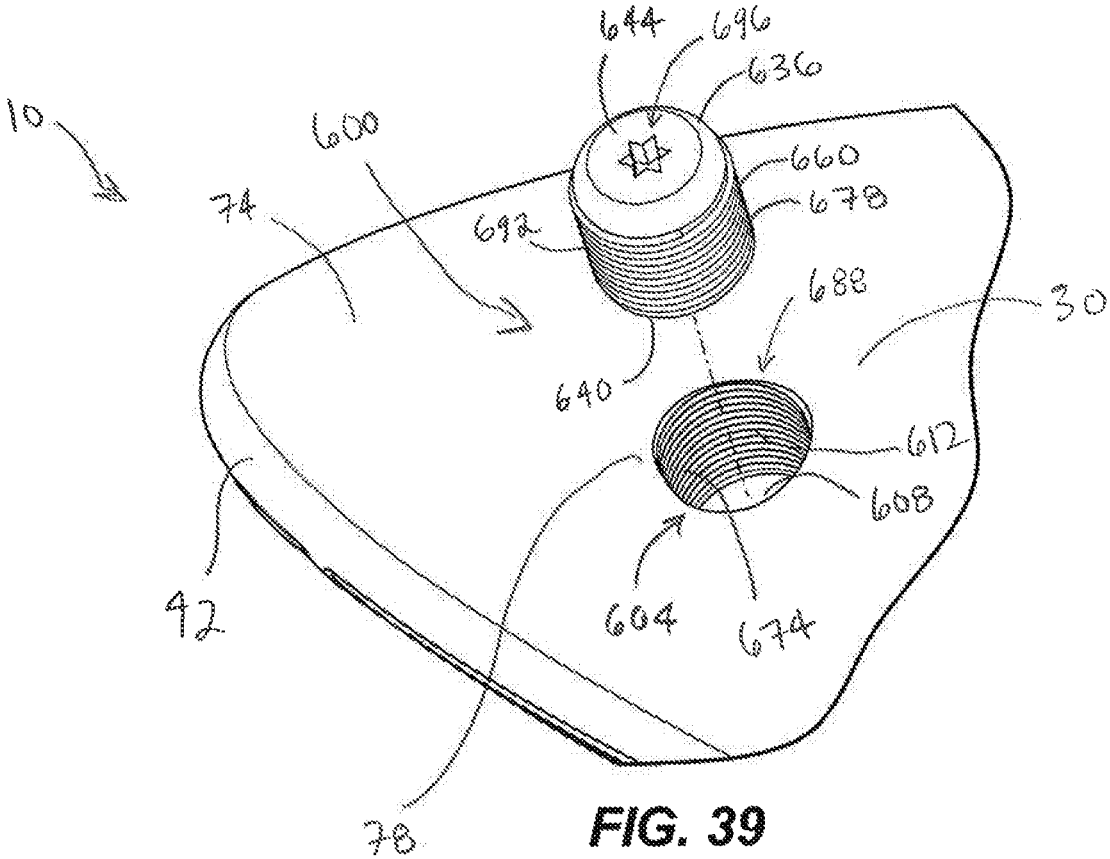
FIG. 39 is an exploded perspective view of the golf club head of FIG. 38.

Referring now to FIGS. 35-37, in the illustrated embodiment, the adjustment member 536 is repositionable within the recess 504 between a first, retracted adjustment position (FIG. 35) a second, partially-extended adjustment position (FIG. 36), and a third, fully-extended adjustment position (FIG. 37). For example, FIG. 35 illustrates the adjustment member 536 in the first adjustment position wherein the projection 576 engages the first channel 562, and the bottom surface 540 is located closest to the bottom wall 508. Referring to FIG. 36, the adjustment member 536 is depicted in the second adjustment position wherein the projection 576 engages the second channel 566, and the bottom surface 540 is located an intermediate distance from the bottom wall 508. Referring to FIG. 37, the adjustment member 536 is depicted in the third adjustment position wherein the projection 576 engages the third channel 570, and the bottom surface 540 is located farthest from the bottom wall 508.

In the illustrated embodiment, when the adjustment member 536 is in the first adjustment position, the keel surface 544 is relatively flush with the adjacent surface portion 78

(or edge 78). When the adjustment member 536 is in the second adjustment position, the keel surface 544 projects to an intermediate extent beyond the adjacent surface portion 78. When the adjustment member 536 is in the third adjustment position, the keel surface 544 projects beyond the adjacent surface portion 78 to a greater extent than when the adjustment member 536 is in the first or second adjustment positions.

In operation of the resting face angle adjuster 500, the location of the adjustment member 536 within the recess 504 can be adjusted by engaging any of the first, second, and third channels 550 of the recess 504. For example, to locate the adjustment member 536 in the first adjustment position (FIG. 35), the adjustment member 536 is first pressed axially into the recess 504 so that the projection 576 engages and traverses the axial portion 554 of the first channel 562, and then the adjustment member 536 is subsequently rotated so that the projection 576 engages and traverses the circumferential portion 558 of the first channel 562. Similarly, the adjustment member 536 can be relocated from the first adjustment position (FIG. 40) to the second adjustment position (FIG. 36) or third adjustment position (FIG. 37) by engaging the adjustment member 536 with the second or third channels 566, 570, in a manner similar to that described above with respect to the first channel 562.

By repositioning the adjustment member 536 between the first, second, and third adjustment positions, the keel height H can be adjusted to manipulate the resting face angle at address position. For example, with the adjustment member 536 in the first adjustment position (FIG. 35) wherein the keel surface 544 is generally flush with the adjacent surface portion 78 or entirely within the recess 504, the keel surface 544 may not contact the ground and thus not generate its own keel point when the golf club head 10 is at address position. By positioning the adjustment member 536 in the first adjustment position, the resting face angle at address can be oriented into a more open position at address, or alternatively into a neutral position (or neutral configuration or square configuration), with neither the toe end 18 nor the heel end 22 being closer to the golf ball at address (e.g., to promote a straight ball flight).

As another example, the adjustment member 536 can be reoriented to the second adjustment position (FIG. 36) wherein the keel surface 544 extends to an intermediate extent out of the recess 504 at a sufficient keel height H so that the keel surface 544 contacts the ground and thus generates its own keel point when the golf club head 10 is at address position. In the second position, the keel point generated by the keel surface 544 is located behind the CG 58 (i.e., between the back end 42 and the CG 58 in a direction parallel to the z-axis 70). By repositioning the adjustment member 536 to the second adjustment position, the resting face angle at address can be reoriented into a more closed position, either from an open position to a neutral position or from a neutral position to a closed position, relative to the first adjustment position, with the toe end 18 being closer than the heel end 22 to a golf ball at address (e.g., to promote a draw or a hook).

As another example, the adjustment member 536 can be reoriented to the third adjustment position (FIG. 37) wherein the keel surface 544 extends out of the recess 504 to a greater extent than when the adjustment member 536 is in the second adjustment positions so that the keel surface 544 again contacts the ground and thus generates its own keel point when the golf club head 10 is at address position. In the third position, the keel point generated by the keel surface 544 is likewise located behind the CG 58 (i.e., between the back end 42 and the CG 58 in a direction parallel to the z-axis 70). By repositioning the adjustment member 536 to the third adjustment position, the resting face angle at address can be reoriented into an even more closed position relative to the first and the second adjustment positions, with the toe end 18 being closer than the heel end 22 to a golf ball at address (e.g., to promote a draw or a hook). In other club heads 10, the aforementioned adjustment of the adjustment member 536 may position the resting face angle from an open position (first adjustment position) to a more neutral position (second adjustment position) to a closed position (third adjustment position). Adjustment between the first and second and third adjustment positions also moves a keel point on the sole surface 74 from a first position to a second position to a third position, as similarly described with respect to FIGS. 4-9. The resulting change in resting face angle comparing the first adjustment position to the third adjustment position can be up to 10 degrees. For example, the resulting change in resting face angle comparing the first adjustment position to the third adjustment position can be 1 degree, 2 degrees, 3 degrees, 4 degrees, 5 degrees, 6 degrees, 7 degrees, 8 degrees, 9 degrees, or 10 degrees.

Referring now to FIGS. 38-43, an embodiment of a resting face angle adjuster 600 is illustrated. The adjuster 600 has similar components to the adjusters 100, 200, 300, 400, and 500, with like names and/or like numbers identifying like components. The adjuster 600 includes a recess 604 positioned on the sole 30 of the golf club head 10. In the illustrated embodiment, the recess 604 is generally cylindrical and extends axially from an opening 688 in a sole surface 74 to a bottom wall 608. The recess 604 is positioned on the sole 30 closer to the heel end 22 than to the toe end 18, and closer to the back end 42 than to the face 34. However, in other embodiments, the recess 604 can be positioned at any suitable position on the sole 30, to include in front of the CG.

In the illustrated embodiment, the recess 604 includes the bottom wall 608, and a cylindrical sidewall 612 extending between the bottom wall 608 and the opening 688. The cylindrical sidewall 612 is a threaded cylindrical sidewall 612 that carries internal threads 674. The sole 30 includes a sole surface 74 having an adjacent surface portion 78 immediately surrounding the recess 604 where the sole surface 74 meets the cylindrical sidewall 612. A portion of the sole surface 74 at least partially bounds the recess 604 and in some embodiments the adjacent surface portion 78 is a recess edge 78.

The adjuster 600 also includes an adjustment member 636 at least partially received into the recess 604. The adjustment member 636 includes a generally cylindrical body 660 having a circumferential sidewall 692 that extends between a bottom surface 640 and a keel surface 644 (or projecting surface 644 or contact surface 644) located opposite the bottom surface 640. The circumferential sidewall 692 is a threaded circumferential sidewall 692 that carries external threads 678. The external threads 678 of the adjustment member 636 can selectively engage the internal threads 674 of the recess 604 to provisionally secure the adjustment member 636 within the recess 604. In other embodiments (not shown), the adjustment member 136 can be secured to the golf club head 10 by other mechanical means (e.g., magnets, etc.). A tool recess 696 is disposed in the keel surface 644 and selectively engages with a tool bit (not shown) to rotate the adjustment member 636 into and out of the recess 604. In some embodiments (not shown), a spring can be positioned between the bottom wall 608 of the recess 604 and the bottom surface 640 of the adjustment member 636, and bias the bottom surface 640 away from the bottom wall 608.

Figure 40:
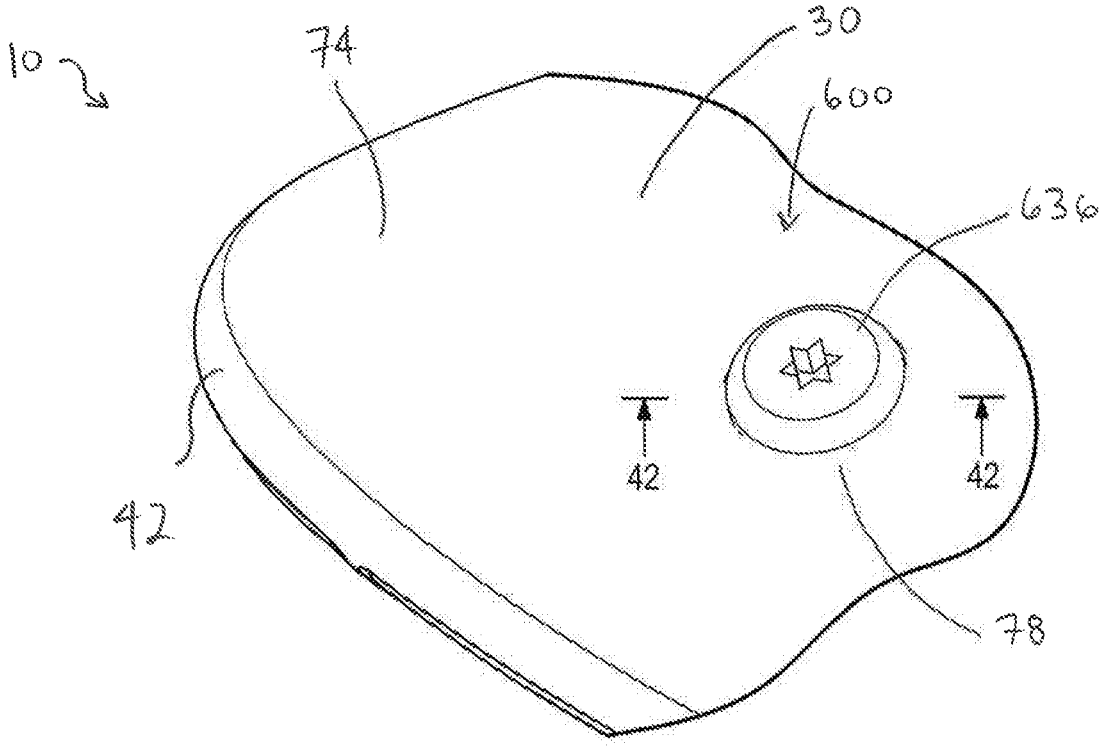
FIG. 40 is a perspective view of a portion of the golf club head of FIG. 38, illustrating the adjustment member in a first position.
Figure 41:
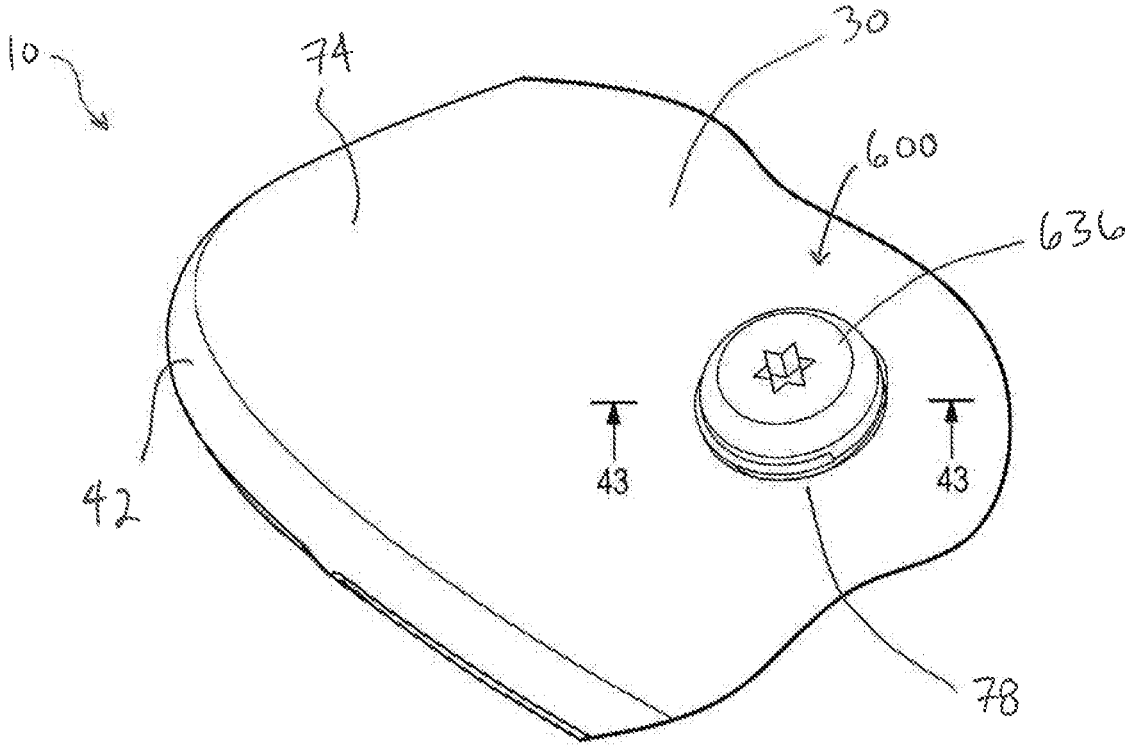
FIG. 41 is another perspective view of the portion of the golf club head of FIG. 38, illustrating the adjustment member in a second position.
Figure 42:
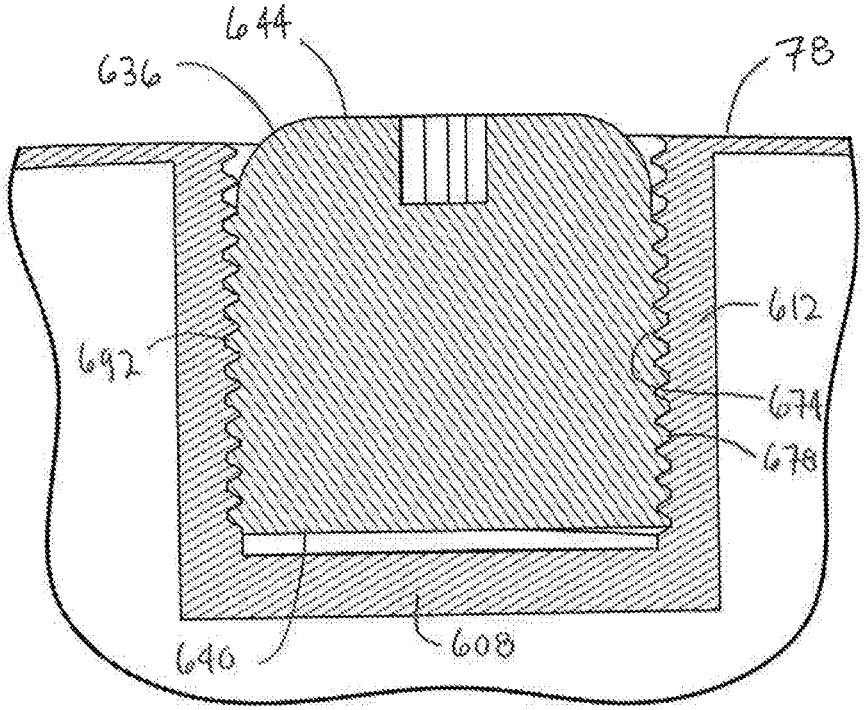
FIG. 42 is a cross-sectional view of the portion of the golf club head of FIG. 38 taken along line 42-42 of FIG. 40.
Figure 43:
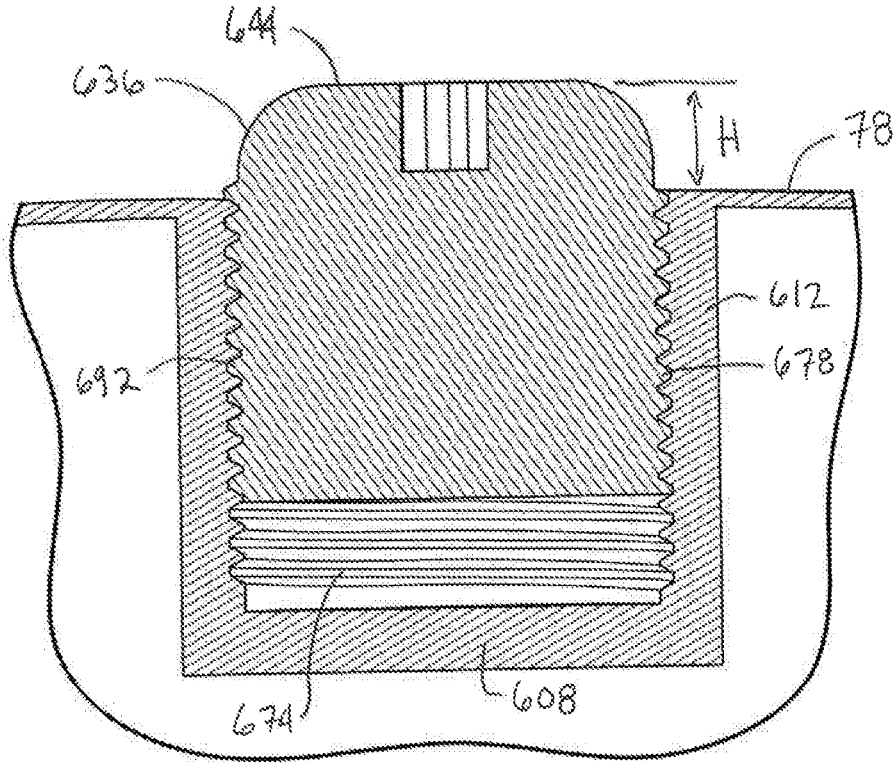
FIG. 43 is another cross-sectional view of the portion of the golf club head of FIG. 38 taken along line 43-43 of FIG. 41.
Figure 44:
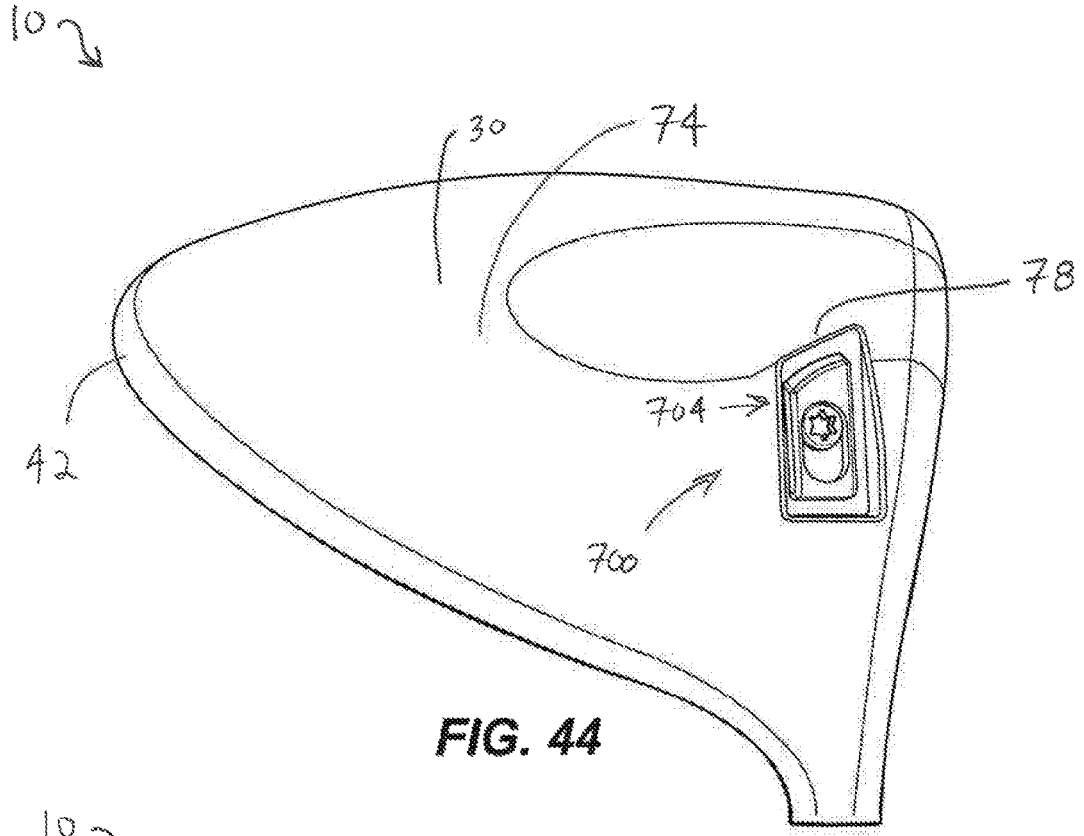
FIG. 44 is a perspective view of a golf club head including a resting face angle adjuster according to another embodiment of the disclosure.
Figure 45:
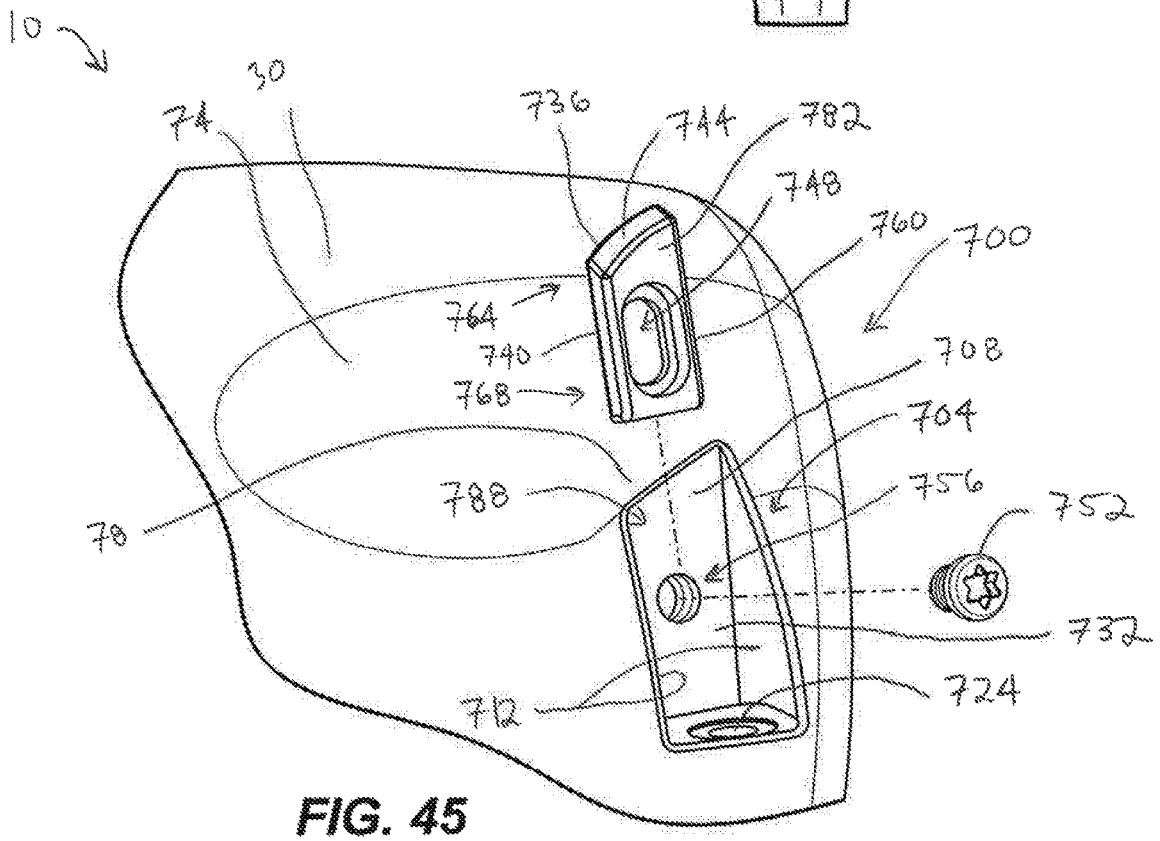
FIG. 45 is an exploded perspective view of the golf club head of FIG. 44.
Figure 46:
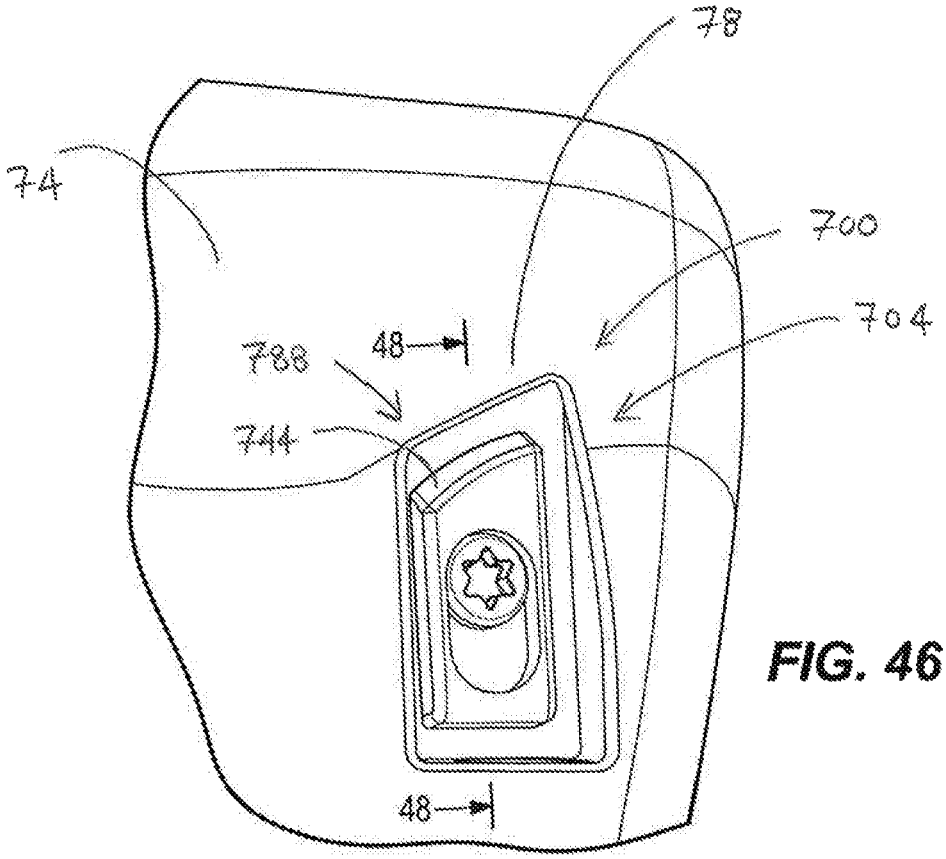
FIG. 46 is a perspective view of a portion of the golf club head of FIG. 44, illustrating the adjustment member in a first position.

Referring now to FIGS. 40-43, the adjustment member 636 is repositionable within the recess 604 in a plurality of adjustment positions between a first, retracted adjustment position (FIGS. 40 and 42) and a second, extended adjustment position (FIGS. 41 and 43). For example, FIGS. 40 and 43 illustrate the adjustment member 636 in the first adjustment position wherein the bottom surface 640 is located closer to the bottom wall 608. Moving to FIGS. 41 and 43, the adjustment member 636 is depicted in the second adjustment position wherein the bottom surface 640 is located farther from the bottom wall 608. The adjustment member 636 can also be positioned in any number of intermediate adjustment positions (not shown) between the first and second adjustment positions.

In the illustrated embodiment, when the adjustment member 636 is in the first adjustment position, the keel surface 644 is below, or relatively flush with, the adjacent surface portion 78. When the adjustment member 636 is in the second adjustment position, the keel surface 644 projects beyond the adjacent surface portion 78 (or edge 78). When the adjustment member is positioned in any intermediate adjustment position (not shown) between the first and second adjustment positions, the keel surface 644 projects to an intermediate extent that is greater than that of the first adjustment position and less than that of the second adjustment position.

In operation of the resting face angle adjuster 600, the location of the adjustment member 636 within the recess 604 can be adjusted by rotating the adjustment member 636 to drive the adjustment member 636 into or out of the recess 604. For example, to move the adjustment member 636 toward the first adjustment position (FIG. 40), the adjustment member is rotated in a first rotational direction to drive the adjustment member into the recess 604 and toward the bottom wall 608. Similarly, the adjustment member 636 can be relocated from the first adjustment position (FIG. 40) to the second adjustment position (FIG. 41) by rotating the adjustment member 636 in a second rotational direction opposite the first rotational direction.

By repositioning the adjustment member 636 between the first and second adjustment positions, the keel height H can be adjusted to manipulate the resting face angle at address position. For example, with the adjustment member 636 in the first adjustment position (FIG. 40) wherein the keel surface 644 does not extend out of the recess 604, the keel surface 644 does not contact the ground and thus does not generate its own keel point when the golf club head 10 is at address position. By positioning the adjustment member 636 in the first adjustment position, the resting face angle at address can be oriented into a more open position at address, or alternatively into a neutral position (or neutral configuration or square configuration), with neither the toe end 18 nor the heel end 22 being closer to the golf ball at address (e.g., to promote a straight ball flight).

As another example, the adjustment member 636 can be reoriented to the second adjustment position (FIG. 41) wherein the keel surface 644 extends out of the recess 604 with a sufficient keel height H so that the keel surface 644 contacts the ground and thus generates its own keel point when the golf club head 10 is at address position. In the second position, the keel point generated by the keel surface 644 is located behind the CG 58 (i.e., between the back end 42 and the CG 58 in a direction parallel to the z-axis 70). By repositioning the adjustment member 636 to the second adjustment position, the resting face angle at address can be reoriented into a more closed position either from an open position to a neutral position or from a neutral position to a closed position, with the toe end 18 being closer than the heel end 22 to a golf ball at address (e.g., to promote a draw or a hook). Adjustment between the first and second adjustment positions also moves a keel point on the sole surface 74 from a first position to a second position, as previously described with respect to FIGS. 4-9. The resulting change in resting face angle comparing the first adjustment position to the second adjustment position can be up to 10 degrees. For example, the resulting change in resting face angle comparing the first adjustment position to the second adjustment position can be 1 degree, 2 degrees, 3 degrees, 4 degrees, 5 degrees, 6 degrees, 7 degrees, 8 degrees, 9 degrees, or 10 degrees.

Likewise, the adjustment member 636 can further be repositioned at any intermediate position (not shown) between the first and second adjustment positions, thereby adjusting an extent to which the resting face angle at address is reoriented into a more closed or open position.

Referring now to FIGS. 44-49, an embodiment of a resting face angle adjuster 700 is illustrated. The adjuster 700 has similar components to the adjusters 100, 200, 300, 400, 500, and 600, with like names and/or like numbers identifying like components. In some embodiments (not shown), any of the adjusters 100, 200, 300, 400, 500, or 600 can be first adjusters 100, 200, 300, 400, 500, or 600, and the adjuster 700 can be a second adjuster 700 combined with the first adjuster 100, 200, 300, 400, 500, or 600 on the golf club head 10.

The adjuster 700 includes a recess 704 that is positioned on the heel end 22 of the golf club head 10. In the illustrated embodiment, the recess 704 is a hosel recess 704 extends from a hosel wall 724 proximate the hosel 50, toward an opening 788 proximate the sole 30. The hosel recess 704 is a substantially straight hosel recess 704 that extends along a portion of the heel end 22. The hosel recess 704 is positioned on the heel end 22 closer to the face 34 than to the back end 42 and in front of the CG.

In the illustrated embodiment, the hosel recess 704 includes the hosel wall 724, a bottom wall 708, and opposing sidewalls 712. The bottom wall 708 and the sidewalls 712 define the opening 788 adjacent the sole 30. The bottom wall 708 defines a sliding surface 732. The sole 30 includes a sole surface 74 having an adjacent surface portion 78 immediately surrounding the opening 788 where the sole surface 74 meets the sidewalls 712 and the bottom wall 708. A portion of the sole surface 74 at least partially bounds the hosel recess 704 and in some embodiments the adjacent surface portion 78 is a recess edge 78.

In the illustrated embodiment, the hosel wall 724 includes a bore that receives a club shaft fastener (not shown). The shaft fastener cooperates with the hosel bore to secure the golf club head 10 to a golf club shaft (not shown). Thus, the hosel recess 704 permits access to the hosel fastener so that the golf club head 10 may be selectively secured to or removed from the shaft, or so that the golf club head 10 may be adjusted relative to the shaft (e.g., to achieve a more open or a more closed resting face angle).

The adjuster 100 also includes an adjustment member 736 at least partially received into the hosel recess 704. The adjustment member 736 includes a body 760 that extends longitudinally between a first end 764 and a second end 768. The body 760 includes a bottom surface 740, a keel surface 744 (or projecting surface 744 or contact surface 744) located at the first end 764, and a through slot 748 extending between the bottom surface 740 and a top surface 782. The through slot 748 can receive a threaded fastener 752 that selectively engages a threaded bore 756 in the bottom wall 708 to provisionally secure the adjustment member 736 to the golf club head 10 within the hosel recess 704. In other embodiments (not shown), the adjustment member 136 can be secured to the golf club head 10 by other mechanical means (e.g., magnets, etc.). When inserted into the hosel recess 704, the bottom surface 740 of the adjustment member 736 abuts the sliding surface 732. The keel surface 744 projects to a keel height H above the adjacent surface portion 78, measured orthogonal to the adjacent surface portion 78 between the adjacent surface portion 78 and the keel surface 744.

Figure 47:
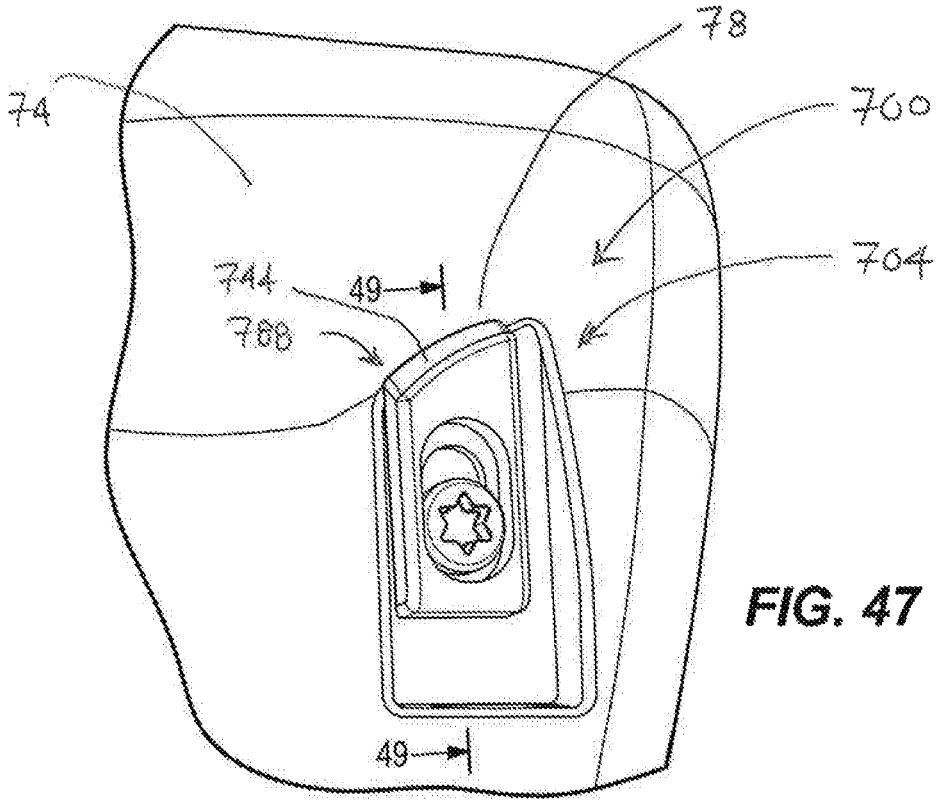
FIG. 47 is another perspective view of the portion of the golf club head of FIG. 44, illustrating the adjustment member in a second position.
Figure 49:
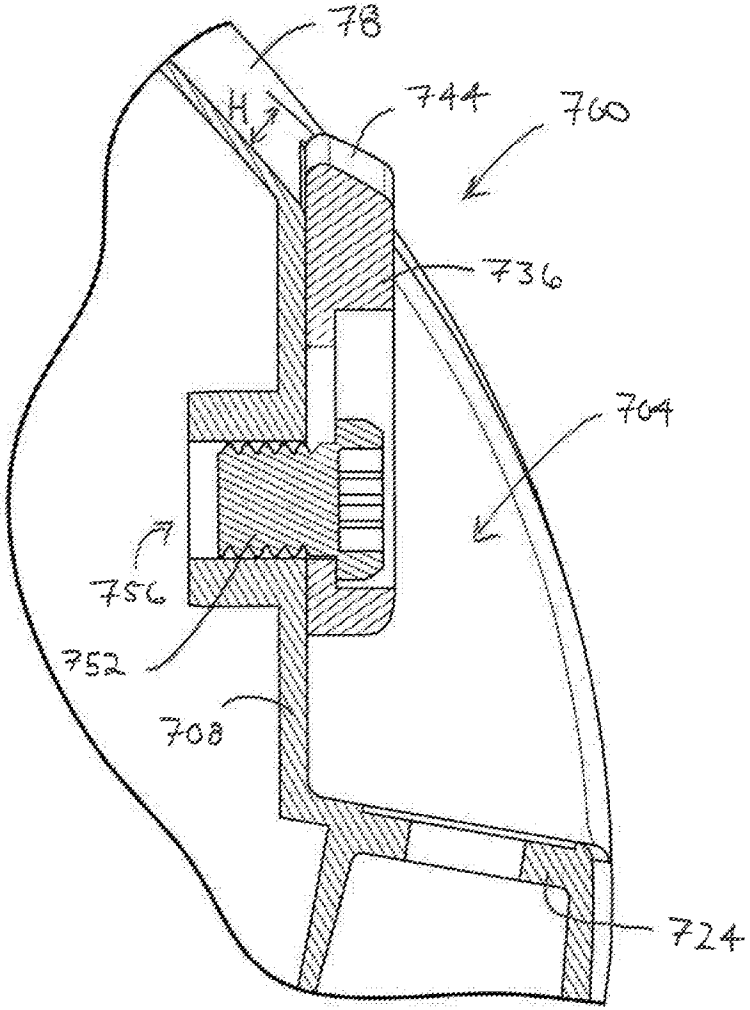
FIG. 49 is another cross-sectional view of the portion of the golf club head of FIG. 44 taken along line 49-49 of FIG. 47.
Figure 48:
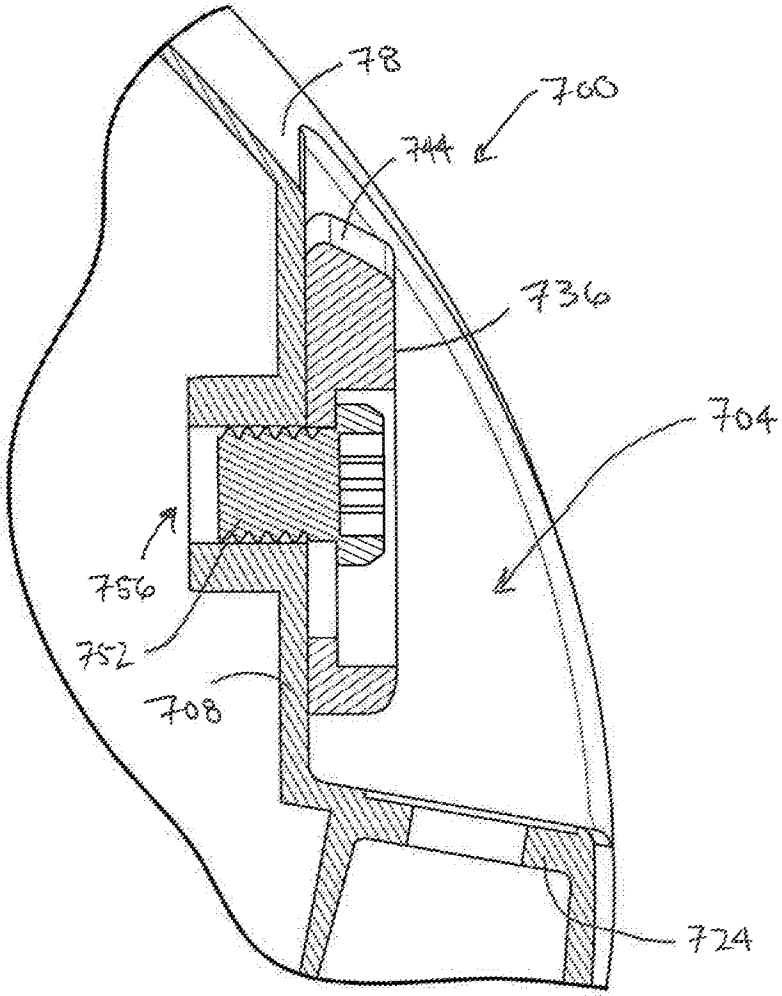
FIG. 48 is a cross-sectional view of the portion of the golf club head of FIG. 44 taken along line 48-48 of FIG. 46.

Referring now to FIGS. 46-49, the adjustment member 736 is repositionable within the hosel recess 704 in a plurality of adjustment positions between a first, retracted adjustment position adjacent the hosel wall 724 (FIGS. 46 and 48), and a second, extended adjustment position adjacent the opening 788 (FIGS. 47 and 49). The adjustment member 736 can also be positioned in any number of intermediate adjustment positions (not shown) between the first and second adjustment positions. In other embodiments (not shown), the adjustment member 736 may only be secured in a discrete number of adjustment positions (i.e., two adjustment positions, three adjustment positions, etc.), with surface features within the recess 704 or on the adjustment member 736 as described above with respect to adjuster 100.

In the illustrated embodiment, when the adjustment member 736 is in the first adjustment position, the keel surface 744 is below, or relatively flush with, the adjacent surface portion 78. When the adjustment member 736 is in the second adjustment position, the keel surface 744 projects beyond the adjacent surface portion 78 (or edge 78). When the adjustment member is positioned in any intermediate adjustment position (not shown) between the first and second adjustment positions, the keel surface 744 projects to an intermediate extent that is greater than that of the first adjustment position and less than that of the second adjustment position.

In operation of the resting face angle adjuster 100, the location of the adjustment member 736 within the hosel recess 704 can be adjusted by loosening the fastener 752 and sliding the adjustment member 736 toward opening 788, or, alternatively, toward the hosel wall 724. For example, the adjustment member 736 can be relocated from the first adjustment position (FIG. 46) to the second adjustment position (FIG. 47) by loosening the fastener 752, sliding the adjustment member 736 within the hosel recess 704 from the hosel wall 724 toward the opening 788, and then retightening the fastener 752 to secure the adjustment member 736 in the second adjustment position. Similarly, the adjustment member 736 can be relocated from the second adjustment position (FIG. 47) to the first adjustment position (FIG. 46) by loosening the fastener 752 and sliding the adjustment member 736 from the opening 788 toward the hosel wall 724.

By repositioning the adjustment member 736 between the first and second adjustment positions, the keel height H can be adjusted to manipulate the resting face angle at address position. For example, with the adjustment member 736 in the first adjustment position (FIG. 46) wherein the keel surface 744 does not extend out of the hosel recess 704 or is positioned entirely within the hosel recess 704, the keel surface 744 does not contact the ground and thus does not generate its own keel point when the golf club head 10 is at address position. By positioning the adjustment member 736 in the first adjustment position, the resting face angle at address can be oriented into a more closed position at address, or alternatively into a neutral position (or neutral configuration or square configuration), with neither the toe end 18 nor the heel end 22 being closer to the golf ball at address (e.g., to promote a straight ball flight).

As another example, the adjustment member 736 can be reoriented to the second adjustment position (FIG. 47) wherein the keel surface 744 extends out of the hosel recess 704 with a sufficient keel height H so that the keel surface 744 contacts the ground and thus generates its own keel point when the golf club head 10 is at address position. In the second position, the keel point generated by the keel surface 744 is located forward of the CG 58 (i.e., between the face 34 and the CG 58 in a direction parallel to the z-axis 70). By repositioning the adjustment member 736 to the second adjustment position, the resting face angle at address can be into a more open position either from a closed position to a neutral position or from a neutral position to an open position, with the heel end 22 being closer than the toe end 18 to a golf ball at address (e.g., to promote a fade or slice). Adjustment between the first and second adjustment positions also moves a keel point on the sole surface 74 from a first position to a second position, as previously described with respect to FIGS. 4-9. The resulting change in resting face angle comparing the first adjustment position to the second adjustment position can be up to 10 degrees. For example, the resulting change in resting face angle comparing the first adjustment position to the second adjustment position can be 1 degree, 2 degrees, 3 degrees, 4 degrees, 5 degrees, 6 degrees, 7 degrees, 8 degrees, 9 degrees, or 10 degrees.

Likewise, the adjustment member 736 can further be repositioned at any intermediate position (not shown) between the first and second adjustment positions, thereby adjusting an extent to which the resting face angle at address is reoriented into a more open or closed position.

In all embodiments of the adjuster 100, 200, 300, 400, 500, 600, and/or 700 heretofore described which include a fastener, such as fastener 152 described with respect to the adjuster 100 of FIGS. 4-9, the adjustment member 136, 236, 336, 436, 536, 636 and/or 736 can also be removed from the recess 104, 204, 304, 404, 504, 604, and/or 704 by disengaging the fastener. The adjustment member 136, 236, 336, 436, 536, 636 and/or 736 can then be rotated, removed and replaced, or otherwise reoriented, and then reinserted, or another adjustment member may be inserted (not shown), into the recess 104, 204, 304, 404, 504, 604, and/or 704. The adjustment member 136, 236, 336, 436, 536, 636 and/or 736 may be reattached to the recess 104, 204, 304, 404, 504, 604, and/or 704 by reinserting and retightening the fastener within the club head 10. In other embodiments of the adjuster 100, 200, 300, 400, 500, 600, and/or 700, the fastener is not removable such that the adjustment member 136, 236, 336, 436, 536, 636 and/or 736 is not removable from the recess.

In some embodiments, one or more of the previously described adjusters 100, 200, 300, 400, 500, 600, and/or 700 could be combined on one club body, for example adjuster 700 with any one of adjusters 100, 200, 300, 400, 500, 600 such that first and secondary adjusters exist on one club body.

Additionally, adjusters 100, 300, 400, 500, and 600 were generally described as positioned behind the CG, though any of adjusters 100, 300, 400, 500, and 600 could be positioned in front of the CG to differently reorient the resting face angle at address.

In some embodiments, one or more of the previously described adjusters 100, 200, 300, 400, 500, 600, and/or 700 could be combined on one club body, for example adjuster 700 with any one of adjusters 100, 200, 300, 400, 500, 600 such that first and secondary adjusters exist on one club body. In these embodiments, the first adjuster could be located behind the CG and the second adjuster located forward of the CG. The resulting range of adjustment for the resting face angle at address can be larger than embodiments with a singular adjuster. For example, combining adjuster 100 with adjuster 700 can result in a greater adjustment resting face angle range than adjuster 100 alone.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to a variety of types of golf clubs including drivers, fairway woods, hybrids, crossovers, or any hollow body type golf clubs. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Although the invention has been described in detail with reference to certain preferred embodiments, variations and modifications exist within the scope and spirit of one or more independent aspects of the invention as described.

Clause 1: A golf club head comprising: a club body having a crown opposite a sole, a toe end opposite a heel end, a back end opposite a face, and a hosel, the sole including a sole surface; and a resting face angle adjuster including a recess formed in the sole such that a portion of the sole surface at least partially bounds the recess; and an adjustment member having a keel surface, the adjustment member being disposed in the recess and positionable between a first adjustment position and a second adjustment position; the adjuster configured such that when the adjustment member is positioned in the first adjustment position, the keel surface is at a first distance relative to the portion of the sole surface in a direction orthogonal to the portion of the sole surface, and when the adjustment member is positioned in the second adjustment position, the keel surface is at a second distance relative to the portion of the sole surface not equal to the first distance in the direction.

Clause 2: The golf club head of clause 1, wherein the keel surface is situated within the recess when the adjustment member is positioned in the first adjustment position.

Clause 3: The golf club head of clause 1, wherein: the adjustment member includes a through slot; the adjuster includes a fastener that selectively secures the adjustment member in each of the first adjustment position and the second adjustment position; and the adjuster is configured such that the fastener is translatable relative to the adjustment member within the through slot.

Clause 4: The golf club head of clause 3, wherein the adjustment member is slidable within the recess relative to the club body between the first and second adjustment positions.

Clause 5: The golf club head of clause 1, wherein the recess includes a channel formed therein, and the adjustment member includes a projection that is configured to engage the channel to selectively secure the adjustment member in one of the first adjustment position and the second adjustment position.

Clause 6: A golf club head comprising: a club body having a crown opposite a sole, a toe end opposite a heel end, a back end opposite a face, and a hosel, the sole including a sole surface; and a resting face angle adjuster including an adjustment member positionable within a recess formed in the sole and defining a recess edge, the adjustment member including a keel surface positionable between a first adjustment position and a second adjustment position, the adjuster configured such that when the adjustment member is positioned in the first adjustment position, a portion of the keel surface is at a first distance from a portion of the recess edge and when the adjustment member is positioned in the second adjustment position, the portion of the keel surface is at a second distance from the portion of the recess edge greater than the first distance.

Clause 7: The golf club head of clause 6, wherein the portion of the keel surface is situated within the recess when the adjustment member is positioned in the first adjustment position.

Clause 8: The golf club head of clause 6, wherein the adjustment member is rotatable about a pivot axis between the first and second adjustment positions.

Clause 9: The golf club head of clause 8, wherein: the adjustment member includes a first end and a second end, and the keel surface extends between the first and second ends; the adjuster configured such that when the adjustment member is positioned in the first adjustment position, a portion of the keel surface adjacent the first end protrudes outside of the recess, and a portion of the keel surface adjacent the second end is situated within the recess; and when the adjustment member is positioned in the second adjustment position, the portion of the keel surface adjacent the first end is situated within the recess, and the portion of the keel surface adjacent the second end protrudes outside of the recess.

Clause 10: The golf club head of clause 9, wherein: the adjustment member is further positionable in a third adjustment position, the adjuster configured such that when the adjustment member is positioned in the third adjustment position, the keel surface is generally coplanar with the portion of the sole surface.

Clause 11: The golf club head of clause 8, wherein: the adjustment member includes a bottom surface opposite the keel surface; the adjuster includes a threaded bore adjacent the recess, and an adjustment screw selectively receivable into the threaded bore, the adjustment screw having a tip portion selectively engageable with the bottom surface, wherein the adjustment screw is rotatable to reposition the adjustment member between the first and second adjustment positions.

Clause 12: The golf club head of clause 6, wherein the adjustment member further includes a spring that biases the adjustment member toward one of the first adjustment position and the second adjustment position.

Clause 13: A golf club head comprising: a club body having a crown opposite a sole, a toe end opposite a heel end, a back end opposite a face, and a hosel, the sole including a sole surface; and a resting face angle adjuster including an adjustment member positionable within a recess formed in the sole, the adjustment member including a keel surface positionable between a first adjustment position and a second adjustment position, wherein the resting face angle adjustment member is configured such that when the adjustment member is positioned in the first adjustment position, the adjustment member effects a keel point at a first location on the club body when the club head is at an address position, and when the adjustment member is positioned in the second adjustment position, the adjustment member effects a keel point at a second location on the club body when the club head is at the address position.

Clause 14: The golf club head of clause 13, wherein the adjustment member is entirely within the recess when the adjustment member is positioned in the first adjustment position.

Clause 15: The golf club head of clause 13, wherein the second location is closer to the face than the first location.

Clause 16: The golf club head of clause 13, wherein the first location is closer to the face than the second location.

Clause 17: The golf club head of clause 13, wherein the adjustment member is rotatable about a pivot axis between the first and second adjustment positions.

Clause 18: The golf club head of clause 13, wherein: the adjustment member includes a through slot; the adjuster includes a fastener that selectively secures the adjustment member in each of the first adjustment position and the second adjustment position; and the adjuster is configured such that the fastener is translatable relative to the adjustment member within the through slot.

Clause 19: The golf club head of clause 18, wherein the adjustment member is slidable within the recess relative to the club body between the first and second adjustment positions.

Clause 20: The golf club head of clause 13, wherein the recess includes a channel formed therein, and the adjustment member includes a projection that is configured to engage the channel to selectively secure the adjustment member in one of the first adjustment position and the second adjustment position.

Clause 21: A golf club head comprising: a club body having a crown opposite a sole including a sole surface, a toe end opposite a heel end, a back end opposite a face, a hosel, and a hosel recess having a hosel surface configured to receive a fastener for securing a golf club shaft to the club body, the hosel recess defining a recess edge, wherein a portion of the sole surface bounds the recess edge; and a resting face angle adjuster including an adjustment member disposed within the hosel recess, the adjustment member including a keel surface, the adjustment member being positionable between a first adjustment position and a second adjustment position, the adjuster configured such that when the adjustment member is positioned in the first adjustment position, the keel surface is at a first distance relative to the portion of the sole surface in a direction orthogonal to the portion of the sole surface, and when the adjustment member is positioned in the second adjustment position, the keel surface is at a second distance relative to the portion of the sole surface not equal to the first distance in the direction.

Clause 22: The golf club head of clause 21, wherein the resting face angle adjustment member is configured such that when the adjustment member is positioned in the first adjustment position, the adjustment member effects a keel point at a first location on the club body, and when the adjustment member is positioned in the second adjustment position, the adjustment member effects a keel point at a second location on the club body different than the first location.

Clause 23: The golf club head of clause 21, wherein the adjustment member is further positionable in a plurality of intermediate adjustment positions between the first adjustment position and the second adjustment position.

Clause 24: The golf club head of clause 23, wherein: the adjustment member includes a through slot; the adjuster includes a fastener that selectively secures the adjustment member in each of the first adjustment position and the second adjustment position; and the adjuster is configured such that the fastener is translatable relative to the adjustment member within the through slot.

Clause 25: The golf club head of clause 24, wherein the adjustment member is slidable within the hosel recess relative to the club body between the first and second adjustment positions.

Various features of the disclosure are set forth in the following claims.

What is claimed is:

1. A golf club head comprising:

a club body having a crown opposite a sole, a toe end opposite a heel end, a back end opposite a face, and a hosel, the sole including a sole surface; and a resting face angle adjuster including an adjustment member positionable within a recess formed in the sole and defining a recess edge, the adjustment member including a keel surface rotatable about a pivot axis between a first adjustment position and a second adjustment position, the adjuster configured such that when the adjustment member is positioned in the first adjustment position, a portion of the keel surface is at a first distance from a portion of the recess edge and when the adjustment member is positioned in the second adjustment position, the portion of the keel surface is at a second distance from the portion of the recess edge greater than the first distance wherein:

the adjustment member includes a first end and a second end, and the keel surface extends between the first and second ends, the adjuster configured such that when the adjustment member is positioned in the first adjustment position, a portion of the keel surface adjacent the first end protrudes outside of the recess, and a portion of the keel surface adjacent the second end is situated within the recess; and when the adjustment member is positioned in the second adjustment position, the portion of the keel surface adjacent the first end is situated within the recess, and the portion of the keel surface adjacent the second end protrudes outside of the recess.

2. The golf club head of claim 1, wherein:

the adjustment member is further rotatable to a third adjustment position, the adjuster configured such that when the adjustment member is positioned in the third adjustment position, the keel surface is generally coplanar with a portion of the sole surface.

3. The golf club head of claim 1, wherein:

the adjustment member includes a bottom surface opposite the keel surface; and the adjuster includes a threaded bore adjacent the recess, and an adjustment screw selectively receivable into the threaded bore, the adjustment screw having a tip portion selectively engageable with the bottom surface, wherein the adjustment screw is rotatable to reposition the adjustment member between the first and second adjustment positions.

4. The golf club head of claim 1, wherein the recess extends longitudinally from a recess front wall, closer to the face than the rear end, to a recess back wall, closer to the rear end than the face.

5. The golf club head of claim 1, wherein the recess is positioned on the sole closer to the heel end than to the toe end.

6. The golf club head of claim 1, wherein a resting face angle of the golf club head is altered by between 1 and 20 degrees when the adjustment member is reoriented from the first adjustment position to the second adjustment position.

7. The golf club head of claim 1, wherein:

by orienting the adjustment member in the first adjustment position, the resting face angle of the golf club head is a more open position than that of a similar club head lacking the adjustment member in the first adjustment position; and by orienting the adjustment member in the second adjustment position, the resting face angle of the golf club head is a more closed position than that of a similar club head lacking the adjustment member in the first adjustment position.

8. The golf club head of claim 1, wherein:

either the first end or the second end of the adjustment member defines a keel point on which the golf club rests against the ground when in a resting or address position;

the golf club head comprises a center of gravity;

the keel point is forward of the center of gravity when the adjustment member is in the first adjustment configuration; and the keel point is behind the center of gravity when the adjustment member is in the second adjustment configuration.

9. The golf club head of claim 1, wherein the adjustment member can only be positioned in a discrete number of adjustment positions.

10. The golf club head of claim 1, wherein the adjustment member can be repositioned in at any intermediate position between the second adjustment position and the third adjustment position.

11. A golf club head comprising:

a club body having a crown opposite a sole, a toe end opposite a heel end, a back end opposite a face, and a hosel, the sole including a sole surface; and a resting face angle adjuster including an adjustment member positionable within a recess formed in the sole and defining a recess edge, the adjustment member including a keel surface rotatable about a pivot axis between a first adjustment position, a second adjustment position, and a neutral position;

wherein:

the adjustment member includes a first end and a second end, and the keel surface extends between the first and second ends, the adjuster configured such that:

when the adjustment member is positioned in the first adjustment position, a portion of the keel surface adjacent the first end protrudes outside of the recess, and a portion of the keel surface adjacent the second end is situated within the recess;

when the adjustment member is positioned in the second adjustment position, the portion of the keel surface adjacent the first end is situated within the recess, and the portion of the keel surface adjacent the second end protrudes outside of the recess; and when the adjustment member is positioned in the neutral position, the keel surface is generally coplanar with a portion of the sole surface.

12. The golf club head of claim 11, wherein:

the adjustment member includes a bottom surface opposite the keel surface; and the adjuster includes a threaded bore adjacent the recess, and an adjustment screw selectively receivable into the threaded bore, the adjustment screw having a tip portion selectively engageable with the bottom surface, wherein the adjustment screw is rotatable to reposition the adjustment member between the first and second adjustment positions.

13. The golf club head of claim 11, wherein the recess extends longitudinally from a recess front wall, closer to the face than the rear end, to a recess back wall, closer to the rear end than the face.

14. The golf club head of claim 11, wherein the recess is positioned on the sole closer to the heel end than to the toe end.

15. The golf club head of claim 11, wherein a resting face angle of the golf club head is altered by between 1 and 20 degrees when the adjustment member is reoriented from the first adjustment position to the second adjustment position.

16. The golf club head of claim 11, wherein:

by orienting the adjustment member in the first adjustment position, a resting face angle of the golf club head is a more open position than that of a similar club head lacking the adjustment member in the first adjustment position; and by orienting the adjustment member in the second adjustment position, the resting face angle of the golf club head is a more closed position than that of a similar club head lacking the adjustment member in the first adjustment position.

17. The golf club head of claim 11, wherein:

either the first end or the second end of the adjustment member defines a keel point on which the golf club rests against the ground when in a resting or address position;

the golf club head comprises a center of gravity;

the keel point is forward of the center of gravity when the adjustment member is in the first adjustment configuration; and the keel point is behind the center of gravity when the adjustment member is in the second adjustment configuration.

18. The golf club head of claim 11, wherein the adjustment member can only be positioned in a discrete number of adjustment positions.

19. The golf club head of claim 18, wherein the adjustment member can only be positioned in three, four, or five adjustment positions.

20. The golf club head of claim 11, wherein the adjustment member can be repositioned in at any intermediate position between the second adjustment position and the third adjustment position.

* * * * *